US008431304B2

(12) United States Patent
Sugimoto et al.

(10) Patent No.: US 8,431,304 B2
(45) Date of Patent: Apr. 30, 2013

(54) TONER AND DEVELOPER

(75) Inventors: Tsuyoshi Sugimoto, Shizuoka (JP); Naohiro Watanabe, Shizuoka (JP); Osamu Uchinokura, Shizuoka (JP); Tomoyuki Satoh, Kanagawa (JP); Shinya Hanatani, Shizuoka (JP); Mamoru Hozumi, Miyagi (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 13/210,773

(22) Filed: Aug. 16, 2011

(65) Prior Publication Data

US 2012/0052434 A1 Mar. 1, 2012

(30) Foreign Application Priority Data

Aug. 31, 2010 (JP) ..... 2010-194609

(51) Int. Cl.
*G03G 9/00* (2006.01)

(52) U.S. Cl.
USPC ..... 430/109.4; 430/109.1

(58) Field of Classification Search ..... 430/109.1, 430/109.4
See application file for complete search history.

(56) References Cited

U.S. PATENT DOCUMENTS

| | | | | |
|---|---|---|---|---|
| 7,306,887 | B2 | 12/2007 | Tanaka et al. | |
| 7,413,839 | B2 | 8/2008 | Matsumoto et al. | |
| 7,449,273 | B2 | 11/2008 | Ohki et al. | |
| 7,459,255 | B2 | 12/2008 | Tanaka et al. | |
| 7,485,401 | B2 * | 2/2009 | Matsumura et al. | 430/109.4 |
| 7,550,243 | B2 | 6/2009 | Matsumoto et al. | |
| 7,550,245 | B2 | 6/2009 | Inoue et al. | |
| 7,662,532 | B2 | 2/2010 | Tomita | |
| 7,718,339 | B2 | 5/2010 | Tomita et al. | |
| 7,829,254 | B2 | 11/2010 | Kurose et al. | |
| 2006/0057488 | A1 | 3/2006 | Inoue et al. | |
| 2007/0218390 | A1 | 9/2007 | Nozaki et al. | |
| 2008/0096119 | A1 | 4/2008 | Yamamoto et al. | |
| 2008/0102393 | A1 | 5/2008 | Hasegawa | |
| 2009/0075195 | A1 | 3/2009 | Shu et al. | |
| 2010/0129748 | A1 | 5/2010 | Inoue et al. | |
| 2010/0216068 | A1 | 8/2010 | Kotsugai et al. | |
| 2010/0310980 | A1 | 12/2010 | Sugimoto et al. | |
| 2011/0002719 | A1 | 1/2011 | Shu et al. | |
| 2011/0076612 | A1 | 3/2011 | Awamura et al. | |

FOREIGN PATENT DOCUMENTS

| | | |
|---|---|---|
| JP | 2579150 | 11/1996 |
| JP | 11-133665 | 5/1999 |
| JP | 2001-158819 | 6/2001 |
| JP | 2002-287400 | 10/2002 |
| JP | 2002-351143 | 12/2002 |
| JP | 2005-275146 | 10/2005 |
| JP | 2007-57660 | 3/2007 |
| JP | 2007-271789 | 10/2007 |
| JP | 4175505 | 8/2008 |

OTHER PUBLICATIONS

U.S. Appl. No. 13/208,941, filed Aug. 12, 2011, Hozumi, et al.
U.S. Appl. No. 13/086,833, filed Apr. 14, 2011, Sugimoto, et al.
U.S. Appl. No. 13/025,277, filed Feb. 11, 2011, Tsuyoshi Sugimoto, et al.

* cited by examiner

*Primary Examiner* — Mark F. Huff
*Assistant Examiner* — Stewart Fraser
(74) *Attorney, Agent, or Firm* — Oblon, Spivak, McClelland, Maier & Neustadt, L.L.P.

(57) ABSTRACT

A toner containing: a non-crystalline polyester resin; a crystalline polyester resin; a releasing agent; a graft-modified polymer; and a colorant, wherein the graft-modified polymer is a polymer having a glass transition temperature of higher than 40° C. but lower than 80° C., and obtained by grafting an acrylic resin onto at least one of a hydrocarbon wax and a crystalline polyester resin, and wherein a SP value of the non-crystalline polyester resin is defined as SP1, a SP value of the crystalline polyester resin is defined as SP2, a SP value of the releasing agent is defined as SP3, and a SP value of the graft-modified polymer is defined as SP4, and SP1, SP2, SP3 and SP4 satisfy relations represented by Formulas (1) to (3):

| | |
|---|---|
| $SP1 > SP4 > SP2 > SP3$ | Formula (1), |
| $0.1 < SP1 - SP4 < 1.0$ | Formula (2), and |
| $0.1 < SP4 - SP2 < 1.0$ | Formula (3). |

14 Claims, No Drawings

TONER AND DEVELOPER

BACKGROUND OF THE INVENTION

1. Field of the Invention

The present invention relates to a toner and a developer.

2. Description of the Related Art

In recent years, demand has arisen on the market for toners having various advantageous properties such as small particle diameters for forming high-quality output images, high temperature offset resistance, low temperature fixing ability for energy saving, and heat resistant storage stability during storage after production or during conveyance of a product at high temperature and high humidity. Particularly, power consumption for fixation accounts for a large proportion of the power consumed in an image forming step, and improvement of the low temperature fixing ability is extremely important.

Conventionally, toners produced by kneading-pulverizing method have been used. Toners obtained by the conventional kneading-pulverizing method are not easily made to have a small particle diameter, and each have an indeterminate shape, and broad particle size distribution. Thus, output images have insufficient quality. Furthermore, these toners have various problems such as requiring a large amount of energy for being fixed. In particular, when toner materials including wax (releasing agent) for improving fixing ability are used to produce a toner by the kneading-pulverizing method, cracks occur at the interfaces of the wax during pulverization, resulting in that the wax exists on the toner surface in a large amount. As a result, although the releasing effects can be obtained, toner adhesion to a carrier, a photoconductor and a blade is likely to occur. The properties of such toners are not satisfactory in total.

In order to overcome the above-described problems the kneading-pulverizing method has, there is proposed a method for producing a toner by a polymerization method. According to the polymerization method, toners are made easily to have a small particle diameter. Their particle size distribution is sharper than that of the toners obtained by the pulverizing method. Furthermore, the wax can be embedded in the toner particles. As one exemplary method for producing a toner by the polymerization method, Japanese Patent Application Laid-Open (JP-A) No. 11-133665 discloses a method for producing a toner using, as a binder, an elongated product of a urethane-modified polyester for the purposes of improving the low temperature fixing ability and hot offset resistance of the toner.

Also, JP-A Nos. 2002-287400 and 2002-351143 disclose a method for producing a toner having excellent fluidity and transferability as powder with a small particle diameter as well as being excellent in heat resistant storage stability, low temperature fixing ability and high temperature offset resistance.

Japanese Patent (JP-B) No. 2579150 and JP-A No. 2001-158819 disclose a method for producing a toner including an aging step for producing a toner binder having a more stable molecular weight distribution and for attaining both low temperature fixing ability and high temperature offset resistance.

However, these proposed techniques do not satisfy high level of low temperature fixing ability demanded recently.

In order to obtain high level of low temperature fixing ability, there is a proposal of a toner containing a crystalline polyester resin-containing resin and a releasing agent, wherein the resin and the wax are incompatible with each other, to thereby form a sea-island phase separation structure (for example, Japanese Patent Application Laid-Open (JP-A) No. 2004-46095).

Moreover, there is a proposal of a toner containing a crystalline polyester resin, a releasing agent and a graft polymer (for example, JP-A No. 2007-271789).

However, by the techniques of these proposals, heat resistant storage stability, high temperature offset resistance, and high-level low temperature fixing ability can be obtained, but the crystalline polyester resin and the releasing agent are not sufficiently dispersed, causing filming.

Therefore, currently there is a demand for a toner having excellent low temperature fixing ability, high temperature offset resistance, and heat resistant storage stability without causing filming, and a developer containing the toner.

BRIEF SUMMARY OF THE INVENTION

The present invention solves the conventional problems and achieve the following object. That is, the present invention aims to provide a toner having excellent low temperature fixing ability, high temperature offset resistance, and heat resistant storage stability without causing filming, and a developer containing the toner.

Means for solving the problems are as follows.

<1> A toner containing: a non-crystalline polyester resin; a crystalline polyester resin; a releasing agent; a graft-modified polymer; and a colorant, wherein the graft-modified polymer is a polymer having a glass transition temperature of higher than 40° C. but lower than 80° C., and obtained by grafting an acrylic resin onto at least one of a hydrocarbon wax and a crystalline polyester resin, and wherein a SP value of the non-crystalline polyester resin is defined as SP1, a SP value of the crystalline polyester resin is defined as SP2, a SP value of the releasing agent is defined as SP3, and a SP value of the graft-modified polymer is defined as SP4, and SP1, SP2, SP3 and SP4 satisfy relations represented by Formulas (1) to (3):

| | |
|---|---|
| $SP1 > SP4 > SP2 > SP3$ | Formula (1), |
| $0.1 < SP1 - SP4 < 1.0$ | Formula (2), and |
| $0.1 < SP4 - SP2 < 1.0$ | Formula (3). |

<2> The toner according to <1>, wherein the amount of the at least one of the hydrocarbon wax and the crystalline polyester resin in the graft-modified polymer is 2 parts by mass to 25 parts by mass, relative to 100 parts by mass of the graft-modified polymer.

<3> The toner according to any one of <1> and <2>, wherein the weight average molecular weight of the at least one of the hydrocarbon wax and the crystalline polyester resin in the graft-modified polymer is 500 to 20,000.

<4> The toner according to any one of <1> to <3>, wherein the weight average molecular weight of the acrylic resin in the graft-modified polymer is 5,000 to 100,000.

<5> The toner according to any one of <1> to <4>, wherein the crystalline polyester resin has a constituent unit derived from saturated aliphatic dicarboxylic acid and a constituent unit derived from saturated aliphatic diol.

<6> The toner according to any one of <1> to <5>, wherein the crystalline polyester resin has a melting point of 60° C. or higher but lower than 80° C.

<7> The toner according to any one of <1> to <6>, wherein the releasing agent is a hydrocarbon wax, and the hydrocarbon wax has a melting point of 60° C. or higher but lower than 95° C.

<8> The toner according to any one of <1> to <7>, wherein the SP1 and the SP2 satisfy a relation represented by Formula (4):

$$0.5<SP1-SP2<1.5 \quad \text{Formula (4).}$$

<9> The toner according to any one of <1> to <8>, wherein a mass of the toner is defined as W1, a mass of the crystalline polyester resin in the toner is defined as W2, a mass of the releasing agent in the toner is defined as W3, and a mass of the graft-modified polymer in the toner is defined as W4, and W1, W2, W3 and W4 satisfy relations represented by Formulas (5) to (7):

$$W1:W2:W3:W4=100:2 \text{ to } 20:2 \text{ to } 10:1 \text{ to } 10 \quad \text{Formula (5)}$$

$$0.2<W4/W2<1.0 \quad \text{Formula (6), and}$$

$$0.2<W4/W3<1.0 \quad \text{Formula (7).}$$

<10> The toner according to any one of <1> to <9>, wherein the glass transition temperature of the toner at the first temperature rise (Tg1st) in a differential scanning calorimetry measurement is 45° C. or higher but lower than 65° C.

<11> The toner according to any one of <1> to <10>, wherein the glass transition temperature of the toner at the second temperature rise (Tg2nd) in a differential scanning calorimetry measurement is 20° C. or higher but lower than 40° C.

<12> The toner according to any one of <1> to <11>, wherein an orthodichlorobenzene soluble content of the crystalline polyester resin has a weight average molecular weight (Mw) of 3,000 to 30,000, a number average molecular weight (Mn) of 1,000 to 10,000, and a ratio Mw/Mn of 1 to 10 as determined by gel permeation chromatography.

<13> The toner according to any one of <1> to <12>, obtained by dispersing in an aqueous medium an oil phase containing at least the non-crystalline polyester resin, the crystalline polyester resin, the releasing agent, the graft-modified polymer and the colorant.

<14> The toner according to <13>, wherein the dispersing the oil phase in the aqueous medium including: dissolving or dispersing at least an active hydrogen group-containing compound, a polymer having a site reactive with the active hydrogen group-containing compound, the non-crystalline polyester resin, the crystalline polyester resin, the releasing-agent, the graft-modified polymer and the colorant in an organic solvent, so as to form a dissolved or dispersed product, dispersing the dissolved or dispersed product in the aqueous medium, allowing the active hydrogen group-containing compound and the polymer having a site reactive with the active hydrogen group-containing compound to undergo crosslinking reaction or elongation reaction in the aqueous medium so as to obtain a dispersion liquid, and removing the organic solvent from the dispersion liquid.

<15> A developer containing the toner according to any one of <1> to <14>.

The present invention can solve the conventional problems, and provide a toner having excellent low temperature fixing ability, high temperature offset resistance, and heat resistant storage stability without causing filming, and a developer containing the toner.

DETAILED DESCRIPTION OF THE INVENTION (Toner)

A toner of the present invention contains at least a non-crystalline polyester resin, a crystalline polyester resin, a releasing agent, a graft-modified polymer, and a colorant, and if necessary further contains other components.

In the toner of the present invention, in the case where a SP value of the non-crystalline polyester resin is defined as SP1, a SP value of the crystalline polyester resin is defined as SP2, a SP value of the releasing agent is defined as SP3, and a SP value of the graft-modified polymer is defined as SP4, SP1, SP2, SP3 and SP4 satisfy the relations represented by Formulas (1) to (3):

| | |
|---|---|
| $SP1 > SP4 > SP2 > SP3$ | Formula (1), |
| $0.1 < SP1 - SP4 < 1.0$ | Formula (2), and |
| $0.1 < SP4 - SP2 < 1.0$ | Formula (3). |

As in the relations represented by Formulas (1) to (3), as the SP value of the graft-modified polymer (SP4), by selecting a value which is an intermediate polarity between the SP value of the non-crystalline polyester resin (SP1) and the SP values of the crystalline polyester resin (SP2) and between the SP value of the non-crystalline polyester resin (SP1) and the releasing agent (SP3), and has an appropriate difference with another SP value, i.e. SP1, SP2, and SP3, the dispersibility of both the crystalline polyester resin and the releasing agent in the toner can be improved. As a result, the crystalline polyester resin and the releasing agent can be uniformly and finely dispersed in the toner, to thereby prevent filming caused by the crystalline polyester resin and the releasing agent, and achieve low temperature fixing ability of the toner.

In the case of SP4>SP1, the dispersion effect of the graft-modified polymer to the crystalline polyester resin and the releasing agent decreases, the dispersion diameters of the crystalline polyester resin and the releasing agent become large, and the crystalline polyester resin and the releasing agent are easily, unevenly localized in the toner surface. Thus, filming, smear and the like caused by the crystalline polyester resin and the releasing agent easily occur.

In the case of SP2>SP4, the dispersion effect of the graft-modified polymer to the crystalline polyester resin decreases, the dispersion diameter of the crystalline polyester resin becomes large, and the crystalline polyester resin is easily, unevenly localized in the toner surface. Thus, filming, smear and the like caused by the crystalline polyester resin easily occur.

In the case of SP1−SP4 is 0.1 or less, the graft-modified polymer may be excessively compatible with the non-crystalline polyester resin, and the graft-modified polymer is absorbed into the non-crystalline polyester resin, and dispersion stability effect is not sufficiently exhibited. Thus, filming, smear and the like caused by the crystalline polyester resin occur.

In the case of SP1−SP4 is 1.0 or more, the graft-modified polymer is not sufficiently effective with respect to the crystalline polyester resin, a dispersion diameter of the crystalline polyester resin becomes large, and the crystalline polyester resin is easily, unevenly localized in the toner surface. Thus, filming, smear and the like caused by the crystalline polyester resin may occur.

In the case of SP4−SP2 is 0.1 or less, the graft-modified polymer may be excessively compatible with the crystalline polyester resin, and the softening effect of the crystalline polyester resin is not sufficiently exhibited, causing poor low temperature fixing ability.

In the case where SP4−SP2 is 1.0 or more, the graft-modified polymer is not sufficiently effective with respect to the crystalline polyester resin, a dispersion diameter of the releasing agent becomes large, and the releasing agent is easily, unevenly localized in the toner surface. Thus, filming, smear and the like caused by the releasing agent may occur.

The difference (SP1−SP2) in the SP value between the non-crystalline polyester resin and the crystalline polyester resin preferably satisfies the relation represented by the following Formula (4):

$$0.5<SP1-SP2<1.5 \quad \text{Formula (4).}$$

In the case where the difference (SP1−SP2) in the SP value between the non-crystalline polyester resin (SP1) and the crystalline polyester resin (SP2) is 0.5 or less, the difference in the SP value between the crystalline polyester resin and the non-crystalline polyester resin is small, and compatibility therebetween is high. As a result, the crystalline polyester resin is dispersed inside the toner, but the crystallinity of the crystalline polyester resin decreases, and heat resistant storage stability may be adversely affected.

In the case where the difference (SP1−SP2) in the SP value between the non-crystalline polyester resin (SP1) and the crystalline polyester resin (SP2) is 1.5 or more, the difference in the SP value between the crystalline polyester resin and the non-crystalline polyester resin becomes large, and the polarities thereof interact with each other. Consequently, the crystalline polyester resin in the toner is unevenly localized near the toner surface, and low temperature fixing ability and heat resistant storage stability may be degraded. Moreover, the particle size of the crystalline polyester resin becomes large, a large amount of the crystalline polyester resin is exposed on the toner surface, and filming may severely occur. The particle diameter of the crystalline polyester resin is preferably 0.1 μm to 2.0 μm. The particle diameter of the crystalline polyester resin can be measured by observing a cross section of the toner using a scanning electron microscope (SEM).

<Non-Crystalline Polyester Resin>

The non-crystalline polyester resin is formed from a polyhydric alcohol component and a polycarboxylic acid component, such as polycarboxylic acid, polycarboxylic acid anhydride, and polycarboxylate.

In the present invention, the non-crystalline polyester resin means, as described above, a resin formed from a polyhydric alcohol component and a polycarboxylic acid component, such as polycarboxylic acid, polycarboxylic acid anhydride, and polycarboxylate. The non-crystalline polyester resin does not include a resin formed by modifying a polyester resin, for example, the graft-modified polymer described below, the prepolymer described below, and a resin (modified resin) obtained by subjecting the prepolymer to crosslinking and/or elongation reaction.

Examples of the polyhydric alcohol component include alkylene (2 to 3 carbon atoms) oxide adducts (average number of moles added: 1 to 10) of bisphenol A, such as polyoxypropylene(2.2)-2,2-bis(4-hydroxyphenyl)propane, and polyoxyethylene(2.2)-2,2-bis(4-hydroxyphenyl)propane; ethylene glycol, propylene glycol, neopentyl glycol, glycerin, pentaerythritol, trimethylolpropane, hydrogenated bisphenol A, sorbitol, and alkylene (2 to 3 carbon atoms) oxide adducts (average number of moles added: 1 to 10) thereof. These may be used alone or in combination.

Examples of the polycarboxylic acid component include dicarboxylic acid such as adipic acid, phthalic acid, isophthalic acid, terephthalic acid, fumaric acid, and maleic acid; succinic acid substituted with alkyl group having 1 to 20 carbon atoms or an alkenyl group having 2 to 20 carbon atoms, such as dodecenylsuccinic acid, octylsuccinic acid; trimellitic acid, pyromellitic acid; anhydrides and alkyl esters (1 to 8 carbon atoms) of these acids. These may be used alone or in combination.

The non-crystalline polyester resin is preferably compatible at least in part with the prepolymer described below and a resin obtained by subjecting the prepolymer to the crosslinking and/or elongation reaction. Due to the compatibility therebetween, the low temperature fixing ability and high temperature offset resistance can be improved. Thus, the polyhydric alcohol component and polycarboxylic acid component for forming the non-crystalline polyester resin preferably have similar compositions to those of the polyhydric alcohol component and polycarboxylic acid component for forming the prepolymer described below.

The molecular weight of the non-crystalline polyester resin is not particularly limited and may be appropriately selected depending on the intended purpose. In gel permeation chromatography (GPC) measurement, the non-crystalline polyester resin preferably has a weight average molecular weight (Mw) of 2,500 to 10,000, a number average molecular weight of (Mn) 1,000 to 4,000 and Mw/Mn of 1.0 to 4.0. When the non-crystalline polyester resin has excessively small molecular weight, the resultant toner may have degraded heat resistant storage stability, and poor resistance to stress such as stirring etc. in a developing device. When the non-crystalline polyester resin has excessively high molecular weight, the viscoelasticity of the toner increases upon melting, and the resultant toner may have degraded low temperature fixing ability.

Moreover, the non-crystalline polyester resin more preferably has a weight average molecular weight (Mw) of 3,000 to 6,000, a number average molecular weight of (Mn) 1,500 to 3,000, and Mw/Mn of 1.0 to 3.5.

The acid value of the non-crystalline polyester resin is not particularly limited and may be appropriately selected depending on the intended purpose. It is preferably 1 mgKOH/g to 50 mgKOH/g, more preferably 5 mgKOH/g to 30 mgKOH/g. When the acid value thereof is 1 mgKOH/g or higher, it is easy for the toner to be negatively charged. Moreover, the affinity between toner and paper is increased upon fixing of the toner on the paper, thereby improving the low temperature fixing ability. When the acid value thereof is higher than 50 mgKOH/g, charge stability of the toner may be degraded, particularly depending on a change in the working environment.

The hydroxyl value of the non-crystalline polyester resin is not particularly limited and may be appropriately selected depending on the intended purpose. It is preferably 5 mgKOH/g or higher.

The glass transition temperature Tg of the non-crystalline polyester resin is not particularly limited and may be appropriately selected depending on the intended purpose. When the glass transition temperature Tg is excessively low, the resultant toner may have degraded heat resistant storage stability, and poor resistance to stress such as stirring, etc. in a developing device. When the glass transition temperature Tg is excessively high, the viscoelasticity of the toner increases upon melting, and the low temperature fixing ability may be degraded. The glass transition temperature Tg of the non-crystalline polyester resin is preferably 40° C. to 70° C., more preferably 45° C. to 60° C.

The amount of the non-crystalline polyester resin is not particularly limited and may be appropriately selected depending on the intended purpose. It is preferably 50 parts by mass to 95 parts by mass, more preferably 60 parts by mass to 90 parts by mass, relative to 100 parts by mass of the toner.

When the amount of the non-crystalline polyester resin is less than 50 parts by mass, the dispersibility of a pigment and a releasing agent in the toner may be degraded, and image fogging and degradation may easily occur. When the amount of the non-crystalline polyester resin is more than 95 parts by mass, the amount of the crystalline polyester resin decreases, and the resultant toner may have degraded low temperature fixing ability. The amount of the non-crystalline polyester resin being within the more preferable range is advantageous in that the resultant toner is excellent in the image quality, stability, and low temperature fixing ability.

The molecular structure of the non-crystalline polyester resin may be confirmed by NMR measurement of the non-crystalline polyester resin in a solution or as a solid, as well as by measurement of the non-crystalline polyester resin using X-ray diffraction, GC/MS, LC/MS, and IR. For example, simply in the infrared absorption spectrum, a resin having no absorption at wavelengths of 965 $cm^{-1}$±10 $cm^{-1}$ and 990 $cm^{-1}$±10 $cm^{-1}$, which is based on an out-of-plane bending vibration (δCH) of an olefin is detected as a non-crystalline polyester resin.

<Crystalline Polyester Resin>

The crystalline polyester resin contained in the toner of the present invention has high crystallinity and thus exhibits such a hot melt property that the viscosity is rapidly decreased in the vicinity of a temperature at which fixing is initiated. Use of the crystalline polyester resin having such properties provides a toner having both excellent heat resistant storage stability and excellent low temperature fixing ability, since the crystalline polyester resin exhibits excellent heat resistant storage stability due to its crystallinity immediately before melting is initiated and is rapidly decreased in viscosity (sharp melt property) for fixing at a temperature at which melting is initiated. In addition, the toner containing this crystalline polyester resin has a suitable difference between the minimum fixing temperature and the temperature at which hot offset occurs (i.e., a release range).

The crystalline polyester resin is formed from a polyhydric alcohol component and a polycarboxylic acid component, such as polycarboxylic acid, polycarboxylic acid anhydride, and polycarboxylate.

In the present invention, the crystalline polyester resin means, as described above, a resin formed from a polyhydric alcohol component and a polycarboxylic acid component, such as polycarboxylic acid, polycarboxylic acid anhydride, and polycarboxylate. The crystalline polyester resin does not include a resin formed by modifying a polyester resin, for example, the graft-modified polymer described below, the prepolymer described below, and a resin (modified resin) obtained by subjecting the prepolymer to crosslinking and/or elongation reaction.

—Polyhydric Alcohol Component—

The polyhydric alcohol component is not particularly limited and may be appropriately selected depending on the intended purpose. Examples thereof include diols and trihydric or higher alcohols.

Examples of the diols include saturated aliphatic diols. Examples of the aliphatic diols include linear aliphatic diols and branched aliphatic diols. Among these, linear aliphatic diols are preferable, and linear aliphatic diols having 4 to 12 carbon atoms in a main chain is more preferable. When the branched aliphatic diol is used, the crystallinity of the crystalline polyester resin decreases and a melting point may decrease. When the linear aliphatic diol having less than 4 carbon atoms in the main chain, in the case where the diol is polycondensed with aromatic dicarboxylic acid, the melting point increases, possibly causing difficulty in fixation at low temperature. On the other hand, when the linear aliphatic diol having more than 12 carbon atoms in the main chain, it may be difficult to obtain material for practical use. The number of carbon atom in the main chain is more preferably 12 or less.

Examples of the saturated aliphatic diols include, but not limited to, ethylene glycol, 1,3-propanediol, 1,4-butanediol, 1,5-pentanediol, 1,6-hexanediol, 1,7-heptanediol, 1,8-octanediol, 1,9-nonanediol, 1,10-decanediol, 1,11-undecanediol, 1,12-dodecanediol, 1,13-tridecanediol, 1,14-tetradecanediol, 1,18-octadecanediol, and 1,14-eicosanedecanediol. Among these, 1,4-butanediol, 1,6-hexanediol, 1,8-octanediol, 1,10-decanediol, and 1,12-dodecanediol are preferable, because of high crystallinity of the crystalline polyester resin and excellent sharp melting properties.

Examples of trihydric or higher alcohols include glycerin, trimethylolethane, trimethylolpropane, and pentaerythritol.

These may be used alone or in combination.

—Polycarboxylic Acid Component—

The polycarboxylic acid component is not particularly limited and may be appropriately selected depending on the intended purpose. Examples thereof include dicarboxylic acids, and tri- or higher carboxylic acids.

Examples of the dicarboxylic acid include, but not limited to, saturated aliphatic dicarboxylic acids, such as oxalic acid, succinic acid, glutaric acid, adipic acid, suberic acid, azelaic acid, sebacic acid, 1,9-nonanedicarboxylic acid, 1,10-decanedicarboxylic acid, 1,12-dodecanedicarboxylic acid, 1,14-tetradecanedicarboxylic acid, 1,18-octadecanedicarboxylic acid; aromatic dicarboxylic acids of dibasic acids such as phthalic acid, isophthalic acid, terephthalic acid, naphthalene-2,6-dicarboxylic acid, malonic acid, or mesaconic acid; and anhydrides and lower alkyl esters thereof.

Examples of the tri- or higher carboxylic acids include 1,2,4-benzenetricarboxylic acid, 1,2,5-benzenetricarboxylic acid, 1,2,4-naphthalenetricarboxylic acid, and anhydrides and lower alkyl esters thereof.

As the polycarboxylic acid component, dicarboxylic acid components each having a sulfonic group may be included, in addition to the saturated aliphatic dicarboxylic acids and aromatic dicarboxylic acids. Moreover, in addition to the saturated aliphatic dicarboxylic acids and aromatic dicarboxylic acids, dicarboxylic acid components each having double bonds may be included.

These may be used alone or in combination.

Note that when maleic acid, succinic acid, fumaric acid, terephthaiic acid, and derivatives thereof are used as the component of the crystalline polyester resin, a crystalline polyester resin is obtained, but the SP value of the resultant crystalline polyester resin is relatively high. Thus, it is difficult for the toner to satisfy the relations represented by Formulas (1) and (3).

The crystalline polyester resin preferably contain a constituent unit derived from saturated aliphatic dicarboxylic acid and a constituent unit derived from saturated aliphatic diol, so as to has high crystallinity and excellent sharp melting properties to thereby exhibiting excellent low temperature fixing ability.

The melting point of the crystalline polyester resin is not particularly limited and may be appropriately selected depending on the intended purpose. It is preferably 60° C. or higher but lower than 80° C. When the melting point of the crystalline polyester resin is lower than 60° C., the crystalline polyester resin is easily melted at low temperature, and the heat resistant storage stability of a resultant toner may be degraded. When the melting point of the crystalline polyester resin is higher than 80° C., the crystalline polyester resin is not sufficiently melted by heating upon fixing, and the heat resistant storage stability of the resultant toner may be degraded.

The melting point was determined by an endothermic peak value of a DSC chart in a differential scanning calorimetry (DSC) measurement.

The molecular weight of the crystalline polyester resin is not particularly limited and may be appropriately selected depending on the intended purpose. From the standpoint of the fact that a crystalline polyester resin having a sharp molecular weight distribution and having a low molecular weight is excellent in achieving low temperature fixing ability, and that the crystalline polyester resin containing excessive amount of the component having low molecular weight is poor in heat resistant storage stability, the following crystalline polyester resin is preferable: as determined by gel permeation chromatography (GPC) measurement, the orthodichlorobenzene soluble content of the crystalline polyester resin preferably has a weight average molecular weight (Mw) of 3,000 to 30,000, a number average molecular weight (Mn) of 1,000 to 10,000, and a ratio Mw/Mn of 1 to 10, and more preferably has a weight average molecular weight (Mw) of 5,000 to 15,000, a number average molecular weight (Mn) of 2,000 to 10,000, and a ratio Mw/Mn of 1 to 5.

An acid value of the crystalline polyester resin is not particularly limited, may be appropriately selected depending on the intended purpose. It is preferably 5 mgKOH/g or higher, and more preferably 10 mgKOH/g or higher from the standpoint of increasing the affinity of the resin with paper and of achieving the desired low temperature fixing ability. On the other hand, it is preferably 45 mgKOH/g or lower from the standpoint of improving high temperature offset resistance.

The hydroxyl value of the crystalline polymer is not particularly limited, may be appropriately selected depending on the intended purpose. Furthermore, the hydroxyl value of the crystalline polymer is preferably 0 mgKOH/g to 50 mgKOH/g, and more preferably 5 mgKOH/g to 50 mgKOH/g for achieving both the desired degree of low temperature fixing ability and favorable charging property.

The molecular structure of a crystalline polyester resin may be confirmed, for example, by NMR measurement of the crystalline polyester resin in a solution or as a solid, as well as by measurement of the crystalline polyester resin using X-ray diffraction, GC/MS, LC/MS, and IR. For example, simply in the infrared absorption spectrum, a resin having an absorption at wavelengths of 965 $cm^{-1} \pm 10\ cm^{-1}$ and 990 $cm^{-1} \pm 10\ cm^{-1}$, which is based on an out-of-plane bending vibration (δCH) of an olefin is detected as a crystalline polyester resin.

The amount of the crystalline polyester resin is not particularly limited and may be appropriately selected depending on the intended purpose. The amount of the crystalline polyester resin is preferably 2 parts by mass to 20 parts by mass, more preferably 5 parts by mass to 15 parts by mass, relative to 100 parts by mass of the toner. When the amount thereof is less than 2 parts by mass, the crystalline polyester resin does not sufficiently contribute to sharp melting properties, and a resultant toner may have degraded low temperature fixing ability. When the amount of the crystalline polyester resin is more than 20 parts by mass, the heat resistant storage stability may be degraded, and image fogging may easily occur. The amount of the crystalline polyester resin being within the more preferable range is advantageous in that the resultant toner is excellent in the image quality, stability, and low temperature fixing ability.

<Releasing Agent>

The releasing agent is not particularly limited, and may be appropriately selected from those known in the art.

Examples of waxes include natural waxes such as vegetable waxes (e.g., carnauba wax, cotton wax, Japan wax and rice wax), animal waxes (e.g., bees wax and lanolin), mineral waxes (e.g., ozokelite and ceresine) and petroleum waxes (e.g., paraffin waxes, microcrystalline waxes and petrolatum).

Examples of waxes other than the above natural waxes include synthetic hydrocarbon waxes (e.g., Fischer-Tropsch waxes and polyethylene, polypropylene); and synthetic waxes (e.g., ester, ketone and ether).

Further, examples thereof include fatty acid amide compounds such as 12-hydroxystearic acid amide, stearic amide, phthalic anhydride imide and chlorinated hydrocarbons; low-molecular-weight crystalline polymers such as polymethacrylate homopolymers (e.g., poly-n-stearyl methacrylate and poly-n-lauryl methacrylate) and polymethacrylate copolymers (e.g., n-stearyl acrylate-ethyl methacrylate copolymers); and crystalline polymers having a long alkyl group as a side chain.

Among these, hydrocarbon waxes, such as paraffin waxes, microcrystalline waxes, Fischer-Tropsch waxes, polyethylene waxes, and polypropylene waxes are preferable.

The melting point of the releasing agent is not particularly limited and may be appropriately selected depending on the intended purpose. It is preferably 60° C. or higher but lower than 95° C.

As the releasing agent, the hydrocarbon wax having a melting point of 60° C. or higher but lower than 95° C. is more preferable. Since such releasing agent effectively exhibits its releasing effects on the interface between a fixing roller and each toner particle, even when a releasing agent such as oil is not applied onto a fixing roller, high temperature offset resistance can be enhanced.

Particularly, the hydrocarbon wax is preferably used as the releasing agent, since the hydrocarbon wax is hardly compatible with the crystalline polyester resin so that these can separately function, and thus the hydrocarbon wax used as the releasing agent does not impair the softening effect of the crystalline polyester resin as a binder resin, and offset properties of the releasing agent.

When the melting point of the releasing agent is lower than 60° C., the releasing agent is easily melted at low temperature, and the resultant toner may have degraded heat resistant storage stability. When the melting point of the releasing agent is higher than 95° C., the releasing agent is not sufficiently melted by heating upon fixing, and offset properties may not be sufficiently obtained.

The amount of the releasing agent is not particularly limited and may be appropriately selected depending on the intended purpose. The amount of the releasing agent is preferably 2 parts by mass to 10 parts by mass, more preferably 3 parts by mass to 8 parts by mass, relative to 100 parts by mass of the toner. When the amount of the releasing agent is less than 2 parts by mass, the resultant toner may have degraded high temperature offset resistance and low temperature fixing ability upon fixing. When the amount of the releasing agent is more than 10 parts by mass, the heat resistant storage stability may be degraded, and image fogging may easily occur. The amount of the releasing agent being within the more preferable range is advantageous for improving image quality, and fixing stability.

<Graft-Modified Polymer>

The graft-modified polymer is a polymer obtained by grafting an acrylic resin onto at least one of a hydrocarbon wax and a crystalline polyester resin.

The hydrocarbon wax moiety and the crystalline polyester resin moiety in the graft-modified polymer have high affinity to the crystalline polyester resin, and the moieties function so as to allow the graft-modified polymers to be adsorbed to the crystalline polyester resin.

The acrylic resin moiety in the graft-modified polymer prevents the crystalline polyester resin from cohesion in a toner, and from exposing on a toner surface.

The acrylic resin moiety in the graft-modified polymer has generally low SP value to the non-crystalline polyester resin. By introducing the acrylic resin to the graft-modified polymer, the relations represented by Formulas (1) and (2) are easily satisfied. Since the acrylic resin has a monomer structure which is different from that of a polyester resin in a toner, even when the SP value of the acrylic resin is relatively closer to the SP value of the polyester resin, the acrylic resin is not completely compatible with the polyester resin, which functions as steric hindrance preventing cohesion of the crystalline polyester resin.

By grafting the acrylic resin onto at least one of the hydrocarbon wax and the crystalline polyester resin, the graft-modified polymer exhibits dispersion stability effect to the crystalline polyester resin and the releasing agent.

The glass transition temperature of the graft-modified polymer is higher than 40° C. but lower than 80° C.

When the glass transition temperature is 40° C. or lower, the heat resistant storage stability of the toner is degraded. When the glass transition temperature is 80° C. or higher, the low temperature fixing ability of the toner is degraded.

—Hydrocarbon Wax and Crystalline Polyester Resin—

Examples of the hydrocarbon waxes include paraffin waxes, microcrystalline waxes, Fischer-Tropsch waxes, polyethylene waxes, and polypropylene waxes.

Examples of the crystalline polyester resin include the crystalline polyester resins described in the crystalline polyester resin of the toner component as described above. The crystalline polyester resin preferably contains a constituent unit derived from saturated aliphatic dicarboxylic acid and a constituent unit derived from saturated aliphatic diol.

The molecular weight of the hydrocarbon wax and/or the crystalline polyester resin by gel permeation chromatography (GPC) is not particularly limited and may be appropriately selected depending on the intended purpose. The weight average molecular weight (Mw) of the hydrocarbon wax and/or the crystalline polyester resin is preferably 500 to 20,000. The number average molecular weight (Mn) of the hydrocarbon wax and/or the crystalline polyester resin is preferably 300 to 10,000. Mw/Mn of the hydrocarbon wax and/or the crystalline polyester resin is preferably 1.0 to 4.0.

The weight average molecular weight and the number average molecular weight of the hydrocarbon wax and/or the crystalline polyester resin in the graft-modified polymer may be considered as those in the hydrocarbon wax moiety and/or the crystalline polyester resin moiety.

The amount of the hydrocarbon wax and/or the crystalline polyester resin in the graft-modified polymer is not particularly limited and may be appropriately selected depending on the intended purpose. The amount thereof is preferably 2 parts by mass to 25 parts by mass, 3 parts by mass to 20 parts by mass, particularly preferably 5 parts by mass to 15 parts by mass, relative to 100 parts by mass of the graft-modified polymer. When the amount thereof is less than 2 parts by mass, a moiety of the graft-modified polymer is less adsorbed to the releasing agent and/or the crystalline polyester resin, and the effect of the graft-modified polymer as a dispersant relative to the releasing agent and/or the crystalline polyester resin is not sufficiently exhibited, a dispersion diameter of the crystalline polyester resin becomes large, and the crystalline polyester resin is easily, unevenly localized in the toner surface. Thus, filming, smear and the like caused by the crystalline polyester resin may occur. When the amount thereof is more than 25 parts by mass, there exits a small amount of the acrylic resin moiety as a steric hindrance part in the graft-modified polymer, the effect of the graft-modified polymer as a dispersant relative to the releasing agent and/or the crystalline polyester resin is not sufficiently exhibited, a dispersion diameter of the crystalline polyester resin becomes large, and the crystalline polyester resin is easily, unevenly localized in the toner surface. Thus, filming, smear and the like caused by the crystalline polyester resin may occur. The amount of the hydrocarbon wax and/or the crystalline polyester resin being within the particularly preferable range is advantageous in that the crystalline polyester resin and the releasing agent can be uniformly and finely dispersed inside the toner.

The amount of the hydrocarbon wax and/or the crystalline polyester resin can be obtained from mixing ratio of the material components for obtaining the graft-modified polymer. Alternatively, the amount of the hydrocarbon wax and/or the crystalline polyester resin can be obtained by analyzing the graft-modified polymer using GC-MS, NMR, etc.

The maximum value of endotherm peak of the hydrocarbon wax and/or the crystalline polyester resin in endothermic curve at temperature rise measured by DSC is preferably 60° C. to 120° C. When the maximum value of endotherm peak is lower than 60° C. or higher than 120° C., the branching structure of the graft-modified polymer is impaired in the graft polymer, the dispersion diameter of each of the releasing agent and the crystalline polyester resin becomes large, and upon toner formation the releasing agent and the crystalline polyester resin are easily, unevenly localized in the toner surface, and filming resistance may be degraded.

—Acrylic Resin—

The acrylic resin is obtained by polymerizing an unsaturated group-containing monomer.

The unsaturated group containing monomer is not particularly limited and may be appropriately selected depending on the intended purpose. Examples thereof include acrylic ester monomers, methacrylic ester monomers, styrene monomers, nitrogen-containing vinyl monomers, carboxyl group-containing monomers, and hydroxy group-containing monomers. These may be used alone or in combination.

Examples of the acrylic ester monomers include acrylates such as methyl acrylate, ethyl acrylate, n-butyl acrylate, isobutyl acrylate, propyl acrylate, n-octyl acrylate, dodecyl acrylate, 2-ethylhexyl acrylate, stearyl acrylate, 2-chloroethyl acrylate and phenyl acrylate.

Examples of the methacrylic ester monomers include methacrylates such as methyl methacrylate, ethyl methacrylate, propyl methacrylate, n-butyl methacrylate, isobutyl methacrylate, n-octyl methacrylate, dodecyl methacrylate, 2-ethylhexyl methacrylate, stearyl methacrylate, and phenyl methacrylate.

Examples of the styrene monomers include styrene, o-methylstyrene, m-methylstyrene, p-methylstyrene, p-methoxystyrene, p-phenylstyrene, p-chlorostyrene, 3,4-dichlorostyrene, p-ethylstyrene, 2,4-dimethylstyrene, p-n-butylstyrene, p-tert-butylstyrene, p-n-hexylstyrene, p-n-octylstyrene, p-n-nonylstyrene, p-n-decylstyrene, and p-n-dodecylstyrene.

Examples of the nitrogen-containing vinyl monomers include amino group containing α-methylene aliphatic monocarboxylic acid esters such as dimethylaminoethyl methacrylate and diethylaminoethyl methacrylate; acrylic or methacrylic acid derivatives such as acrylonitrile, methacrylonitrile and acrylamide.

Examples of the carboxyl group-containing monomers include unsaturated dibasic acids such as maleic acid, citraconic acid, itaconic acid, alkenylsuccinic acid, fumaric acid and mesaconic acid; unsaturated dibasic acid anhydride such as maleic anhydride, citraconic anhydride, itaconic anhydride and alkenylsuccinic anhydride; half-esters of unsaturated dibasic acids such as methyl maleate half-ester, ethyl maleate half-ester, butyl maleate half-ester, methyl citraconate half-ester, ethyl citraconate half-ester, butyl citraconate half-ester, methyl itaconate half-ester, methyl alkenyl succinate half-ester, methyl fumarate half-ester and methyl mesaconate half-ester; unsaturated dibasic acid esters such as dimethyl maleate and dimethyl fumarate; α,β-unsaturated acids such as acrylic acid, methacrylic acid, crotonic acid and cinnamic acid; α, β-unsaturated acid anhydride such as crotonic anhydride and cinnamic anhydride, anhydrides formed between α,β-unsaturated acids and lower fatty acids; alkenylmalonic acid, alkenylglutaric acid and alkenyladipic acid, and acid anhydrides and monoesters thereof.

Examples of the hydroxy group-containing monomers include acrylates or methacrylates such as 2-hydroxyethyl acrylate, 2-hydroxyethyl methacrylate, and 2-hydroxypropyl methacrylate; 4-(1-hydroxy-1-methylbutyl)styrene and 4-(1-hydroxy-1-methylhexyl)styrene.

Examples of the acrylic resin include a copolymer of styrene and acrylonitrile, a copolymer of styrene and methacrylic acid, a copolymer of styrene, methacrylic acid and acrylonitrile.

The molecular weight of the acrylic resin by GPC is not particularly limited and may be appropriately selected depending on the intended purpose. The weight average molecular weight (Mw) of the acrylic resin is preferably 5,000 to 100,000, the number average molecular weight (Mn) thereof is preferably 1,500 to 15,000, and Mw/Mn thereof is preferably 2 to 40.

These weight average molecular weight and number average molecular weight of the acrylic resin moiety are considered as those of the acrylic resin in the graft-modified polymer.

When the weight average molecular weight (Mw) is less than 5,000, the number average molecular weight (Mn) is less than 15,000, or Mw/Mn is less than 2, the blocking resistance of a toner may be significantly impaired.

When the weight average molecular weight (Mw) is more than 100,000, the number average molecular weight (Mn) is more than 15,000, or Mw/Mn is more than 40, the releasing agent cannot be rapidly transferred to a melted toner surface upon melting and fixing, the releasing ability is degraded, and high temperature offset may easily occur.

A method of grafting the acrylic resin onto at least one of the hydrocarbon wax and the crystalline polyester resin, conventionally known methods can be used. An exemplary method is that the unsaturated group-containing monomer and at least one of the hydrocarbon wax and the crystalline polyester resin are formed in a melted state or dissolved in a solvent, followed by heating in the presence or absence of a radical initiator in atmosphere or under pressure so as to react them.

Examples of the radical initiator used in the reaction include benzoyl peroxide, dichlorobenzoyl peroxide, di-t-butylperoxide, lauroyl peroxide, t-butyl perphenylacetate, cumine perpivalate, azobis isobutyl nitrile, dimethyl azoisobutyrate, and dicumyl peroxide.

The amount of the graft-modified polymer is not particularly limited and may be appropriately selected depending on the intended purpose. It is preferably 1 part by mass to 10 parts by mass, more preferably 3 parts by mass to 8 parts by mass, relative to 100 parts by mass of the toner. When the amount is less than 1 part by mass, the effect of the graft-modified polymer as a dispersant relative to the releasing agent and the crystalline polyester resin is not sufficiently exhibited, a dispersion diameter of the crystalline polyester resin becomes large, and the crystalline polyester resin is easily, unevenly localized in the toner surface. Thus, filming, smear and the like caused by the crystalline polyester resin may occur. When the amount is more than 10 parts by mass, the resultant toner may have degraded low temperature fixing ability. The amount of the graft-modified polymer being within the more preferable range is advantageous for improving image quality, stability, and achieving fixation at low temperature.

<Colorant>

The colorant is not particularly limited and may be appropriately selected depending on the intended purpose. Examples thereof include carbon black, nigrosine dye, iron black, naphthol yellow S, Hansa yellow (10G, 5G and G), cadmium yellow, yellow iron oxide, yellow ocher, yellow lead, titanium yellow, polyazo yellow, oil yellow, Hansa yellow (GR, A, RN and R), pigment yellow L, benzidine yellow (G and GR), permanent yellow (NCG), vulcan fast yellow (5G, R), tartrazinelake, quinoline yellow lake, anthrasan yellow BGL, isoindolinon yellow, colcothar, red lead, lead vermilion, cadmium red, cadmium mercury red, antimony vermilion, permanent red 4R, parared, fiser red, parachloroorthonitro anilin red, lithol fast scarlet G, brilliant fast scarlet, brilliant carmine BS, permanent red (F2R, F4R, FRL, FRLL and F4RH), fast scarlet VD, vulcan fast rubin B, brilliant scarlet G, lithol rubin GX, permanent red F5R, brilliant carmin 6B, pigment scarlet 3B, bordeaux 5B, toluidine Maroon, permanent bordeaux F2K, Helio bordeaux BL, bordeaux 10B, BON maroon light, BON maroon medium, eosin lake, rhodamine lake B, rhodamine lake Y, alizarin lake, thioindigo red B, thioindigo maroon, oil red, quinacridone red, pyrazolone red, polyazo red, chrome vermilion, benzidine orange, perinone orange, oil orange, cobalt blue, cerulean blue, alkali blue lake, peacock blue lake, victoria blue lake, metal-free phthalocyanin blue, phthalocyanin blue, fast sky blue, indanthrene blue (RS and BC), indigo, ultramarine, iron blue, anthraquinon blue, fast violet B, methylviolet lake, cobalt purple, manganese violet, dioxane violet, anthraquinon violet, chrome green, zinc green, chromium oxide, viridian, emerald green, pigment green B, naphthol green B, green gold, acid green lake, malachite green lake, phthalocyanine green, anthraquinon green, titanium oxide, zinc flower, and lithopone.

The amount of the colorant contained is not particularly limited and may be appropriately selected depending on the intended purpose. It is preferably 1 part by mass to 15 parts by mass, preferably 3 parts by mass to 10 parts by mass, relative to 100 parts by mass of the toner.

The colorant may be mixed with a binder resin to form a masterbatch. Examples of the resin which is used for producing a masterbatch or which is kneaded together with a masterbatch include the above-described non-crystalline polyester resins; styrene polymers and substituted products thereof (e.g., polystyrenes, poly-p-chlorostyrenes and polyvinyltoluenes); styrene copolymers (e.g., styrene-p-chlorostyrene copolymers, styrene-propylene copolymers, styrene-vinyltoluene copolymers, styrene-vinylnaphthalene copolymers, styrene-methyl acrylate copolymers, styrene-ethyl acrylate copolymers, styrene-butyl acrylate copolymers, styrene-octyl acrylate copolymers, styrene-methyl methacrylate copolymers, styrene-ethyl methacrylate copolymers, styrene-butyl methacrylate copolymers, styrene-methyl α-chloro methacrylate copolymers, styrene-acrylonitrile copolymers, styrene-vinyl methyl ketone copolymers, styrene-butadiene copolymers, styrene-isoprene copolymers, styrene-acrylonitrile-indene copolymers, styrene-maleic acid copolymers and styrene-maleic acid ester copolymers); polymethyl methacrylates; polybutyl methacrylates; polyvinyl chlorides; polyvinyl acetates; polyethylenes; polypropylenes, polyesters; epoxy resins; epoxy polyol resins; polyurethanes; polyamides; polyvinyl butyrals; polyacrylic acid resins; rosin; modified rosin; terpene resins; aliphatic or alicyclic hydrocarbon resins; aromatic petroleum resins; chlorinated paraffins; and paraffin waxes. These may be used alone or in combination.

The masterbatch can be prepared by mixing and kneading a colorant with a resin for the masterbatch through application of high shearing force. An organic solvent may be used for improving the mutual function of the colorant and the resin. Further, the flashing method, in which an aqueous paste containing a colorant is mixed and kneaded with a resin and an organic solvent, and then the colorant is transferred to the resin to remove water and the organic solvent, is preferably used, since a wet cake of the colorant can be directly used (i.e., no drying is required to be performed). In this mixing and kneading, a high-shearing disperser (e.g., three-roll mill) is preferably used.

<Other Components>

Other components are not particularly limited and may be appropriately selected depending on the intended purpose. Examples thereof include a modified resin, a charge controlling agent, an external additive, a flowability improver, a cleanability improver, and a magnetic material.

The modified resin is obtained by subjecting a polymer having a moiety reactive with an active hydrogen group-containing compound and an active hydrogen group-containing compound to a crosslinking and/or elongating reaction.

—Polymer Having a Site Reactive with Active Hydrogen Group-Containing Compound (Prepolymer)—

The polymer having a site reactive with an active hydrogen group-containing compound (hereinafter also referred to as "prepolymer") is not particularly limited and may be appropriately selected depending on the intended purpose. Examples thereof include polyol resins, polyacrylic resins, polyester resins, epoxy resins, and derivatives thereof. These may be used alone or in combination.

Of these, polyester resins are preferable in terms of their high flowability and transparency when melted.

Examples of the site reactive with the active hydrogen group-containing compound include an isocyanate group, an epoxy group, a carboxyl group, and a functional group having the formula —COCl—. The prepolymer may contain one or more of these groups.

Of these, the isocyanate group is preferable.

The prepolymer is not particularly limited and may be appropriately selected depending on the intended purpose. As the prepolymer, it is preferable to use a polyester resin having an isocyanate group or the like, which can produce a urea bond, since the molecular weights of polymer components can be readily adjusted and oil-less low temperature fixing ability can be ensured in dry toner, particularly since it is possible to ensure excellent releasing ability and fixing ability even when there is no mechanism for applying a releasing oil to the heat medium for toner fixation.

—Active Hydrogen Group-Containing Compound—

The active hydrogen group-containing compound functions as an elongation agent or crosslinking agent when a polymer having a site reactive with an active hydrogen group undergoes an elongation or crosslinking reaction in an aqueous medium.

The active hydrogen group is not particularly limited and may be appropriately selected depending on the intended purpose. Examples of the active hydrogen group include hydroxyl groups (e.g., an alcoholic hydroxyl group and phenolic hydroxyl group), amino groups, carboxyl groups, and mercapto groups. These may be used alone or in combination.

The active hydrogen group-containing compound is not particularly limited and may be appropriately selected depending on the intended purpose. For example, in the case where the polymer having a site reactive with an active hydrogen group is an isocyanate group-containing polyester prepolymer, amines are preferable since the molecular weight can be increased by the elongation reaction or crosslinking reaction with the polyester resin.

The amines are not particularly limited and may be appropriately selected depending on the intended purpose. Examples thereof include diamines, tri- or higher amines, amino alcohols, amino mercaptans, amino acids, and the above amines in which amino groups are blocked. These may be used alone or in combination.

Of these, diamines, and mixtures of diamines with a small amount of tri- or higher amines are preferable.

The diamines are not particularly limited and may be appropriately selected depending on the intended purpose. Examples thereof include aromatic diamines, alicyclic diamines and aliphatic diamines. The aromatic diamines are not particularly limited and may be appropriately selected depending on the intended purpose. Examples thereof include phenylene diamine, diethyltoluene diamine and 4,4'-diaminodiphenylmethane. The alicyclic diamines are not particularly limited and may be appropriately selected depending on the intended purpose. Examples thereof include 4,4'-diamino-3,3'-dimethyldicyclohexylmethane, diaminocyclohexane and isophorone diamine. The aliphatic diamines are not particularly limited and may be appropriately selected depending on the intended purpose. Examples thereof include ethylene diamine, tetramethylene diamine and hexamethylene diamine.

The tri- or higher amines are not particularly limited and may be appropriately selected depending on the intended purpose. Examples thereof include diethylene triamine and triethylene tetramine.

The amino alcohols are not particularly limited and may be appropriately selected depending on the intended purpose. Examples thereof include ethanolamine and hydroxyethylaniline.

The amino mercaptans are not particularly limited and may be appropriately selected depending on the intended purpose. Examples thereof include aminoethylmercaptan and aminopropylmercaptan.

The amino acids are not particularly limited and may be appropriately selected depending on the intended purpose. Examples thereof include amino propionic acid and amino capric acid.

The above amines with blocked amino groups are not particularly limited and may be appropriately selected depending on the intended purpose. Examples thereof include ketimine compounds and oxazoline compounds, which are obtained by blocking the amino groups of the above amines with ketones such as acetone, methyl ethyl ketone or methyl isobutyl ketone.

—Isocyanate Group-Containing Polyester Resin—

The isocyanate group-containing polyester resin (hereinafter also referred to as "isocyanate group-containing polyester prepolymer") is not particularly limited and may be appropriately selected depending on the intended purpose.

Examples thereof include reaction products of polyisocyanate and active hydrogen group-containing polyester resins obtained by polycondensation of polyols with polycarboxylic acids.

—Polyols—

The polyols are not particularly limited and may be appropriately selected depending on the intended purpose. Examples thereof include diols, trihydric or higher alcohols, and mixtures of diols and trihydric or higher alcohols. These may be used alone or in combination.

Of these, preferable are diols and mixtures of diols and a small amount of trihydric or higher alcohols.

The diols are not particularly limited and may be appropriately selected depending on the intended purpose. Examples of the diols include alkylene glycols such as ethylene glycol, 1,2-propylene glycol, 1,3-propylene glycol, 1,4-butanediol, and 1,6-hexanediol; oxyalkylene group-containing diols such as diethylene glycol, triethylene glycol, dipropylene glycol, polyethylene glycol, polypropylene glycol, and polytetramethylene glycol; alicyclic diols such as 1,4-cyclohexane dimethanol and hydrogenated bisphenol A; alkylene oxide adducts of the alicyclic diols, such as those obtained by adding an alkylene oxide such as ethylene oxide, propylene oxide, butylene oxide or the like to the alicyclic diols; bisphenols such as bispheonol A, bisphenol F, and bisphenol S; and alkylene oxide adducts of bisphenols, such as those obtained by adding an alkylene oxide such as ethylene oxide, propylene oxide, butylene oxide or the like to the bisphenols. The number of the carbon atoms of the alkylene glycols is not particularly limited and may be appropriately selected depending on the intended purpose, and it is preferably 2 to 12.

Of these, preferable are alkylene glycols having 2 to 12 carbon atoms and alkylene oxide adducts of bisphenols, with alkylene oxide adducts of bisphenols and mixtures of alkylene oxide adducts of bisphenols and alkylene glycols having 2 to 12 carbon atoms being more preferable.

The trihydric or higher alcohols are not particularly limited and may be appropriately selected depending on the intended purpose. Examples thereof include trihydric or higher aliphatic alcohols, and trihydric or higher polyphenols, and alkylene oxide adducts of the trihydric or higher polyphenols.

The trihydric or higher aliphatic alcohols are not particularly limited and may be appropriately selected depending on the intended purpose. Examples thereof include glycerin, trimethylolethane, trimethylolpropane, pentaerythritol and sorbitol.

The trihydric or higher polyphenols are not particularly limited and may be appropriately selected depending on the intended purpose. Examples thereof include trisphenol PA, phenol novolac, and cresol novolac.

The alkylene oxide adducts of trihydric or higher polyphenols are not particularly limited and may be appropriately selected depending on the intended purpose. Examples thereof include those obtained by adding an alkylene oxide such as ethylene oxide, propylene oxide, or butylene oxide to trihydric or higher polyphenols.

When the diol and trihydric or higher alcohol are mixed for use, the amount of trihydric or higher alcohol relative to the diol is not particularly limited and may be appropriately selected depending on the intended purpose. It is preferably 0.01% by mass to 10% by mass, more preferably 0.01% by mass to 1% by mass.

—Polycarboxylic Acids—

The polycarboxylic acids are not particularly limited and may be appropriately selected depending on the intended purpose. Examples thereof include dicarboxylic acids, tri- or higher carboxylic acids, and mixtures thereof. These may be used alone or in combination.

Of these, dicarboxylic acids and the mixtures of dicarboxylic acids and a small amount of tri- or higher carboxylic acids are preferable.

The dicarboxylic acids are not particularly limited and may be appropriately selected depending on the intended purpose. Examples thereof include dialkanoic acids, dialkenoic acids, and aromatic dicarboxylic acids.

The dialkanoic acids are not particularly limited and may be appropriately selected depending on the intended purpose. Examples thereof include succinic acid, adipic acid, and sebacic acid.

The dialkenoic acids are not particularly limited and may be appropriately selected depending on the intended purpose. Dialkenoic acids having 4 to 20 carbon atoms are preferable. Examples of the dialkenoic acids having 4 to 20 carbon atoms are not particularly limited and may be appropriately selected depending on the intended purpose. Examples thereof include maleic acid, and fumaric acid.

The aromatic dicarboxylic acids are not particularly limited and may be appropriately selected depending on the intended purpose. Aromatic dicarboxylic acids having 8 to 20 carbon atoms are preferable. The aromatic dicarboxylic acids having 8 to 20 carbon atoms are not particularly limited and may be appropriately selected depending on the intended purpose. Examples thereof include phthalic acid, isophthalic acid, terephthalic acid, and naphthalen dicarboxylic acid.

The tri- or higher carboxylic acids are not particularly limited and may be appropriately selected depending on the intended purpose. Examples thereof include tri- or higher aromatic carboxylic acids.

The tri- or higher aromatic carboxylic acids are not particularly limited and may be appropriately selected depending on the intended purpose. The tri- or higher aromatic carboxylic acids having 9 to 20 carbon atoms are preferable. The tri- or higher aromatic carboxylic acids having 9 to 20 carbon atoms are not particularly limited and may be appropriately selected depending on the intended purpose. Examples thereof include trimellitic acid, and pyromellitic acid.

The polycarboxylic acids are not particularly limited and may be appropriately selected depending on the intended purpose. Examples thereof include acid anhydrides of any of dicarboxylic acids, tri- or higher carboxylic acids, and mixtures of dicarboxylic acids and tri- or higher carboxylic acids; and lower alkyl esters.

The lower alkyl esters are not particularly limited and may be appropriately selected depending on the intended purpose. Examples thereof include methyl ester, ethyl ester, and isopropyl ester.

When the dicarboxylic acid and the tri- or higher carboxylic acid are mixed, the amount of the tri- or higher carboxylic acid relative to the dicarboxylic acid is not particularly limited and may be appropriately selected depending on the intended purpose. It is preferably 0.01% by mass to 10% by mass, more preferably 0.01% by mass to 1% by mass.

Upon polycondensation of the polyol with the polycarboxylic acid, the equivalent ratio [OH]/[COOH] of hydroxyl group [OH] content in polyol to carboxyl group [COOH] content in polycarboxylic acid is not particularly limited and may be appropriately selected depending on the intended purpose. It is preferably 1/1 to 2/1, more preferably 1/1 to 1.5/1, and particularly preferably 1.02/1 to 1.3/1.

The amount of the polyol-derived component in the isocyanate group-containing polyester prepolymer is not particularly limited and may be appropriately selected depending on the intended purpose. It is preferably 0.5% by mass to 40% by mass, more preferably 1% by mass to 30% by mass, and particularly preferably 2% mass to 20% by mass.

When the amount is less than 0.5% by mass, the hot offset resistance may be poor, possibly causing difficulty in satisfying both heat-resistant storage stability and low temperature fixing ability of the toner. When the amount is greater than 40% by mass, the low temperature fixing ability may be poor.

—Polyisocyanates—

The polyisocyanates are not particularly limited and may be appropriately selected depending on the intended purpose. Examples thereof include aliphatic diisocyanates, alicyclic diisocyanates, aromatic diisocyanates, aromatic aliphatic diisocyanates, isocyanurates, and blocked products of the polyisocyanates with phenol derivatives, oximes, caprolactams, etc.

The aliphatic diisocyanates are not particularly limited and may be appropriately selected depending on the intended purpose. Examples thereof include tetramethylene diisocyanate, hexamethylene diisocyanate, 2,6-diisocyanate methyl caproate, octamethylene diisocyanate, decamethylene diisocianate, dodecamethylene diisocyanate, tetradecamethylene diisocyanate, trimethyl hexane diisocyanate, and tetramethyl hexane diisocyanate.

The alicyclic diisocyanates are not particularly limited and may be appropriately selected depending on the intended purpose. Examples thereof include isophorone diisocyanate, and cyclohexylmethane diisocyanate.

The aromatic diisocyanates are not particularly limited and may be appropriately selected depending on the intended purpose. Examples thereof include tolylene diisocyanate, diphenylmethane diisocyanate, 1,5-naphthylene diisocyanate, diphenylene-4,4'-diisocyanate, 4,4'-diisocyanato-3,3'-dimethyl diphenyl, 3-methyldiphenyl methane-4,4'-diisocyanate, and diphenylether-4,4'-diisocyanate.

The aromatic aliphatic diisocyanates are not particularly limited and may be appropriately selected depending on the intended purpose. Examples thereof include $\alpha,\alpha,\alpha',\alpha'$-tetramethyl xylylene diisocyanate.

The isocyanurates are not particularly limited and may be appropriately selected depending on the intended purpose. Examples thereof include tris-isocyanatoalkyl-isocyanurate, and tris(isocyanatocycloalkyl)isocyanurate. These may be used alone or in combination.

In reaction between the polyisocyanate and the hydroxyl group-containing polyester resin, the equivalent ratio of the ([NCO]/[OH]) of an isocyanate group [NCO] in the polyisocyanate to a hydroxyl group [OH] in the hydroxyl group-containing polyester resin is not particularly limited and may be appropriately selected depending on the intended purpose. It is preferably 1/1 to 5/1, more preferably 1.2/1 to 4/1, particularly preferably 1.5/1 to 3/1. When the equivalent ratio is less than 1/1, offset resistance may be poor. When the equivalent ratio is greater than 5/1, the low temperature fixing ability may be poor.

The amount of the polyisocyanate-derived component in the isocyanate group-containing polyester prepolymer is not particularly limited and may be appropriately selected depending on the intended purpose. It is preferably 0.5% by mass to 40% by mass, more preferably 1% by mass to 30% by mass, and particularly preferably 2% mass to 20% by mass. When the amount is less than 0.5% by mass, the hot offset resistance may be poor. When the amount is greater than 40% by mass, the low temperature fixing ability may be poor.

The average number of isocyanate groups per one molecule of the isocyanate group-containing polyester prepolymer is not particularly limited and may be appropriately selected depending on the intended purpose. It is preferably 1 or more, more preferably 1.2 to 5, and particularly preferably 1.5 to 4. When the average number is less than 1, the molecular weight of the urea-modified polyester resin decreases and thus the hot offset resistance may be poor.

The mass ratio (isocyanate group-containing polyester prepolymer/polyester resin) of the isocyanate group-containing polyester prepolymer to the polyester resin containing 50% by mole or more of the propylene oxide adducts of bisphenols in the polyhydric alcohol component, and having a certain hydroxyl value and acid value is not particularly limited and may be appropriately selected depending on the intended purpose. It is preferably 5/95 to 25/75, more preferably 10/90 to 25/75. When the mass ratio is less than 5/95, the hot offset resistance may decrease. When the mass ratio is more than 25/75, low temperature fixing ability and image glossiness may decrease.

—Charge Controlling Agent—

The charge controlling agent is not particularly limited and may be appropriately selected depending on the intended purpose. Examples thereof include nigrosine dyes, triphenylmethane dyes, chrome-containing metal complex dyes, molybdic acid chelate pigments, rhodamine dyes, alkoxy amines, quaternary ammonium salts (including fluorine-modified quaternary ammonium salts), alkylamides, phosphorus, phosphorus compounds, tungsten, tungsten compounds, fluorine active agents, metal salts of salicylic acid, and metal salts of salicylic acid derivatives. Specific examples thereof include nigrosine dye BONTRON 03, quaternary ammonium salt BONTRON P-51, metal-containing azo dye BONTRON S-34, oxynaphthoic acid-based metal complex E-82, salicylic acid-based metal complex E-84 and phenol condensate E-89 (products of ORIENT CHEMICAL INDUSTRIES CO., LTD); quaternary ammonium salt molybdenum complex TP-302 and TP-415 (products of Hodogaya Chemical Co., Ltd.); LRA-901 and boron complex LR-147 (products of Japan Carlit Co., Ltd.); copper phthalocyanine; perylene; quinacridone; azo pigments; and polymeric compounds having, as a functional group, a sulfonic acid group, carboxyl group, quaternary ammonium salt, etc.

The amount of the charge controlling agent contained is not particularly limited and may be appropriately selected depending on the intended purpose. The amount of the charge controlling agent is preferably 0.1 parts by mass to 10 parts by mass, more preferably 0.2 parts by mass to 5 parts by mass, relative to 100 parts by mass of the toner. When the amount thereof is more than 10 parts by mass, the formed toner has too high chargeability, resulting in that the charge controlling agent exhibits reduced effects. As a result, the electrostatic force increases between a developing roller and the toner, decreasing the fluidity of the toner and forming an image with reduced color density. The charge controlling agent may be melt-kneaded together with a masterbatch and a resin, and then dissolved or dispersed. Needless to say, they may be added directly to an organic solvent simultaneously with the masterbatch or binder resin on dissolving and dispersing, or may be fixed on the surfaces of the formed toner particles.

—External Additive—

As the external additive, inorganic fine particles or hydrophobized inorganic fine particles may be used in combination with oxide fine particles. The hydrophobized inorganic fine particles each have an average primary particle diameter of preferably 1 nm to 100 nm, and more preferably 5 nm to 70 nm.

The external additive preferably contains at least one type of the hydrophobized inorganic fine particles having an average primary particle diameter of 20 nm or less and at least one type of the hydrophobized inorganic fine particles having an average primary particle diameter of 30 nm or more. Moreover, the hydrophobized inorganic fine particles preferably have a BET specific surface area of 20 $m^2/g$ to 500 $m^2/g$.

The external additive is not particularly limited and may be appropriately selected depending on the intended purpose. Examples thereof include silica fine particles, hydrophobic silica; fatty acid metal salts such as zinc stearate and aluminum stearate; metal oxides such as titania, alumina, tin oxide and antimony oxide; and fluoropolymers.

Examples of preferable additives include hydrophobized silica, titania, titanium oxide and alumina fine particles. Examples of the silica fine particles include R972, R974, RX200, RY200, R202, R805 and R812 (manufactured by Nippon Aerosil Co., Ltd.). Examples of the titania fine particles include P-25 (manufactured by Nippon Aerosil Co., Ltd.), STT-30, STT-65C-S (manufactured by Titanium Industries, Inc.), TAF-140 (manufactured by Fuji Titanium Industry, Co., Ltd.), MT-150 W, MT-500B, MT-600B and MT-150A (manufactured by TAYCA CORPORATION).

Examples of the hydrophobized titanium oxide fine particles include T-805 (manufactured by Nippon Aerosil Co., Ltd.), STT-30A, STT-65S-S (manufactured by Titanium Industries, Inc.), TAF-500T, TAF-1500T (manufactured by Fuji Titanium Industry, Co., Ltd.), MT-100S, MT-100T (manufactured by TAYCA CORPORATION), and IT-S (manufactured by ISHIHARA SANGYO KAISHA, LTD.).

The hydrophobized oxide fine particles of silica, titania or alumina may be produced by treating the hydrophilic fine particle with silane coupling agents such as methyltrimethoxysilane, methyltriethoxysilane and octyltriethoxysilane. In addition, silicone oil-treated oxide fine particles or inorganic fine particles, if necessary which are treated with a silicone oil by heating, are preferably used.

Examples of the silicone oil include dimethyl silicone oil, methylphenyl silicone oil, chlorophenyl silicone oil, methylhydrogen silicone oil, alkyl-modified silicone oil, fluorine-modified silicone oil, polyether-modified silicone oil, alcohol-modified silicone oil, amino-modified silicone oil, epoxy-modified silicone oil, epoxy-polyether-modified silicone oil, phenol-modified silicone oil, carboxyl-modified silicone oil, mercapto-modified silicone oil, acrylic or methacrylic-modified silicone oil, and α-methylstyrene-modified silicone oil. Examples of the inorganic fine particles include silica, alumina, titanium oxide, barium titanate, magnesium titanate, calcium titanate, strontium titanate, iron oxide, copper oxide, zinc oxide, tin oxide, silica sand, clay, mica, wollastonite, diatomaceous earth, chromium oxide, cerium oxide, iron oxide red, antimony trioxide, magnesium oxide, zirconium oxide, barium sulfate, barium carbonate, calcium carbonate, silicon carbide and silicon nitride. Among these, silica and titanium dioxide are particularly preferable.

The amount of the external additive is not particularly limited and may be appropriately selected depending on the intended purpose. It is preferably 0.1% by mass to 5% by mass, more preferably 0.3% by mass to 3% by mass, relative to the toner.

The average primary particle diameter of the inorganic fine particles is not particularly limited and may be appropriately selected depending on the intended purpose. It is preferably 100 nm or less, more preferably 3 nm to 70 nm. In case where the average primary particle diameter is less than the above-described range, the inorganic fine particles tend to be embedded into a toner and the inorganic fine particles are difficult to be effectively exhibited. When the diameter is larger than the range, the photoconductor surface is damaged nonuniformly.

—Flowability Improver—

The flowability improver is not particularly limited and may be appropriately selected depending on the intended purpose, as long as it is an agent for performing surface treatment to improve hydrophobic properties, and is capable of preventing the degradation of flowability or charging ability under high humidity environment. Examples of the flowability improver include silane coupling agents, silylation agents, silane coupling agents having a fluorinated alkyl group, organotitanate coupling agents, aluminum coupling agents, silicone oils, and modified silicone oils. It is particularly preferred that the silica and titanium oxide be subjected to surface treatment with such a flowability improver and used as hydrophobic silica and hydrophobic titanium oxide.

—Cleanability Improver—

The cleanability improver is not particularly limited and may be appropriately selected depending on the intended purpose, as long as it is an agent added to the toner to remove the developer remaining on a photoconductor or a primary transfer medium after transfer. Examples of the cleanability improver include metal salts of fatty acids such as stearic acid (e.g., zinc stearate and calcium stearate), polymer fine particles formed by soap-free emulsion polymerization, such as polymethylmethacrylate fine particles and polystyrene fine particles. The polymer fine particles preferably have a relatively narrow particle size distribution. The polymer fine particles preferably have a volume average particle diameter of 0.01 μm to 1 μm.

—Magnetic Material—

The magnetic material is not particularly limited and may be appropriately selected depending on the intended purpose. Examples thereof include iron powder, magnetite and ferrite. Of these, one having a white color is preferable in terms of color tone.

In the case where a mass of the toner is defined as W1, a mass of the crystalline polyester resin in the toner is defined as W2, a mass of the releasing agent in the toner is defined as W3, and a mass of the graft-modified polymer in the toner is defined as W4, W1, W2, W3, and W4 preferably satisfy the relations represented by Formulas (5) to (7), in terms of uniformly and finely dispersing the releasing agent and the crystalline polyester resin inside the toner, and improving low temperature fixing ability and high temperature offset resistance.

$$W1:W2:W3:W4=100:2 \text{ to } 20:2 \text{ to } 10:1 \text{ to } 10 \quad \text{Formula (5)}$$

$$0.2<W4/W2<1.0 \quad \text{Formula (6), and}$$

$$0.2<W4/W3<1.0 \quad \text{Formula (7).}$$

When the relation represented by Formula (5) is not satisfied, the dispersion diameters of the releasing agent and the crystalline polyester resin in the toner become large, and the releasing agent and the crystalline polyester resin are easily, unevenly localized in the toner surface. Thus, filming and image deterioration easily occur, or low temperature fixing ability may not be sufficiently obtained.

When the relation represented by Formula (6) is not satisfied, the dispersion diameters of the releasing agent and the crystalline polyester resin in the toner become large, and the releasing agent and the crystalline polyester resin are easily, unevenly localized in the toner surface. Thus, filming and image deterioration easily occur, or low temperature fixing ability may not be sufficiently obtained.

When the relation represented by Formula (7) is not satisfied, the dispersion diameters of the releasing agent and the crystalline polyester resin in the toner become large, and the releasing agent and the crystalline polyester resin are easily, unevenly localized in the toner surface. Thus, filming and image deterioration easily occur, or high temperature offset resistance may not be sufficiently obtained.

The acid value of the toner is not particularly limited and may be appropriately selected depending on the intended purpose. It is preferably 0.5 KOHmg/g to 40 KOHmg/g from the standpoint of controlling the low temperature fixing ability; i.e., the minimum fixing temperature, and the temperature at which hot offset occurs. When the acid value thereof is less than 0.5 KOHmg/g, the base may not contribute to dispersion stability during production. Moreover, by using the prepolymer elongation and/or crosslinking reaction proceeds to an undesired extent, causing decrease in production stability. When the acid value thereof is more than 40 KOHmg/g, elongation reaction and/or crosslinking reaction does not sufficiently proceed by using the prepolymer, adversely affecting the hot offset resistance.

The glass transition temperature Tg of the toner is not particularly limited and may be appropriately selected depending on the intended purpose. The glass transition temperature of the toner at the first temperature rise (Tg1st) in DSC measurement is preferably 45° C. or higher but lower than 65° C., and more preferably 50° C. to 60° C. The toner having such Tg1st can obtain suitable low temperature fixing ability, heat resistant storage stability and high durability. The toner having a Tg1st lower than 45° C. may involve blocking in a developing device and filming on a photoconductor. The toner having a Tg1st of 65° C. or higher may be decreased in low temperature fixing ability.

The glass transition temperature of the toner at the second temperature rise (Tg2nd) in DSC measurement is preferably 20° C. or higher but lower than 40° C. The toner having a Tg2nd lower than 20° C. may involve blocking in a developing device and filming on a photoconductor. The toner having a Tg2nd of 40° C. or higher may be decreased in low temperature fixing ability.

The toner is preferably obtained by dispersing in an aqueous medium an oil phase containing at least the non-crystalline polyester resin, the crystalline polyester resin, the releasing agent, the graft-modified polymer and the colorant.

The dispersing the oil phase in the aqueous medium preferably includes: dissolving or dispersing at least an active hydrogen group-containing compound, a polymer having a site reactive with the active hydrogen group-containing compound, the non-crystalline polyester resin, the crystalline polyester resin, the releasing agent, the graft-modified polymer and the colorant in an organic solvent, so as to form a dissolved or dispersed product, dispersing the dissolved or dispersed product in the aqueous medium, allowing the active hydrogen group-containing compound and the polymer having a site reactive with the active hydrogen group-containing compound to undergo crosslinking reaction or elongation reaction in the aqueous medium so as to obtain a dispersion liquid, and removing the organic solvent from the dispersion liquid.

The volume average particle diameter of the toner is not particularly limited and may be appropriately selected depending on the intended purpose. It is preferably 3 μm to 7 μm. The ratio of the volume average particle diameter to the number average particle diameter is preferably 1.2 or lower. The toner having a volume average particle diameter of 2 μm or less is preferably contained in an amount of 1% by number to 10% by number.

<Calculation and Analysis Methods of Various Properties of Toner and Toner Constituent Component>

<<SP Value>>

The solubility parameter (SP value) will be described below.

The SP value is a solubility parameter, and is a numerical expression which indicates how substances dissolve easily in each other. This SP value is represented by attracting force between molecules, that is, square root of cohesive energy density (CED). CED is an energy quantity required for evaporation of 1 mL substance.

In the present invention, the SP value can be calculated according to the Fedors method using the following Equation (I):

$$\text{Solubility Parameter(SP value)}=(\text{CED value})^{1/2}=(E/V)^{1/2} \quad \text{Equation (I)}$$

In Equation (I), E denotes a molecular cohesive energy (cal/mol), and V denotes a molecular volume ($cm^3$/mol), and E and V are represented respectively by the following Equations (II) and (III)

$$E=\Sigma\Delta ei \quad \text{Equation (II)}$$

$$V=\Sigma\Delta vi \quad \text{Equation (III)}$$

In Equations (II) and (III), Δei denotes an evaporation energy of an atomic group, and Δvi denotes a molar volume.

There are various calculating methods of the SP value. In the present invention, the SP value is calculated according to the commonly used Fedors method.

With regard to the calculation method, various data of the evaporation energy of the atomic group Δei, and the molar volume Δvi, data described in "Basic Theory of Adhesion" (secchaku no kiso riron), Chapter. 5, Minoru Imoto, published by Kobunshi Kankokai are used.

Additionally, with regard to the data, such as —$CF_3$, that are not described in "Basic Theory of Adhesion", reference is made to R. F. Fedors, Polym. Eng. Sci, 14, 147 (1974).

For reference, when the SP value represented by Equation (I) is converted to the unit $(J/cm^3)^{1/2}$, the SP value may be multiplied by 2.046. When the SP value is converted to SI unit $(J/m^3)^{1/2}$, the SP value may be multiplied by 2,046.

For example, when the non-crystalline polyester resin, the crystalline polyester resin, the releasing agent, and the graft-modified polymer are synthesized and mixed, the SP values thereof can be easily calculated according to the above-description.

Generally, in a resin whose skeleton is changed by adding a monomer during polymerization, it is difficult to calculate the SP value from the compounding ratio. It is also difficult to calculate the SP value of the components contained in a toner, since the compositions thereof are generally unclear.

On the other hand, calculation of the SP value by the Fedors method can be achieved by specifying the type and proportion of monomers constituting the resin.

For example, a mixture of the non-crystalline polyester resin, the crystalline polyester resin, the releasing agent, and the graft-modified polymer is separated from each other by GPC, and the SP value of each separated component can be calculated by the analytical method described below, whereby the SP value can be calculated.

That is, in a GPC measurement using tetrahydrofuran (THF) as a mobile phase, an elute is fractionated with a fraction collector etc., and fractions corresponding to a desired molecular weight, out of the whole area of its elution curve, are combined.

The combined elute is concentrated and dried in an evaporator or the like, and the resulting solid is dissolved in a deuterated solvent such as deuterochloroform or deuterated THF, and then measured by $^1$H-NMR, and from the integral ratio of each element, the ratio of the constituent monomer of the resin in the eluted components can be calculated.

In an alternative method, the elute is concentrated and hydrolyzed with sodium hydroxide or the like, and the decomposed product can be qualitatively and quantitatively analyzed by high performance liquid chromatography (HPLC), so as to calculate the ratio of constituent monomers.

Calculation of the SP value by the Fedors method can be achieved by specifying the type and ratio of monomers constituting the resin. When the monomer species are specified by the above analysis, the SP value is determined by adding the composition ratios of monomers in the order of a decreasing ratio until the total sum of their ratios reaches 90% by mole. That is, residual monomers are not added in calculation of the SP value.

<<Analysis of Toner Composition>>

An analysis method for analyzing the toner and then calculating the SP value will be described below.

First, 1 g of a toner is added to 100 mL of THF, and stirred at 25° C. for 30 minutes to prepare a solution, in which a THF soluble content of the toner is dissolved.

The thus-prepared solution is filtered with a membrane filter having a pore size of 0.2 μm, to thereby obtain the THF-soluble content in the toner solution.

Then, the THF-soluble content is dissolved into THF to obtain a sample for GPC. The sample is charged into GPC used for measurement of a molecular weight of the above-described resin.

Meanwhile, a fraction collector is disposed at the outlet of an eluate obtained through GPC, and eluates are recovered at predetermined counts. Every 5% of the area ratio from initiation (rising of the curve) in the elution curve, the eluate are obtained.

Next, each (30 mg) of the eluates is dissolved in 1 mL of deuterated chloroform. In addition, tetramethylsilane (TMS) serving as a reference substance is added thereto at a concentration of 0.05% by volume.

The resultant solution is charged into a glass tube for NMR having a diameter of 5 mm, and then integrated 128 times at 23° C. to 25° C. using a nuclear magnetic resonance apparatus (JNM-AL400, product of JEOL Ltd.), to thereby obtain a spectrum.

The composition or ratio of the monomers of the non-crystalline polyester rein, the crystalline polyester resin, the releasing agent, and the graft-modified polymer contained in the toner can be determined on the basis of the integral ratio of the peaks in the obtained spectrum.

Specifically, the component ratio of the constituent monomers is determined from respective integral ratios on the basis of attribution of each peak as follows.

The attribution of the peaks is, for example, as follows:

8.25 ppm and thereabout: attributed to the benzene ring of trimellitic acid (corresponding to one hydrogen atom);

8.07 ppm to 8.10 ppm and thereabout: attributed to the benzene ring of terephthalic acid (corresponding to four hydrogen atoms);

7.1 ppm to 7.25 ppm and thereabout: attributed to the benzene ring of bisphenol A (corresponding to four hydrogen atoms);

6.8 ppm and thereabout: attributed to the benzene ring of bisphenol A (corresponding to four hydrogen atoms) and the double bond of fumaric acid (corresponding to two hydrogen atom);

5.2 ppm to 5.4 ppm and thereabout: attributed to the methine of bisphenol A propylene oxide adduct (corresponding to one hydrogen atom);

3.7 ppm to 4.7 ppm and thereabout: attributed to the methylene of bisphenol A propylene oxide adduct (corresponding to two hydrogen atoms) and the methylene of bisphenol A ethylene oxide adduct (corresponding to four hydrogen atoms); and 1.6 ppm and thereabout: attributed to the methyl group of bisphenol A (corresponding to six hydrogen atoms).

From the obtained results, the SP values of the non-crystalline polyester resin, the crystalline polyester resin, the releasing agent, and the graft-modified polymer can be calculated by the Formula (I).

<<Measurement Methods for Acid Value and Hydroxyl Value>>

The hydroxyl value is measured by the method in accordance with JIS K0070-1966.

Specifically, first, 0.5 g of a sample is accurately weighed in a 100 mL measuring flask, and then 5 mL of an acetylation reagent is added thereto. Next, the measuring flask is heated for 1 hour to 2 hours in a warm bath set to 100° C.±5° C., and is then taken out from the warm bath and left to cool. In addition, water is added to the measuring flask, which is then shaken to decompose acetic anhydride. Next, for completely decomposing acetic anhydride, the flask is heated again in the warm bath for 10 minutes or longer and then left to cool. Thereafter, the wall of the flask is thoroughly washed with an organic solvent.

Then, a potentiometric automatic titrator DL-53 (product of Metller-Toledo International Inc.) and an electrode DG113-SC (product of Metller-Toledo International Inc.) are used to measure the hydroxyl value at 23° C. The measurements are analyzed with analysis software LabX Light Version 1.00.000. The calibration for this apparatus is performed using a solvent mixture of toluene (120 mL) and ethanol (30 mL).

The measurement conditions are as follows.

| [Measurement Conditions] | |
|---|---|
| Stir | |
| Speed [%] | 25 |
| Time [s] | 15 |
| EQP titration | |
| Titrant/Sensor | |
| Titrant | $CH_3ONa$ |
| Concentration [mol/L] | 0.1 |
| Sensor | DG115 |
| Unit of measurement | mV |
| Predispensing to volume | |
| Volume [mL] | 1.0 |
| Wait time [s] | 0 |
| Titrant addition | Dynamic |
| dE (set) [mV] | 8.0 |
| dV (min) [mL] | 0.03 |
| dV (max) [mL] | 0.5 |
| Measure mode | Equilibrium controlled |
| dE [mV] | 0.5 |
| dt [s] | 1.0 |
| t (min) [s] | 2.0 |
| t (max) [s] | 20.0 |
| Recognition | |
| Threshold | 100.0 |
| Steepest jump only | No |
| Range | No |

-continued

| [Measurement Conditions] | |
|---|---|
| Tendency | None |
| Termination | |
| at maximum volume [mL] | 10.0 |
| at potential | No |
| at slope | No |
| after number EQPs | Yes |
| n = 1 | |
| comb.termination conditions | No |
| Evaluation | |
| Procedure | Standard |
| Potential 1 | No |
| Potential 2 | No |
| Stop for reevaluation | No |

The acid value is measured by the method in accordance with JIS K0070-1992.

Specifically, first, 0.5 g of a sample (ethyl acetate soluble content: 0.3 g) is added to 120 mL of toluene, and the resultant mixture is stirred for about 10 hours at 23° C. for dissolution. Next, ethanol (30 mL) is added thereto to prepare a sample solution. Notably, when the sample is not dissolved thereinto, another solvent such as dioxane or tetrahydrofuran is used. Then, a potentiometric automatic titrator DL-53 (product of Metller-Toledo International Inc.) and an electrode DG113-SC (product of Metller-Toledo International Inc.) are used to measure the acid value at 23° C. The measurements are analyzed with analysis software LabX Light Version 1.00.000. The calibration for this apparatus is performed using a solvent mixture of toluene (120 mL) and ethanol (30 mL).

The measurement conditions are the same as those set for measuring the hydroxyl value.

The acid value can be measured in the above-described manner. Specifically, the sample solution is titrated with a pre-standardized 0.1N potassium hydroxide/alcohol solution and then the acid value is calculated from the titer using the equation: acid value (KOHmg/g)=titer (mL)×N×56.1 (mg/mL)/mass of sample (g), where N is a factor of 0.1N potassium hydroxide/alcohol solution.

<<Measurement Methods for Melting Point and Glass Transition Temperature Tg>>

In the present invention, a melting point and a glass transition temperature Tg can be measured with, for example, a DSC system (a differential scanning calorimeter) ("DSC-60," product of Shimadzu Corporation).

Specifically, a melting point and a glass transition temperature of a measurement sample can be measured by the following procedure.

First, about 5.0 mg of a measurement sample is placed in an aluminum sample container. The sample container is placed on a holder unit and set in an electric furnace. Next, in a nitrogen atmosphere, the sample container is heated from 0° C. to 150° C. at a temperature increasing rate of 10° C./min. Thereafter, the sample container is cooled from 150° C. to 0° C. at a temperature decreasing rate of 10° C./min, and then heated to 150° C. at a temperature increasing rate of 10° C./min. In this process, the DSC curve of the sample is measured with the differential scanning calorimeter ("DSC-60," product of Shimadzu Corporation).

From the obtained DSC curves, the glass transition temperature can be obtained at each temperature rising with the analysis program "endothermic shoulder temperature" of the DSC-60 system. Specifically, the glass transition temperature of the measurement sample at the first temperature rise is determined from the DSC curve of the first temperature rising with "endothermic shoulder temperature" of the analysis program. The glass transition temperature of the measurement sample at the second temperature rise is determined from the DSC curve of the second temperature rising with "endothermic shoulder temperature" of the analysis program.

Similarly, from the obtained DSC curves, the melting point can be obtained at each temperature rising with the analysis program "endothermic peak temperature" of the DSC-60 system. Specifically, the melting point of the measurement sample at the first temperature rise is determined from the DSC curve of the first temperature rising with "endothermic peak temperature" of the analysis program. The melting point of the measurement sample at the second temperature rise is determined from the DSC curve of the second temperature rising with "endothermic peak temperature" of the analysis program.

In the present invention, the glass transition temperature of a toner as the measurement sample at the first temperature rise is defined as Tg1st, and that at the second temperature rise is defined as Tg2nd.

Also, in the present invention, the melting point and Tg of each constituent component as the measurement sample at the second temperature rising is defined as the melting point and Tg thereof.

<<Measurement Method for Particle Size Distribution>>

The volume average particle diameter ($D_4$), number average particle diameter ($D_n$), and a ratio ($D_4/D_n$) of the volume average particle diameter to the number average particle diameter, of the toner can be measured by Coulter Counter TA-II, Coulter Multisizer II (these products are of Beckman Coulter, Inc.), or the like. In the present invention, the Coulter Multisizer II is used. The measurement method will be described below.

Specifically, first, 0.1 mL to 5 mL of a surfactant, preferably polyoxyethylene alkyl ether (nonionic surfactant), is added as a dispersant to 100 mL to 150 mL of an electrolyte solution. Here, the electrolyte solution is a 1% by mass NaCl aqueous solution prepared using primary sodium chloride, and for example, ISOTON-II (product of Beckman Coulter, Inc.) can be used. Subsequently, 2 mg to 20 mg of a measurement sample is suspended in the above-obtained electrolyte solution. The resultant electrolyte solution is dispersed with an ultrasonic wave disperser for 1 minute to 3 minutes. The thus-obtained dispersion liquid is analyzed with the above-described apparatus using an aperture of 100 μm to measure the number and volume of a toner particle or toner. Then, the volume particle size distribution and number particle size distribution are calculated from the obtained values. From the obtained distribution, a volume average particle diameter ($D_4$) and number average particle diameter ($D_n$) can be obtained.

In this measurement, 13 channels are used: 2.00 μm (inclusive) to 2.52 μm (exclusive); 2.52 μm (inclusive) to 3.17 μm (exclusive); 3.17 μm (inclusive) to 4.00 μm (exclusive); 4.00 μm (inclusive) to 5.04 μm (exclusive); 5.04 μm (inclusive) to 6.35 μm (exclusive); 6.35 μm (inclusive) to 8.00 μm (exclusive); 8.00 μm (inclusive) to 10.08 μm (exclusive); 10.08 μm (inclusive) to 12.70 μm (exclusive); 12.70 μm (inclusive) to 16.00 μm (exclusive); 16.00 μm (inclusive) to 20.20 μm (exclusive); 20.20 μm (inclusive) to 25.40 μm (exclusive); 25.40 μm (inclusive) to 32.00 μm (exclusive); and 32.00 μm (inclusive) to 40.30 μm (exclusive); i.e., particles having a particle diameter of 2.00 μm (inclusive) to 40.30 μm (exclusive) are subjected to the measurement.

<Method for Producing Toner>

A method for producing a toner is not particularly limited and may be appropriately selected depending on the intended purpose. The toner is preferably formed by dispersing in an aqueous medium an oil phase containing at least the non-crystalline polyester resin, the crystalline polyester resin, the releasing agent, the graft-modified polymer, and the colorant.

As such method for producing a toner, a known dissolution suspension method is used.

As another method for producing a toner, a method of producing toner base particles while producing a resin (modified resin) (hereinafter, referred to as an "adhesive base material") obtained by elongation and/or crosslinking reaction of the active hydrogen group-containing compound and the polymer having a site reactive with the active hydrogen group-containing compound. In this method, preparation of an aqueous medium, preparation of an oil phase containing a toner material, emulsification or dispersing of the toner material, solvent removal, etc., are carried out.

—Preparation of Aqueous Medium (Aqueous Phase)—

Preparation of the aqueous medium can be achieved by dispersing resin particles into an aqueous medium. The amount of the resin particles to be added in the aqueous medium is not particularly limited and may be appropriately selected depending on the intended purpose. It is preferably 0.5% by mass to 10% by mass.

The aqueous medium is not particularly limited and may be appropriately selected depending on the intended purpose. Examples thereof include water, water-miscible solvents and mixtures thereof. These may be used alone or in combination.

Of these, water is preferable.

The water-miscible solvents are not particularly limited and may be appropriately selected depending on the intended purpose. Examples thereof include alcohols, dimethylformamide, tetrahydrofuran, cellsolves and lower ketones. The alcohols are not particularly limited and may be appropriately selected depending on the intended purpose. Examples thereof include methanol, isopropanol and ethylene glycol. The lower ketones are not particularly limited and may be appropriately selected depending on the intended purpose. Examples thereof include acetone and methyl ethyl ketone.

—Oil Phase—

The oil phase is not particularly limited and may be appropriately selected depending on the intended purpose. The oil phase containing the toner material is prepared by dissolving or dispersing the toner material in an organic solvent, the toner material containing the active hydrogen group-containing compound, the polymer having a site reactive with the active hydrogen group-containing compound, the crystalline polyester resin, the non-crystalline polyester resin, the releasing agent, the graft-modified polymer, the colorant, etc.

The organic solvent is not particularly limited, and may be appropriately selected depending on the intended purpose. The organic solvent having a boiling point of lower than 150° C. is preferable in terms of easy removal.

The organic solvent having a boiling point of lower than 150° C. is not particularly limited and may be appropriately selected depending on the intended purpose. Examples thereof include toluene, xylene, benzene, carbon tetrachloride, methylene chloride, 1,2-dichloroethane, 1,1,2-trichloroethane, trichloroethylene, chloroform, monochlorobenzene, dichloroethylidene, methyl acetate, ethyl acetate, methyl ethyl ketone and methyl isobutyl ketone. These may be used alone or in combination.

Of these, ethyl acetate, toluene, xylene, benzene, methylene chloride, 1,2-dichloroethane, chloroform, and carbon tetrachloride are preferable, and ethyl acetate is more preferable.

—Emulsification or Dispersing—

Emulsification or dispersing of the toner material can be achieved by dispersing the oil phase containing the toner material in the aqueous medium. By allowing the active hydrogen group-containing compound and the polymer having a site reactive with the active hydrogen group-containing compound to undergo elongation reaction and/or crosslinking reaction upon emulsification or dispersing of the toner material, an adhesive base material is produced.

The adhesive base material may be produced by emulsifying or dispersing in an aqueous medium an oil phase containing a polymer reactive with an active hydrogen group (e.g., isocyanate group-containing polyester prepolymer) together with an active hydrogen group-containing compound (e.g., amine) so that they undergo elongation reaction and/or crosslinking reaction in the aqueous medium, may be produced by emulsifying or dispersing an oil phase containing the toner material in an aqueous medium in which the active hydrogen group-containing compound has been previously added so that they undergo elongation reaction and/or crosslinking reaction in the aqueous medium, or may be produced by emulsifying or dispersing an oil phase containing a toner material in an aqueous medium and adding the active hydrogen group-containing compound so that they undergo elongation reaction and/or crosslinking reaction from particle interfaces in the aqueous medium. When effecting the elongation reaction and/or crosslinking reaction from particle interfaces, the urea-modified polyester resin is preferentially formed on the toner particle surfaces being produced; thus it is possible to form a concentration gradient of the urea-modified polyester resin in the toner particles.

The reaction conditions, such as reaction time, reaction temperature, etc. used for the production of the adhesive base material is not particularly limited and may be appropriately determined depending on the combinations of the polymer having a site reactive with an active hydrogen group and the active hydrogen group-containing compound.

The reaction time is not particularly limited and may be appropriately selected depending on the intended purpose. It is preferably from 10 minutes to 40 hours, more preferably from 2 hours to 24 hours.

The reaction temperature is not particularly limited and may be appropriately selected depending on the intended purpose. It is preferably 0° C. to 150° C., more preferably from 40° C. to 98° C.

A method of stably forming a dispersion liquid containing the polymer having a site reactive with the active hydrogen group-containing compound (e.g. isocyanate group-containing polyester prepolymer) in the aqueous medium is not particularly limited and may be appropriately selected depending on the intended purpose. For example, a method is used, in which an oil phase prepared by dissolving or dispersing the toner material in an aqueous phase and dispersed by shear force.

A disperser for dispersing is not particularly limited and may be appropriately selected depending on the intended purpose. Examples thereof include a low-speed shear disperser, high-speed shear disperser, friction disperser, high-pressure and jet disperser, and supersonic disperser.

Of these, the high-speed shear disperser is preferable, because it is capable of adjusting the particle diameter of the dispersion (oil droplet) to be a range of 2 μm to 20 μm.

When the high-speed shear disperser is used, conditions of rotational speed, dispersing time, dispersing temperature, etc., can be determined depending on the intended purpose.

The rotational speed is not particularly limited and may be appropriately selected depending on the intended purpose. It is preferably 1,000 rpm to 30,000 rpm, more preferably 5,000 rpm to 20,000 rpm.

The dispersing time is not particularly limited and may be appropriately selected depending on the intended purpose. It is preferably 0.1 minutes to 5 minutes in the case of batch method.

The dispersing temperature is not particularly limited and may be appropriately selected depending on the intended purpose. It is preferably 0° C. to 150° C., more preferably 40° C. to 98° C. under pressure. In general, dispersing can be more easily effected at higher temperature.

The amount of the aqueous medium for emulsification or dispersing of the toner material is not particularly limited and may be appropriately selected depending on the intended purpose. It is preferably 50 parts by mass to 2,000 parts by mass, more preferably 100 parts by mass to 1,000 parts by mass relative to 100 parts by mass of the toner material.

When the amount of the aqueous medium is less than 50 parts by mass, the toner material is poorly dispersed and thus toner base particles each having a desired particle diameter cannot be obtained. When it is more than 2,000 parts by mass, production costs may be high.

When the oil phase containing the toner material is emulsified or dispersed, a dispersant is preferably used for the purpose of stabilizing the dispersion (e.g., oil droplets) to have a desired shape, and of obtaining a sharp particle size distribution.

The dispersant is not particularly limited and may be appropriately selected depending on the intended purpose. Examples thereof include surfactants, sparingly water soluble inorganic dispersants, and polymeric protective colloids. These dispersants may be used alone or in combination.

Of these, surfactants are preferable.

The surfactants are not particularly limited and may be appropriately selected depending on the intended purpose. Examples thereof include anionic surfactants, cationic surfactants, nonionic surfactants, and ampholytic surfactants.

The anionic surfactants are not particularly limited and may be appropriately selected depending on the intended purpose. Examples thereof include alkylbenzene sulfonates, α-olefin sulfonates, and phosphates.

Of these, those having fluoroalkyl groups are preferable.

A catalyst can be used for elongation reaction and/or crosslinking reaction for production of the adhesive base material.

The catalyst is not particularly limited and may be appropriately selected depending on the intended purpose. Examples thereof include dibutyltin laurate, and dioctyltin laurate.

—Removal of Organic Solvent—

The method for removing the organic solvent from the dispersion liquid such as emulsified slurry is not particularly limited and may be appropriately selected depending on the intended purpose. Examples of the method include a method in which the entire reaction system is gradually increased in temperature to completely evaporate the organic solvent contained in the oil droplets; and a method in which the dispersion liquid is sprayed in a dry atmosphere to completely remove the organic solvent contained in the oil droplets.

When the organic solvent is removed, toner base particles are formed. The toner base particles are subjected to washing, drying, and classification. The Classification is performed by removing very fine particles using a cyclone, a decanter, a centrifugal separator, etc. in the liquid. Alternatively, the classification may be performed on powder obtained after drying.

The resultant toner base particles may be mixed with other particles such as the external additive, and the charge controlling agent. A mechanical impact may be applied to the mixture on the surfaces of the toner base particles, to thereby prevent the other particles from dropping off from the surfaces of the toner base particles.

The method for applying mechanical impact is not particularly limited and may be appropriately selected depending on the intended purpose. Examples thereof include a method in which an impact is applied to a mixture using a high-speed rotating blade, and a method in which an impact is applied by putting mixed particles into a high-speed air flow and accelerating the air speed such that the particles collide against one another or that the particles are crashed into a proper collision plate.

An apparatus used in these methods is not particularly limited and may be appropriately selected depending on the intended purpose. Examples of the apparatus include ANGMILL (product of Hosokawa Micron Corporation), an apparatus produced by modifying I-type mill (product of Nippon Pneumatic Mfg. Co., Ltd.) so that the pulverizing air pressure thereof is decreased, a hybridization system (product of Nara Machinery Co., Ltd.), a kryptron system (product of Kawasaki Heavy Industries, Ltd.) and an automatic mortar.

(Developer)

A developer of the present invention contains at least the toner of the present invention and, if necessary, may further contain appropriately selected additional components such as carrier.

Thus, the developer has excellent transferability, charging ability and is capable of stably forming high-quality images. The developer may be a one-component developer or two-component developer and it is preferably a two-component developer for its long life when used in high-speed printers corresponding to recent high information processing speed.

When the developer is used as a one-component developer, variations in toner particle diameter are small, even after toner consumption or toner supply, and toner filming to a development roller and toner fusing to members (e.g., a blade for forming a thin toner film) are prevented, and in addition, even after long-time use of the development device (i.e., long-time stirring of developer), excellent developing ability can be ensured and excellent images are obtained in a stable manner.

When the developer is used as a two-component developer, even after a long-time toner consumption and toner supply, variations in toner particle diameter are small, and even after long-time stirring in a development device, excellent developing ability can be ensured and excellent images are obtained in a stable manner.

When the toner is used for a two-component developer, the toner may be mixed with the carrier. The amount of the carrier in the two-component developer is not particularly limited and may be appropriately selected depending on the intended purpose. It is preferably 90% by mass to 98% by mass, more preferably 93% by mass to 97% by mass.

<Carrier>

The carrier is not particularly limited and may be appropriately selected depending on the intended purpose. The carrier preferably has a core material and a resin layer covering the core material.

—Core Material—

The material of the core material is not particularly limited and may be appropriately selected depending on the intended purpose. Examples thereof include manganese-strontium material or manganese-magnesium material (50 emu/g to 90 emu/g). For the purpose of securing image density, high magnetization material such as iron powder (100 emu/g or more) or magnetite (75 emu/g to 120 emu/g) is preferably used.

Moreover, a low magnetization material such as copper-zinc with 30 emu/g to 80 emu/g is preferably used, because the impact toward the photoconductor, on which developer particles are held in an upright position, can be relieved and because it is advantageous for improvement of image quality.

These materials may be used alone or in combination.

The volume average particle diameter of the core material is not particularly limited and may be appropriately selected depending on the intended purpose. It is preferably 10 μm to 150 μm, more preferably 40 μm to 100 μm. When the volume-average particle diameter is less than 10 μm, the amount of fine carrier powder increases, whereas magnetization per particle decreases and carrier scattering may occur. When the volume-average particle diameter is greater than 150 μm, the specific surface area decreases and thus toner scattering may occur; therefore, in the case of printing a full-color image with many solid portions, especially the solid portions may be poorly reproduced.

—Resin Layer—

The material of the resin layer is not particularly limited and may be appropriately selected from known resins depending on the intended purpose. Examples thereof include amino resins, polyvinyl resins, polystyrene resins, polyhalogenated olefins, polyester resins, polycarbonate resins, polyethylene, polyvinyl fluoride, polyvinylidene fluoride, polytrifluoroethylene, polyhexafluoropropylene, copolymers of vinylidene fluoride and acrylic monomer, copolymers of vinylidene fluoride and vinyl fluoride, fluoroterpolymers such as terpolymers of tetrafluoroethylene, vinylidene fluoride and monomer having no fluoro group, and silicone resins.

These may be used alone or in combination.

The amino resins are not particularly limited and may be appropriately selected depending on the intended purpose. Examples thereof include urea-formaldehyde resins, melamine resins, benzoguanamine resins, urea resins, polyamide resins, and epoxy resins.

The polyvinyl resins are not particularly limited and may be appropriately selected depending on the intended purpose. Examples thereof include acrylic resins, polymethyl methacrylate, polyacrylonitrile, polyvinyl acetate, polyvinyl alcohol, and polyvinyl butyral.

The polystyrene resins are not particularly limited and may be appropriately selected depending on the intended purpose. Specific examples thereof include polystyrene and styrene-acrylic copolymers.

The polyhalogenated olefins are not particularly limited and may be appropriately selected depending on the intended purpose. Examples thereof include polyvinyl chloride.

The polyester resins are not particularly limited and may be appropriately selected depending on the intended purpose. Examples thereof include polyethylene terephtalate and polybutylene terephtalate.

The resin layer may contain conductive powder or the like, if necessary. The conductive powder is not particularly limited and may be appropriately selected depending on the intended purpose. Examples thereof include metal powder, carbon black, titanic oxide, tin oxide, and zinc oxide. The average particle diameter of these conductive powders is preferably 1 μm or less. When the average particle diameter is greater than 1 μm, it may be difficult to control the electrical resistance.

The resin layer may be formed by uniformly coating a surface of the core material with a coating solution, which is prepared by dissolving a silicone resin or the like in a solvent, by a known coating method, followed by drying and baking.

The coating method is not particularly limited and may be appropriately selected depending on the intended purpose. Examples thereof include dipping, spraying, and brushing.

The solvent not particularly limited and may be appropriately selected depending on the intended purpose. Examples thereof include toluene, xylene, methyl ethyl ketone, methyl isobutyl ketone, and butyl cellosolve acetate.

The baking is not particularly limited and may be external heating or internal heating. Examples of the baking methods include methods using fixed electric furnace, fluid electric furnace, rotary electric furnace, or burner furnace, and methods using microwaves.

The amount of the resin layer in the carrier is not particularly limited and may be appropriately selected depending on the intended purpose. It is preferably 0.01% by mass to 5.0% by mass. When the amount is less than 0.01% by mass, the resin layer may not be uniformly formed over the surface of the core material. When the amount is more than 5.0% by mass, the resin layer becomes so thick that fusing of carrier particles occurs, possibly causing decrease in uniformity in carrier particle size.

EXAMPLES

Hereinafter, Examples of the present invention will be described in detail, however, these Examples shall not be construed as limiting the scope of the present invention. Note that, "part(s)" described in the following means "part(s) by mass".

Production Example 1-1

<Synthesis of Crystalline Polyester Resin 1>

A 5 L four-neck flask equipped with a nitrogen-introducing tube, a drain tube, a stirrer and a thermocouple was charged with 2,120 g of 1,10-decanedicarboxylic acid, 1,000 g of 1,8-octanediol, 1,520 g of 1,4-butanediol and 3.9 g of hydroquinone, followed by reaction at 180° C. for 10 hours. Thereafter, the reaction mixture was allowed to react at 200° C. for 3 hours and further react at 8.3 kPa for 2 hours, to thereby produce Crystalline Polyester Resin 1.

The thus-produced Crystalline Polyester Resin 1 had a SP value of 9.9 and a melting point of 67° C.

The orthodichlorobenzene soluble content of Crystalline Polyester Resin 1 had a weight average molecular weight (Mw) of 15,000, a number average molecular weight (Mn) of 5,000, and Mw/Mn of 3.0, as determined by measuring the orthodichlorobenzene soluble content of Crystalline Polyester Resin 1 through gel permeation chromatography (GPC).

Production Example 1-2

<Synthesis of Crystalline Polyester Resin 2>

A 5 L four-neck flask equipped with a nitrogen-introducing tube, a drain tube, a stirrer and a thermocouple was charged with 1,160 g of fumaric acid, 1,520 g of 1,10-decanedicarboxylic acid, 1,020 g of 1,6-octanediol, 1,300 g of 1,4-butanediol and 4.9 g of hydroquinone, followed by reaction at 180° C. for 10 hours. Thereafter, the reaction mixture was allowed to react at 200° C. for 3 hours and further react at 8.3 kPa for 2 hours, to thereby produce Crystalline Polyester Resin 2.

The thus-produced Crystalline Polyester Resin 2 had a SP value of 10.3 and a melting point of 82° C.

The orthodichlorobenzene soluble content of Crystalline Polyester Resin 2 had a weight average molecular weight (Mw) of 18,000, a number average molecular weight (Mn) of 5,000, and Mw/Mn of 3.6, as determined by measuring the orthodichlorobenzene soluble content of Crystalline Polyester Resin 2 through gel permeation chromatography (GPC).

Production Example 1-3

<Synthesis of Crystalline Polyester Resin 3>

A 5 L four-neck flask equipped with a nitrogen-introducing tube, a drain tube, a stirrer and a thermocouple was charged with 2,120 g of 1,10-decanedicarboxylic acid, 1,800 g of 1,10-octanediol, and 3.9 g of hydroquinone, followed by reaction at 180° C. for 10 hours. Thereafter, the reaction mixture was allowed to react at 200° C. for 3 hours and further react at 8.3 kPa for 2 hours, to thereby produce Crystalline Polyester Resin 3.

The thus-produced Crystalline Polyester Resin 3 had a SP value of 9.6 and a melting point of 71° C.

The orthodichlorobenzene soluble content of Crystalline Polyester Resin 3 had a weight average molecular weight (Mw) of 16,000, a number average molecular weight (Mn) of 5,000, and Mw/Mn of 3.2, as determined by measuring the orthodichlorobenzene soluble content of Crystalline Polyester Resin 3 through gel permeation chromatography (GPC).

Production Example 1-4

<Synthesis of Crystalline Polyester Resin 4>

A 5 L four-neck flask equipped with a nitrogen-introducing tube, a drain tube, a stirrer and a thermocouple was charged with 2,320 g of 1,12-decanedicarboxylic acid, 2,100 g of 1,12-octanediol, and 3.9 g of hydroquinone, followed by reaction at 180° C. for 10 hours. Thereafter, the reaction mixture was allowed to react at 200° C. for 3 hours and further react at 8.3 kPa for 2 hours, to thereby produce Crystalline Polyester Resin 4.

The thus-produced Crystalline Polyester Resin 4 had a SP value of 9.3 and a melting point of 73° C.

The orthodichlorobenzene soluble content of Crystalline Polyester Resin 4 had a weight average molecular weight (Mw) of 16,000, a number average molecular weight (Mn) of 4,000, and Mw/Mn of 4.0, as determined by measuring the orthodichlorobenzene soluble content of Crystalline Polyester Resin 4 through gel permeation chromatography (GPC).

Production Example 1-5

<Synthesis of Crystalline Polyester Resin 5>

A 5 L four-neck flask equipped with a nitrogen-introducing tube, a drain tube, a stirrer and a thermocouple was charged with 1,120 g of maleic acid, 1,140 g of succinic acid, 960 g of 1,4-butanediol, 1,200 g of 1,6-hexanediol, and 3.9 g of hydroquinone, followed by reaction at 180° C. for 10 hours. Thereafter, the reaction mixture was allowed to react at 200° C. for 3 hours and further react at 8.3 kPa for 2 hours, to thereby produce Crystalline Polyester Resin 5.

The thus-produced Crystalline Polyester Resin 5 had a SP value of 10.8 and a melting point of 88° C.

The orthodichlorobenzene soluble content of Crystalline Polyester Resin 5 had a weight average molecular weight (Mw) of 6,200, a number average molecular weight (Mn) of 1,400, and Mw/Mn of 4.4, as determined by measuring the orthodichlorobenzene soluble content of Crystalline Polyester Resin 5 through gel permeation chromatography (GPC).

Production Example 1-6

<Synthesis of Crystalline Polyester Resin 6>

A 5 L four-neck flask equipped with a nitrogen-introducing tube, a drain tube, a stirrer and a thermocouple was charged with 1,060 g of fumaric acid, 892 g of 1,4-butanediol, 260 g of 1,6-hexanediol, 190 g of trimellitic anhydride, and 2.0 g of hydroquinone, followed by reaction at 160° C. for 5 hours. Thereafter, the reaction mixture was allowed to react at 8.3 kPa at 160° C. for 12 hours, to thereby produce Crystalline Polyester Resin 6.

The thus-produced Crystalline Polyester Resin 6 had a SP value of 11.1 and a melting point of 117° C.

The orthodichlorobenzene soluble content of Crystalline Polyester Resin 6 had a weight average molecular weight (Mw) of 160,000, a number average molecular weight (Mn) of 5,000, and Mw/Mn of 32.0, as determined by measuring the orthodichlorobenzene soluble content of Crystalline Polyester Resin 6 through gel permeation chromatography (GPC).

The characteristic values of the crystalline polyester resins are shown in Table 1.

TABLE 1

| Production Example | Crystalline polyester resin | SP Value | Melting point (° C.) | Mw | Mn | Mw/Mn |
|---|---|---|---|---|---|---|
| 1-1 | 1 | 9.9 | 67 | 15,000 | 5,000 | 3.0 |
| 1-2 | 2 | 10.3 | 82 | 18,000 | 5,000 | 3.6 |
| 1-3 | 3 | 9.6 | 71 | 16,000 | 5,000 | 3.2 |
| 1-4 | 4 | 9.3 | 73 | 16,000 | 4,000 | 4.0 |
| 1-5 | 5 | 10.8 | 88 | 6,200 | 1,400 | 4.4 |
| 1-6 | 6 | 11.1 | 117 | 160,000 | 5,000 | 32.0 |

Production Example 2-1

<Synthesis of Non-Crystalline Polyester Resin 1>

A 5 L four-neck flask equipped with a nitrogen-introducing tube, a drain tube, a stirrer and a thermocouple was charged with 229 parts of bisphenol A ethylene oxide 2 mole adduct, 529 parts of bisphenol A propylene oxide 3 mole adduct, 100 parts of isophthalic acid, 108 parts of terephthalic acid, 46 parts of adipic acid and 2 parts of dibutyl tin oxide. The reaction mixture was allowed to react under normal pressure at 230° C. for 10 hours and further react under a reduced pressure of 10 mmHg to 15 mmHg for 5 hours. Then, 30 parts of trimellitic anhydride was added to the flask, followed by reaction at 180° C. under normal pressure for 3 hours, to thereby produce Non-Crystalline Polyester Resin 1.

Non-Crystalline Polyester Resin 1 had a SP value of 10.8.

Non-Crystalline Polyester Resin 1 had a weight average molecular weight (Mw) of 5,500, a number average molecular weight (Mn) of 1,800, a glass transition temperature (Tg) of 50° C., and an acid value of 20 mgKOH/g.

Production Example 2-2

<Synthesis of Non-Crystalline Polyester Resin 2>

A 5 L four-neck flask equipped with a nitrogen-introducing tube, a drain tube, a stirrer and a thermocouple was charged with 499 parts of bisphenol A ethylene oxide 2 mole adduct, 229 parts of bisphenol A propylene oxide 3 mole adduct, 100 parts of isophthalic acid, 108 parts of terephthalic acid, 46 parts of adipic acid and 2 parts of dibutyl tin oxide. The reaction mixture was allowed to react under normal pressure at 230° C. for 10 hours and further react under a reduced pressure of 10 mmHg to 15 mmHg for 5 hours. Then, 30 parts of trimellitic anhydride was added to the flask, followed by reaction at 180° C. under normal pressure for 3 hours, to thereby produce Non-Crystalline Polyester Resin 2.

Non-Crystalline Polyester Resin 2 had a SP value of 11.1.

Non-Crystalline Polyester Resin 2 had a weight average molecular weight (Mw) of 5,500, a number average molecular weight (Mn) of 1,800, a glass transition temperature (Tg) of 50° C., and an acid value of 20 mgKOH/g.

Production Example 2-3

<Synthesis of Non-Crystalline Polyester Resin 3>

A 5 L four-neck flask equipped with a nitrogen-introducing tube, a drain tube, a stirrer and a thermocouple was charged with 229 parts of bisphenol A ethylene oxide 2 mole adduct, 529 parts of bisphenol A propylene oxide 3 mole adduct, 70 parts of isophthalic acid, 98 parts of terephthalic acid, 46 parts of fumaric acid, 24 parts of dodecenyl succinic acid and 2 parts of dibutyl tin oxide, and nitrogen gas was introduced into the flask to maintain the internal atmosphere thereof as an inert atmosphere, followed by raising the temperature thereof. The mixture was allowed to proceed to condensation copolymerization reaction at 230° C. for 12 hours, and then internal pressure of the flask was gradually reduced at 230° C., to thereby produce Non-Crystalline Polyester Resin 3.

Non-Crystalline Polyester Resin 3 had a SP value of 10.8.

Non-Crystalline Polyester Resin 3 had a weight average molecular weight (Mw) of 17,400, a number average molecular weight (Mn) of 6,700, a glass transition temperature (Tg) of 61° C., and an acid value of 14 mgKOH/g.

Production Example 2-4

<Synthesis of Non-Crystalline Polyester Resin 4>

A 5 L four-neck flask equipped with a nitrogen-introducing tube, a drain tube, a stirrer and a thermocouple was charged with 29 parts of bisphenol A ethylene oxide 2 mole adduct, 759 parts of bisphenol A propylene oxide 3 mole adduct, 100 parts of isophthalic acid, 108 parts of terephthalic acid, 46 parts of adipic acid and 2 parts of dibutyl tin oxide. The reaction mixture was allowed to react under normal pressure at 230° C. for 10 hours and further react under a reduced pressure of 10 mmHg to 15 mmHg for 5 hours. Then, 30 parts of trimellitic anhydride was added to the flask, followed by reaction at 180° C. under normal pressure for 3 hours, to thereby produce Non-Crystalline Polyester Resin 4.

Non-Crystalline Polyester Resin 4 had a SP value of 10.6.

Non-Crystalline Polyester Resin 4 had a weight average molecular weight (Mw) of 5,500, a number average molecular weight (Mn) of 1,700, a glass transition temperature (Tg) of 50° C., and an acid value of 20 mgKOH/g.

Production Example 2-5

<Synthesis of Non-Crystalline Polyester Resin 5>

A 5 L four-neck flask equipped with a nitrogen-introducing tube, a drain tube, a stirrer and a thermocouple was charged with 550 parts of bisphenol A ethylene oxide 2 mole adduct, 163 parts of bisphenol A propylene oxide 3 mole adduct, 100 parts of isophthalic acid, 108 parts of terephthalic acid, 46 parts of adipic acid and 2 parts of dibutyl tin oxide. The reaction mixture was allowed to react under normal pressure at 230° C. for 10 hours and further react under a reduced pressure of 10 mmHg to 15 mmHg for 5 hours. Then, 30 parts of trimellitic anhydride was added to the flask, followed by reaction at 180° C. under normal pressure for 3 hours, to thereby produce Non-Crystalline Polyester Resin 5.

Non-Crystalline Polyester Resin 5 had a SP value of 11.0.

Non-Crystalline Polyester Resin 5 had a weight average molecular weight (Mw) of 5,500, a number average molecular weight (Mn) of 1,800, a glass transition temperature (Tg) of 50° C., and an acid value of 20 mgKOH/g.

Production Example 2-6

<Synthesis of Non-Crystalline Polyester Resin 6>

Bis{4-hydroxypolyoxypropylene (2.2 mol) phenyl}propane (1,575 parts, 90 parts by mole), 163 parts (10 parts by mole) of bis{4-hydroxypolyoxyethylene (2.2 mol) phenyl}propane, 377 parts (65 parts by mole of fumaric acid, and 4 parts of dibutyl tin oxide were allowed to react at 220° C. for 8 hours in a nitrogen atmosphere, followed by reaction at 8.3 kPa at 220° C. for 1 hour. To the reaction mixture, 336 parts (35 parts by mole) of trimellitic anhydride was added at 210° C., followed by reaction at 210° C. for 24 hours, to thereby produce Non-Crystalline Polyester Resin 6.

Non-Crystalline Polyester Resin 6 had a SP value of 11.0.

Non-Crystalline Polyester Resin 6 had a weight average molecular weight (Mw) of 28,000, a number average molecular weight (Mn) of 5,000, a glass transition temperature (Tg) of 65° C., and an acid value of 20 mgKOH/g.

The characteristic values of Non-Crystalline Polyester Resins 1 to 6 are shown in Table 2.

TABLE 2

| Production Example | Non-crystalline polyester resin | SP value | Mw | Mn | Mw/Mn | Tg (° C.) | Acid value (mgKOH/g) |
|---|---|---|---|---|---|---|---|
| 2-1 | 1 | 10.8 | 5,500 | 1,800 | 3.1 | 50 | 20 |
| 2-2 | 2 | 11.1 | 5,500 | 1,800 | 3.1 | 50 | 20 |
| 2-3 | 3 | 10.8 | 17,400 | 6,700 | 2.6 | 61 | 14 |
| 2-4 | 4 | 10.6 | 5,500 | 1,700 | 3.2 | 50 | 20 |
| 2-5 | 5 | 11.0 | 5,500 | 1,800 | 3.1 | 50 | 20 |
| 2-6 | 6 | 11.0 | 28,000 | 5,000 | 5.6 | 65 | 20 |

Production Example 3-1

<Synthesis of Graft-Modified Polymer 1>

In an autoclave reaction vessel equipped with a thermometer and a stirrer, 480 parts of xylene and 100 parts of low molecular weight polyethylene (SANWAX 151P, product of Sanyo Chemical Industries, Ltd., a melting point: 108° C., a weight average molecular weight: 1,000) were placed such that the polyethylene was sufficiently dissolved into the xylene, and then the vessel was purged with nitrogen. Thereafter, in the autoclave reaction vessel a mixed solution of 805 parts of styrene, 50 parts of acrylonitrile, 45 parts of butyl acrylate, and 36 parts of di-t-butyl peroxide, 100 parts of xylene was added dropwise at 170° C. for 3 hours to effect polymerization, followed by maintaining the mixture at 170°

C. for 30 min. Subsequently, the solvent was removed from the obtained product, to thereby obtain Graft-Modified Polymer 1.

In Graft-Modified Polymer 1, the acrylic resin had a weight average molecular weight of 16,000.

Graft-Modified Polymer 1 had a SP value of 10.4.

Graft-Modified Polymer 1 had a weight average molecular weight (Mw) of 18,000, a number average molecular weight (Mn) of 3,300, and a glass transition temperature (Tg) of 65° C.

Production Example 3-2

<Synthesis of Graft-Modified Polymer 2>

In an autoclave reaction vessel equipped with a thermometer and a stirrer, 480 parts of xylene and 100 parts of Crystalline Polyester Resin 1 were placed such that Crystalline Polyester Resin 1 was sufficiently dissolved into the xylene, and then the vessel was purged with nitrogen. Thereafter, in the autoclave reaction vessel a mixed solution of 805 parts of styrene, 50 parts of acrylonitrile, 45 parts of butyl acrylate, 36 parts of di-t-butyl peroxide, and 100 parts of xylene was added dropwise at 170° C. for 3 hours to effect polymerization, followed by maintaining the mixture at 170° C. for 30 min. Subsequently, the solvent was removed from the obtained product, to thereby obtain Graft-Modified Polymer 2.

In Graft-Modified Polymer 2, the acrylic resin had a weight average molecular weight of 15,000.

Graft-Modified Polymer 2 had a SP value of 10.5.

Graft-Modified Polymer 2 had a weight average molecular weight (Mw) of 19,000, a number average molecular weight (Mn) of 3,600, and a glass transition temperature (Tg) of 63° C.

Production Example 3-3

<Synthesis of Graft-Modified Polymer 3>

In an autoclave reaction vessel equipped with a thermometer and a stirrer, 480 parts of xylene and 200 parts of Crystalline Polyester Resin 1 were placed such that Crystalline Polyester Resin 1 was sufficiently dissolved into the xylene, and then the vessel was purged with nitrogen. Thereafter, into the autoclave reaction vessel, 800 parts of Non-Crystalline Polyester Resin 1, and 5 parts of dibutyltin oxide were charged, and reacted under normal pressure at 230° C. for 10 hours. Subsequently, the resultant mixture was reacted for 5 hours under reduced pressure of 10 mmHg to 15 mmHg. Subsequently, the solvent was removed from the obtained product, to thereby obtain Graft-Modified Polymer 3.

Graft-Modified Polymer 3 had a SP value of 10.6.

Graft-Modified Polymer 3 had a weight average molecular weight (Mw) of 12,000, a number average molecular weight (Mn) of 2,000, and a glass transition temperature (Tg) of 49° C.

Production Example 3-4

<Synthesis of Graft-Modified Polymer 4>

In an autoclave reaction vessel equipped with a thermometer and a stirrer, 480 parts of xylene and 1,000 parts of low molecular weight polyethylene (SANWAX 151P, product of Sanyo Chemical Industries, Ltd., a melting point: 108° C., a weight average molecular weight: 1,000) were placed such that the polyethylene was sufficiently dissolved into the xylene, and then the vessel was purged with nitrogen. Thereafter, in the autoclave reaction vessel a mixed solution of 105 parts of styrene, 10 parts of acrylonitrile, 5 parts of butyl acrylate, and 4 parts of di-t-butyl peroxide, 50 parts of xylene was added dropwise at 170° C. for 3 hours to effect polymerization, followed by maintaining the mixture at 170° C. for 30 min. Subsequently, the solvent was removed from the obtained product, to thereby obtain Graft-Modified Polymer 4.

In Graft-Modified Polymer 4, the acrylic resin had a weight average molecular weight of 15,000.

Graft-Modified Polymer 4 had a SP value of 9.7.

Graft-Modified Polymer 4 had a weight average molecular weight (Mw) of 6,500, a number average molecular weight (Mn) of 1,200, and a glass transition temperature (Tg) of 82° C.

Production Example 3-5

<Synthesis of Graft-Modified Polymer 5>

In an autoclave reaction vessel equipped with a thermometer and a stirrer, 480 parts of xylene and 100 parts of Non-Crystalline Polyester Resin 1 were placed such that Non-Crystalline Polyester Resin 1 was sufficiently dissolved into the xylene, and then the vessel was purged with nitrogen. Thereafter, into the autoclave reaction vessel, 900 parts of Non-Crystalline Polyester Resin 2, and 5 parts of dibutyltin oxide were charged, and reacted under normal pressure at 230° C. for 10 hours. Subsequently, the resultant mixture was reacted for 5 hours under reduced pressure of 10 mmHg to 15 mmHg. Subsequently, the solvent was removed from the obtained product, to thereby obtain Graft-Modified Polymer 5.

Graft-Modified Polymer 5 had a SP value of 11.0.

Graft-Modified Polymer 5 had a weight average molecular weight (Mw) of 7,000, a number average molecular weight (Mn) of 15,000, and a glass transition temperature (Tg) of 48° C.

Production Example 3-6

<Synthesis of Graft-Modified Polymer 6>

In an autoclave reaction vessel equipped with a thermometer and a stirrer, 480 parts of xylene and 240 parts of low molecular weight polyethylene (SANWAX 151P, product of Sanyo Chemical Industries, Ltd., a melting point: 108° C., a weight average molecular weight: 1,000) were placed such that the polyethylene was sufficiently dissolved into the xylene, and then the vessel was purged with nitrogen. Thereafter, in the autoclave reaction vessel a mixed solution of 750 parts of styrene, 57 parts of acrylonitrile, 53 parts of butyl acrylate, 26 parts of di-t-butyl peroxide, and 100 parts of xylene was added dropwise at 170° C. for 3 hours to effect polymerization, followed by maintaining the mixture at 170° C. for 30 min. Subsequently, the solvent was removed from the obtained product, to thereby obtain Graft-Modified Polymer 6.

In Graft-Modified Polymer 6, the acrylic resin had a weight average molecular weight of 16,000.

Graft-Modified Polymer 6 had a SP value of 10.1.

Graft-Modified Polymer 6 had a weight average molecular weight (Mw) of 18,000, a number average molecular weight (Mn) of 3,000, and a glass transition temperature (Tg) of 58° C.

Production Example 3-7

<Synthesis of Graft-Modified Polymer 7>

In an autoclave reaction vessel equipped with a thermometer and a stirrer, 480 parts of xylene and 30 parts of low molecular weight polyethylene (SANWAX 151P, product of Sanyo Chemical Industries, Ltd., a melting point: 108° C., a weight average molecular weight: 1,000) were placed such that the polyethylene was sufficiently dissolved into the xylene, and then the vessel was purged with nitrogen. Thereafter, in the autoclave reaction vessel a mixed solution of 880 parts of styrene, 45 parts of acrylonitrile, 45 parts of butyl acrylate, 26 parts of di-t-butyl peroxide, and 100 parts of xylene was added dropwise at 170° C. for 3 hours to effect polymerization, followed by maintaining the mixture at 170° C. for 30 min. Subsequently, the solvent was removed from the obtained product, to thereby obtain Graft-Modified Polymer 7.

In Graft-Modified Polymer 7, the acrylic resin had a weight average molecular weight of 16,000.

Graft-Modified Polymer 7 had a SP value of 10.5.

Graft-Modified Polymer 7 had a weight average molecular weight (Mw) of 16,000, a number average molecular weight (Mn) of 4,000, and a glass transition temperature (Tg) of 69° C.

Production Example 3-8

<Synthesis of Graft-Modified Polymer 8>

In an autoclave reaction vessel equipped with a thermometer and a stirrer, 480 parts of xylene and 260 parts of low molecular weight polyethylene (SANWAX 151P, product of Sanyo Chemical Industries, Ltd., a melting point: 108° C., a weight average molecular weight: 1,000) were placed such that the polyethylene was sufficiently dissolved into the xylene, and then the vessel was purged with nitrogen. Thereafter, in the autoclave reaction vessel a mixed solution of 640 parts of styrene, 52 parts of acrylonitrile, 48 parts of butyl acrylate, 26 parts of di-t-butyl peroxide, and 100 parts of xylene was added dropwise at 170° C. for 3 hours to effect polymerization, followed by maintaining the mixture at 170° C. for 30 min. Subsequently, the solvent was removed from the obtained product, to thereby obtain Graft-Modified Polymer 8.

In Graft-Modified Polymer 8, the acrylic resin had a weight average molecular weight of 16,000.

Graft-Modified Polymer 8 had a SP value of 10.1.

Graft-Modified Polymer 8 had a weight average molecular weight (Mw) of 18,000, a number average molecular weight (Mn) of 2,800, and a glass transition temperature (Tg) of 58° C.

Production Example 3-9

<Synthesis of Graft-Modified Polymer 9>

In an autoclave reaction vessel equipped with a thermometer and a stirrer, 480 parts of xylene and 10 parts of low molecular weight polyethylene (SANWAX 151P, product of Sanyo Chemical Industries, Ltd., a melting point: 108° C., a weight average molecular weight: 1,000) were placed such that the polyethylene was sufficiently dissolved into the xylene, and then the vessel was purged with nitrogen. Thereafter, in the autoclave reaction vessel a mixed solution of 890 parts of styrene, 52 parts of acrylonitrile, 48 parts of butyl acrylate, 26 parts of di-t-butyl peroxide, and 100 parts of xylene was added dropwise at 170° C. for 3 hours to effect polymerization, followed by maintaining the mixture at 170° C. for 30 min. Subsequently, the solvent was removed from the obtained product, to thereby obtain Graft-Modified Polymer 9.

In Graft-Modified Polymer 9, the acrylic resin had a weight average molecular weight of 16,000.

Graft-Modified Polymer 9 had a SP value of 10.5.

Graft-Modified Polymer 9 had a weight average molecular weight (Mw) of 17,000, a number average molecular weight (Mn) of 4,000, and a glass transition temperature (Tg) of 69° C.

Production Example 3-10

<Synthesis of Graft-Modified Polymer 10>

In an autoclave reaction vessel equipped with a thermometer and a stirrer, 480 parts of xylene and 100 parts of low molecular weight polyethylene (SANWAX 151P, product of Sanyo Chemical Industries, Ltd., a melting point: 108° C., a weight average molecular weight: 1,000) were placed such that the polyethylene was sufficiently dissolved into the xylene, and then the vessel was purged with nitrogen. Thereafter, in the autoclave reaction vessel a mixed solution of 805 parts of styrene, 50 parts of acrylonitrile, 45 parts of butyl acrylate, 56 parts of di-t-butyl peroxide, and 100 parts of xylene was added dropwise at 180° C. for 6 hours to effect polymerization, followed by maintaining the mixture at 180° C. for 60 min. Subsequently, the solvent was removed from the obtained product, to thereby obtain Graft-Modified Polymer 10.

In Graft-Modified Polymer 10, the acrylic resin had a weight average molecular weight of 95,000.

Graft-Modified Polymer 10 had a SP value of 10.4.

Graft-Modified Polymer 10 had a weight average molecular weight (Mw) of 97,000, a number average molecular weight (Mn) of 15,000, and a glass transition temperature (Tg) of 68° C.

Production Example 3-11

<Synthesis of Graft-Modified Polymer 11>

In an autoclave reaction vessel equipped with a thermometer and a stirrer, 480 parts of xylene and 100 parts of low molecular weight polyethylene (SANWAX 151P, product of Sanyo Chemical Industries, Ltd., a melting point: 108° C., a weight average molecular weight: 1,000) were placed such that the polyethylene was sufficiently dissolved into the xylene, and then the vessel was purged with nitrogen. Thereafter, in the autoclave reaction vessel a mixed solution of 805 parts of styrene, 50 parts of acrylonitrile, 45 parts of butyl acrylate, 26 parts of di-t-butyl peroxide, and 100 parts of xylene was added dropwise at 160° C. for 2 hours to effect polymerization, followed by maintaining the mixture at 160° C. for 30 min. Subsequently, the solvent was removed from the obtained product, to thereby obtain Graft-Modified Polymer 11.

In Graft-Modified Polymer 11, the acrylic resin had a weight average molecular weight of 5,000.

Graft-Modified Polymer 11 had a SP value of 10.4.

Graft-Modified Polymer 11 had a weight average molecular weight (Mw) of 6,000, a number average molecular weight (Mn) of 2,000, and a glass transition temperature (Tg) of 62° C.

Production Example 3-12

<Synthesis of Graft-Modified Polymer 12>

In an autoclave reaction vessel equipped with a thermometer and a stirrer, 480 parts of xylene and 100 parts of low molecular weight polyethylene (SANWAX 151P, product of Sanyo Chemical Industries, Ltd., a melting point: 108° C., a weight average molecular weight: 1,000) were placed such that the polyethylene was sufficiently dissolved into the xylene, and then the vessel was purged with nitrogen. Thereafter, in the autoclave reaction vessel a mixed solution of 805 parts of styrene, 50 parts of acrylonitrile, 45 parts of butyl acrylate, 62 parts of di-t-butyl peroxide, and 100 parts of xylene was added dropwise at 180° C. for 7 hours to effect polymerization, followed by maintaining the mixture at 180° C. for 60 min. Subsequently, the solvent was removed from the obtained product, to thereby obtain Graft-Modified Polymer 12.

In Graft-Modified Polymer 12, the acrylic resin had a weight average molecular weight of 105,000.

Graft-Modified Polymer 12 had a SP value of 10.4.

Graft-Modified Polymer 12 had a weight average molecular weight (Mw) of 107,000, a number average molecular weight (Mn) of 17,000, and a glass transition temperature (Tg) of 70° C.

Production Example 3-13

<Synthesis of Graft-Modified Polymer 13>

In an autoclave reaction vessel equipped with a thermometer and a stirrer, 480 parts of xylene and 100 parts of low molecular weight polyethylene (SANWAX 151P, product of Sanyo Chemical Industries, Ltd., a melting point: 108° C., a weight average molecular weight: 1,000) were placed such that the polyethylene was sufficiently dissolved into the xylene, and then the vessel was purged with nitrogen. Thereafter, in the autoclave reaction vessel a mixed solution of 805 parts of styrene, 50 parts of acrylonitrile, 45 parts of butyl acrylate, 24 parts of di-t-butyl peroxide, and 100 parts of xylene was added dropwise at 160° C. for 2 hours to effect polymerization, followed by maintaining the mixture at 160° C. for 20 min. Subsequently, the solvent was removed from the obtained product, to thereby obtain Graft-Modified Polymer 13.

In Graft-Modified Polymer 13, the acrylic resin had a weight average molecular weight of 4,000.

Graft-Modified Polymer 13 had a SP value of 10.4.

Graft-Modified Polymer 13 had a weight average molecular weight (Mw) of 5,000, a number average molecular weight (Mn) of 18,000, and a glass transition temperature (Tg) of 62° C.

Production Example 3-14

<Synthesis of Graft-Modified Polymer 14>

In an autoclave reaction vessel equipped with a thermometer and a stirrer, 480 parts of xylene and 320 parts of low molecular weight polyethylene (SANWAX 151P, product of Sanyo Chemical Industries, Ltd., a melting point: 108° C., a weight average molecular weight: 1,000) were placed such that the polyethylene was sufficiently dissolved into the xylene, and then the vessel was purged with nitrogen. Thereafter, in the autoclave reaction vessel a mixed solution of 680 parts of styrene, 52 parts of acrylonitrile, 48 parts of butyl acrylate, 26 parts of di-t-butyl peroxide, and 100 parts of xylene was added dropwise at 170° C. for 3 hours to effect polymerization, followed by maintaining the mixture at 170° C. for 30 min. Subsequently, the solvent was removed from the obtained product, to thereby obtain Graft-Modified Polymer 14.

In Graft-Modified Polymer 14, the acrylic resin had a weight average molecular weight of 16,000.

Graft-Modified Polymer 14 had a SP value of 10.0.

Graft-Modified Polymer 14 had a weight average molecular weight (Mw) of 18,000, a number average molecular weight (Mn) of 3,000, and a glass transition temperature (Tg) of 56° C.

Production Example 3-15

<Synthesis of Graft-Modified Polymer 15>

In an autoclave reaction vessel equipped with a thermometer and a stirrer, 200 parts of xylene, 160 parts of low molecular weight polypropylene (VISCOL 440P, product of Sanyo Chemical Industries, Ltd., a melting point: 153° C.) and 40 parts of low molecular weight polyethylene (LEL-400, product of Sanyo Chemical Industries, Ltd., a melting point: 128° C.) were placed such that the polypropylene and polyethylene were uniformly dissolved into the xylene, and then the vessel was purged with nitrogen, followed by raising the temperature to 175° C. Thereafter, in the autoclave reaction vessel a mixed solution of 660 parts of styrene, 60 parts of acrylonitrile, 80 parts of monobutyl maleate, 26 parts of di-t-butyl peroxyhexahydroterephthalate, and 152 parts of xylene was added dropwise at 175° C. for 3 hours to effect polymerization, followed by stirring the mixture at 175° C. for 30 min. Subsequently, the solvent was removed from the obtained product, to thereby obtain Graft-Modified Polymer 15.

In Graft-Modified Polymer 15, the acrylic resin had a weight average molecular weight of 10,000.

Graft-Modified Polymer 15 had a SP value of 11.0.

Graft-Modified Polymer 15 had a weight average molecular weight (Mw) of 10,900, a number average molecular weight (Mn) of 3,000, and a glass transition temperature (Tg) of 84° C.

The characteristic values of the graft-modified polymers are shown in Table 3.

TABLE 3

| | Graft-modified polymer | Hydrocarbon wax/ crystalline polyester resin Amount (parts by mass) | Weight average molecular weight | Weight average molecular weight of acrylic resin | SP value | Mw | Mn | Mw/Mn | Tg (° C.) |
|---|---|---|---|---|---|---|---|---|---|
| Production Example 3-1 | 1 | 10 | 1,000 | 16,000 | 10.4 | 18,000 | 3,300 | 5.5 | 65 |
| Production Example 3-2 | 2 | 10 | 15,000 | 15,000 | 10.5 | 19,000 | 3,600 | 5.3 | 63 |
| Production Example 3-3 | 3 | 20 | 15,000 | — | 10.6 | 12,000 | 2,000 | 6.0 | 49 |
| Production Example 3-4 | 4 | 89 | 1,000 | 15,000 | 9.7 | 6,500 | 1,200 | 5.4 | 82 |
| Production Example 3-5 | 5 | 10 | 5,500 | — | 11.0 | 7,000 | 1,500 | 4.7 | 48 |
| Production Example 3-6 | 6 | 22 | 1,000 | 16,000 | 10.1 | 18,000 | 3,000 | 6.0 | 58 |
| Production Example 3-7 | 7 | 3 | 1,000 | 16,000 | 10.5 | 16,000 | 4,000 | 4.0 | 69 |
| Production Example 3-8 | 8 | 26 | 1,000 | 16,000 | 10.1 | 18,000 | 2,800 | 6.4 | 58 |
| Production Example 3-9 | 9 | 1 | 1,000 | 16,000 | 10.5 | 17,000 | 4,000 | 4.3 | 69 |
| Production Example 3-10 | 10 | 10 | 1,000 | 95,000 | 10.4 | 97,000 | 15,000 | 6.5 | 68 |
| Production Example 3-11 | 11 | 10 | 1,000 | 5,000 | 10.4 | 6,000 | 2,000 | 3.0 | 62 |
| Production Example 3-12 | 12 | 10 | 1,000 | 105,000 | 10.4 | 107,000 | 17,000 | 6.3 | 70 |
| Production Example 3-13 | 13 | 10 | 1,000 | 4,000 | 10.4 | 5000 | 1,800 | 2.8 | 62 |
| Production Example 3-14 | 14 | 29 | 1,000 | 16,000 | 10.0 | 18,000 | 3,000 | 6.0 | 56 |
| Production Example 3-15 | 15 | 20 | 1,000 | 10,000 | 11.0 | 10,900 | 3,000 | 3.6 | 84 |

Note that the amounts of the hydrocarbon wax and the amount of the crystalline polyester resin respectively denote the amounts of a hydrocarbon wax moiety, and the amount of a crystalline polyester resin moiety in the graft-modified polymer, with respect of 100 parts of graft-modified polymer.

Production Example 4-1

<Preparation of Crystalline Polyester Resin Dispersion Liquid 1>

Into a 2 L-metallic container, 100 parts of Crystalline Polyester Resin 1 and 200 parts of ethyl acetate were placed, and heated at 75° C. such that Crystalline Polyester Resin 1 was dissolved into the ethyl acetate, and followed by rapidly cooling the mixture in an ice-water bath at 27° C./min. To the reaction mixture 500 mL of glass beads each having a diameter of 3 mm were added, and the mixture was pulverized with a batch-type sand mill device (product of Kanpe Hapio Co., Ltd.) for 10 hours, to thereby produce Crystalline Polyester Resin Dispersion Liquid 1.

Production Example 4-2

<Preparation of Crystalline Polyester Resin Dispersion Liquid 2>

Crystalline Polyester Resin Dispersion Liquid 2 was prepared in the same manner as in Production Example 4-1, except that Crystalline Polyester Resin 1 was replaced with Crystalline Polyester Resin 2.

Production Example 4-3

<Preparation of Crystalline Polyester Resin Dispersion Liquid 3>

Crystalline Polyester Resin Dispersion Liquid 3 was prepared in the same manner as in Production Example 4-1, except that Crystalline Polyester Resin 1 was replaced with Crystalline Polyester Resin 3.

Production Example 4-4

<Preparation of Crystalline Polyester Resin Dispersion Liquid 4>

Crystalline Polyester Resin Dispersion Liquid 4 was prepared in the same manner as in Production Example 4-1, except that Crystalline Polyester Resin 1 was replaced with Crystalline Polyester Resin 4.

Production Example 4-5

<Preparation of Crystalline Polyester Resin Dispersion Liquid 5>

Crystalline Polyester Resin Dispersion Liquid 5 was prepared in the same manner as in Production Example 4-1, except that Crystalline Polyester Resin 1 was replaced with Crystalline Polyester Resin 5.

Production Example 4-6

<Preparation of Crystalline Polyester Resin Dispersion Liquid 6>

Crystalline Polyester Resin Dispersion Liquid 6 was prepared in the same manner as in Production Example 4-1, except that Crystalline Polyester Resin 1 was replaced with Crystalline Polyester Resin 6.

Example 1

<Preparation of Toner 1>

—Preparation of Oil Phase—

—Synthesis of Prepolymer—

A reaction container equipped with a condenser, a stirrer and a nitrogen-introducing tube was charged with 682 parts of bisphenol A ethylene oxide 2 mole adduct, 81 parts of bisphenol A propylene oxide 2 mole adduct, 283 parts of terephthalic acid, 22 parts of trimellitic anhydride and 2 parts of dibutyl tin oxide. The resultant mixture was allowed to react under normal pressure at 230° C. for 8 hours and further react at a reduced pressure of 10 mmHg to 15 mmHg for 5 hours, to thereby produce Intermediate Polyester 1. The Intermediate Polyester 1 had a number average molecular weight of 2,100, a weight average molecular weight of 9,500, a glass transition temperature (Tg) of 55° C., an acid value of 0.5 mgKOH/g and a hydroxyl value of 51 mgKOH/g.

Next, a reaction container equipped with a condenser, a stirrer and a nitrogen-introducing tube was charged with 410 parts of Intermediate Polyester 1, 89 parts of isophorone diisocyanate and 500 parts of ethyl acetate, followed by reaction at 100° C. for 5 hours, to thereby produce Prepolymer 1. The amount of free isocyanate contained in Prepolymer 1 was 1.53% by mass.

—Synthesis of Ketimine—

A reaction container equipped with a stirring rod and a thermometer was charged with 170 parts of isophorone diisocyanate and 75 parts of methyl ethyl ketone, followed by reaction at 50° C. for 5 hours, to thereby produce Ketimine Compound 1. Ketimine Compound 1 had an amine value of 418.

—Synthesis of Masterbatch (MB)—

Water (1,200 parts), 540 parts of carbon black (Printex35, product of Degussa) [DBP oil absorption amount=42 mL/100 mg, pH=9.5] and 1,200 parts of Non-Crystalline Polyester Resin 1 were mixed together with HENSCHEL MIXER (product of Mitsui Mining Co., Ltd). The resultant mixture was kneaded at 150° C. for 30 minutes with a two-roller mill, and then rolled, cooled and pulverized with a pulverizer, to thereby produce Masterbatch 1.

—Preparation of Pigment-Wax Dispersion Liquid—

A container equipped with a stirring rod and a thermometer was charged with 378 parts of Non-Crystalline Polyester Resin 1, 50 parts of paraffin wax as Releasing Agent 1 (product of Nippon Seiro Co., Ltd., HNP-9, hydrocarbon wax, a melting point: 75° C., a SP value: 8.8) and 20 parts of Graft-Modified Polymer 1, 22 parts of CCA (salycilic acid metal complex E-84: product of Orient Chemical Industries, Ltd.) and 947 parts of ethyl acetate, and the mixture was heated to 80° C. with stirring. The resultant mixture was maintained at 80° C. for 5 hours and then cooled to 30° C. for 1 hour. Subsequently, 500 parts of Masterbatch 1 and 500 parts of ethyl acetate were charged into the container, followed by mixing for 1 hour, to thereby prepare Raw Material Solution 1.

Raw Material Solution 1 (1,324 parts) was placed in a container, and dispersed with a bead mill ("ULTRA VISCOMILL," product of AIMEX CO., Ltd.) under the following conditions: a liquid feed rate of 1 kg/hr, disc circumferential velocity of 6 m/s, 0.5 mm-zirconia beads packed to 80% by volume, and 3 passes. Next, 1,042.3 parts of a 65% by mass ethyl acetate solution of Non-Crystalline Polyester Resin 1 was added thereto, and passed once with the bead mill under the above conditions, to thereby obtain Pigment-Wax Dispersion Liquid 1. Pigment-Wax Dispersion Liquid 1 had a solid content concentration of 50% by mass (130° C., 30 minutes).

—Preparation of Oil Phase—

A container was charged with 664 parts of Pigment-Wax Dispersion Liquid 1, 109.4 parts of Prepolymer 1, 73.9 parts of Crystalline Polyester Resin dispersion liquid 1, and 4.6 parts of Ketimine Compound 1, and the mixture was mixed at 5,000 rpm for 1 min with TK HOMOMIXER (produced by PRIMIX Corporation), to thereby obtain Oil Phase 1.

—Synthesis of Organic Fine Particle Emulsion (Fine Particle Dispersion Liquid)—

A reaction container equipped with a stirring rod and a thermometer was charged with 683 parts of water, 11 parts of a sodium salt of sulfuric acid ester of methacrylic acid-ethylene oxide adduct (ELEMINOL RS-30: product of Sanyo Chemical Industries, Ltd.), 138 parts of styrene, 138 parts of methacrylic acid and 1 part of ammonium persulfate, and the resultant mixture was stirred at 400 rpm for 15 min to prepare a white emulsion. The thus-obtained emulsion was heated to 75° C. and allowed to react for 5 hours. Subsequently, 30 parts of a 1% by mass aqueous ammonium persulfate solution was added to the reaction mixture, followed by aging at 75° C. for 5 hours, to thereby prepare an aqueous dispersion liquid, i.e., Fine Particle Dispersion Liquid 1 of a vinyl resin (a copolymer of styrene/methacrylic acid/sodium salt of sulfuric acid ester of methacrylic acid ethylene oxide adduct). The thus-prepared Fine Particle Dispersion Liquid 1 had a volume average particle diameter of 0.14 μm as measured with LA-920 (product of Horiba, Ltd.). Part of Fine Particle Dispersion Liquid 1 was dried to separate a resin.

—Preparation of Aqueous Phase—

Water (990 parts), 83 parts of Fine Particle Dispersion Liquid 1, 37 parts of a 48.5% aqueous solution of sodium dodecyldiphenyl ether disulfonate (ELEMINOL MON-7, product of Sanyo Chemical Industries Ltd.) and 90 parts of ethyl acetate were mixed together and stirred to obtain an opaque white liquid, which was used as Aqueous Phase 1.

—Emulsification/Desolventation—

Into a container, Oil Phase 1 was charged, 1,200 parts of Aqueous Phase 1 was added thereto, and the resultant mixture was mixed with a TK homomixer at 13,000 rpm for 20 minutes, to thereby produce Emulsified Slurry 1.

A container equipped with a stirrer and a thermometer was charged with Emulsified Slurry 1, followed by removing a solvent (desolventation) at 30° C. for 8 hours and aging at 45° C. for 4 hours, to thereby produce Dispersion Slurry 1.

—Washing/Drying—

Dispersion Slurry 1 (100 parts) was filtrated under reduced pressure and then subjected twice to a series of treatments (1) to (4) described below, to thereby produce Filtration Cake 1:

(1): 100 parts of ion-exchanged water was added to the filtration cake, followed by mixing with a TK homomixer (at 12,000 rpm for 10 minutes) and then filtration;

(2): 100 parts of 10% aqueous sodium hydroxide solution was added to the filtration cake obtained in (1), followed by mixing with the TK homomixer (at 12,000 rpm for 30 minutes) and then filtration under reduced pressure;

(3): 100 parts of 10% by mass hydrochloric acid was added to the filtration cake obtained in (2), followed by mixing with the TK homomixer (at 12,000 rpm for 10 minutes) and then filtration; and (4): 300 parts of ion-exchanged water was added to the filtration cake obtained in (3), followed by mixing with the TK homomixer (at 12,000 rpm for 10 minutes) and then filtration.

Filtration Cake 1 was dried with an air-circulating drier at 45° C. for 48 hours, and then sieved with a mesh having an aperture of 75 μm, to thereby produce Toner 1.

The volume average particle diameter of the obtained toner, the glass transition temperature measured at the first temperature rise in DSC measurement of the toner (i.e., Tg1st), and the glass transition temperature measured at the second temperature rise in DSC measurement of the toner (i.e., Tg2nd) are shown in Tables 4-1 and 4-2.

In the toner, the amount of the crystalline polyester resin (W2), the amount of the releasing agent (W3), and the amount of the graft-modified polymer (W4), with respect to 100 parts of the toner (W1=100) are shown in Tables 4-1 and 4-2.

<Evaluation>

A developer was produced using the obtained toner in the following manner, and evaluated as described below. The results are shown in Tables 5-1 and 5-2.

<<Production of Developer>>

—Production of Carrier—

A silicone resin (organo straight silicone) (100 parts), 5 parts of γ-(2-aminoethyl)aminopropyltrimethoxysilane and 10 parts of carbon black were added to 100 parts of toluene, and the resultant mixture was dispersed with a homomixer for 20 min, to thereby prepare a resin layer coating liquid. Subsequently, using a fluid bed coater, the resin layer coating liquid was applied on the surfaces of spherical magnetite particles (1,000 parts) having an average particle diameter of 50 μm, to thereby prepare a carrier.

—Production of Developer—

Using a ball mill, 5 parts of the obtained Toner 1 and 95 parts of the above-prepared carrier were mixed with each other to produce a developer.

<<Low Temperature Fixing Ability and High Temperature Offset Resistance>>

The fixing portion of the copier MF-2200 (product of Ricoh Company, Ltd.) employing a TEFLON roller as a fixing roller was modified to produce a modified copier. The above-produced developer and Type 6200 paper sheets (product of Ricoh Company, Ltd.) were set in the modified copier for printing test.

Specifically, the cold offset temperature (minimum fixing temperature) and the hot offset temperature (maximum fixing temperature) were determined while changing the fixing temperature.

The evaluation conditions for the minimum fixing temperature were set as follows: linear velocity of paper feeding: 120 mm/sec to 150 mm/sec, surface pressure: 1.2 kgf/cm$^2$ and nip width: 3 mm.

The evaluation conditions for the maximum fixing temperature were set as follows: linear velocity of paper feeding: 50 mm/sec, surface pressure: 2.0 kgf/cm$^2$ and nip width: 4.5 mm.

<<Heat Resistant Storage Stability>>

The toner was stored at 50° C. for 8 hours, and then sieved with a 42-mesh sieve for 2 min. The residual toner ratio was measured. Here, the better the heat resistant storage stability of the toner had, the lower the residual toner ratio was.

The heat resistant storage stability was evaluated according to the following criteria.

A: Residual toner ratio<10%

B: 10% ≦residual toner ratio<20%

C: 20% ≦residual toner ratio<30%

D: 30% ≦residual toner ratio<

<<Fogging>>

Using the tandem-type color electrophotographic apparatus IMAGIO NEO 450 (product of Ricoh Company, Ltd.) having a cleaning blade and a charging roller each being provided so as to be in contact with a photoconductor, 10,000 copies of a laterally-set A4 chart (image pattern A) having a pattern formed by alternatingly repeating a 1 cm black solid portion and 1 cm white solid portion in a direction perpendicular to the rotating direction of the developing sleeve were printed out. Thereafter, a blank image was printed out, and the printed image was visually evaluated for fogging according to the following criteria.

<Evaluation Criteria>

A: No fogging was observed.

B: Fogging was observed to such an extent that it involved no problems in practical use.

C: Fogging was observed to such an extent that it could involve problems in practical use.

D: Fogging was observed to such an extent that it involved great problems in practical use.

<<Filming>>

Printing of 10,000 images was performed using an image forming apparatus MF2800 (product of Ricoh Company, Ltd.), and then a photoconductor was visually observed and evaluated for adhesion of toner components, particularly a releasing agent, onto the photoconductor.

The evaluation was based on the following criteria.

A: No adhesion of the toner component onto the photoconductor was observed.

B: Adhesion of the toner component onto the photoconductor was observed to such an extent that it did not involve problems in practical use.

C: Adhesion of the toner component onto the photoconductor was observed to such an extent that it involved problems in practical use.

D: Adhesion of the toner component onto the photoconductor was observed to such an extent that it involved great problems in practical use.

Example 2

<Preparation of Toner 2>

Toner 2 was produced in the same manner as in Example 1, except that Non-Crystalline Polyester Resin 1 was replaced with Non-Crystalline Polyester Resin 2.

The volume average particle diameter of the obtained toner, the glass transition temperature measured at the first temperature rise in DSC measurement of the toner (i.e., Tg1st), and the glass transition temperature measured at the second temperature rise in DSC measurement of the toner (i.e., Tg2nd) are shown in Tables 4-1 and 4-2.

In the toner, the amount of the crystalline polyester resin (W2), the amount of the releasing agent (W3), and the amount of the graft-modified polymer (W4), with respect to 100 parts of the toner (W1=100) are shown in Tables 4-1 and 4-2.

The SP value of each component in the toner and relations of the SP values are shown in Tables 5-1 and 5-2.

The obtained toner was evaluated in the same manner as in Example 1. The results are shown in Table 6.

Example 3

<Preparation of Toner 3>

Toner 3 was produced in the same manner as in Example 1, except that Graft-Modified Polymer 1 was replaced with Graft-Modified Polymer 2.

The volume average particle diameter of the obtained toner, the glass transition temperature measured at the first temperature rise in DSC measurement of the toner (i.e., Tg1st), and the glass transition temperature measured at the second temperature rise in DSC measurement of the toner (i.e., Tg2nd) are shown in Tables 4-1 and 4-2.

In the toner, the amount of the crystalline polyester resin (W2), the amount of the releasing agent (W3), and the amount of the graft-modified polymer (W4), with respect to 100 parts of the toner (W1=100) are shown in Tables 4-1 and 4-2.

The SP value of each component in the toner and relations of the SP values are shown in Tables 5-1 and 5-2.

The obtained toner was evaluated in the same manner as in Example 1. The results are shown in Table 6.

Example 4

<Preparation of Toner 4>

Toner 4 was produced in the same manner as in Example 1, except that Crystalline Polyester Resin Dispersion Liquid 1 was replaced with Crystalline Polyester Resin Dispersion Liquid 2.

The volume average particle diameter of the obtained toner, the glass transition temperature measured at the first temperature rise in DSC measurement of the toner (i.e., Tg1st), and the glass transition temperature measured at the second temperature rise in DSC measurement of the toner (i.e., Tg2nd) are shown in Tables 4-1 and 4-2.

In the toner, the amount of the crystalline polyester resin (W2), the amount of the releasing agent (W3), and the amount of the graft-modified polymer (W4), with respect to 100 parts of the toner (W1=100) are shown in Tables 4-1 and 4-2.

The SP value of each component in the toner and relations of the SP values are shown in Tables 5-1 and 5-2.

The obtained toner was evaluated in the same manner as in Example 1. The results are shown in Table 6.

Example 5

<Preparation of Toner 5>

Toner 5 was produced in the same manner as in Example 1, except that Releasing Agent 1 was replaced with carnauba wax (Releasing Agent 2, WA-05, product of TOA KASEI CO., LTD., a melting point: 86° C., a SP value 9.3)

The volume average particle diameter of the obtained toner, the glass transition temperature measured at the first temperature rise in DSC measurement of the toner (i.e., Tg1st), and the glass transition temperature measured at the second temperature rise in DSC measurement of the toner (i.e., Tg2nd) are shown in Tables 4-1 and 4-2.

In the toner, the amount of the crystalline polyester resin (W2), the amount of the releasing agent (W3), and the amount of the graft-modified polymer (W4), with respect to 100 parts of the toner (W1=100) are shown in Tables 4-1 and 4-2.

The SP value of each component in the toner and relations of the SP values are shown in Tables 5-1 and 5-2.

The obtained toner was evaluated in the same manner as in Example 1. The results are shown in Table 6.

Example 6

<Preparation of Toner 6>

Toner 6 was produced in the following manner.

| Composition of Toner 6 | |
|---|---|
| Crystalline Polyester Resin 1 | 6 parts |
| Non-Crystalline Polyester Resin 3 | 80 parts |
| Graft-Modified Polymer 1 | 1.6 parts |
| Colorant: carbon black C-44 (product of Mitsubishi Chemical Corporation, an average particle size: 24 nm, a BET specific surface area: 125 $m^2/g$) | 7.4 parts |

-continued

| Composition of Toner 6 | |
|---|---|
| CCA: BONTRON E-84 (product of ORIENT CHEMICAL INDUSTRIES CO., LTD) | 1 part |
| Releasing Agent 1: HNP-9 (product of Nippon Seiro Co., Ltd., hydrocarbon wax, a melting point: 75° C., a SP value: 8.8) | 4 parts |

These compositions were sufficiently mixed with SUPER-MIXER (SMV-200, product of KAWATA MFG Co., Ltd.), to obtain a toner material powder mixture. The toner material powder mixture was fed to a material feeding hopper of a BUSS Cokneader (TCS-100, product of BUSS), and mixed and kneaded at a feed rate of 120 kg/h.

The obtained kneaded product was rolled and cooled with a double-belt cooler, coarsely pulverized with a hammer mill, and then finely pulverized with a jet stream pulverizer (I-20 jet mill, product of Nippon Pneumatic Mfg. Co., Ltd.), followed by classifying fine particles with a wind power classifier (DS-20, DS-10 classifier, product of Nippon Pneumatic Mfg. Co., Ltd.). Thereafter, the obtained product was left to stand at 50° C. for 24 hours so as to perform annealing.

To 100 parts of the thus-obtained toner base, 0.7 parts of hydrophobic silica and 0.3 parts of hydrophobized titanium oxide were added and mixed with HENSCHEL MIXER, to obtain Toner 6.

The volume average particle diameter of the obtained toner, the glass transition temperature measured at the first temperature rise in DSC measurement of the toner (i.e., Tg1st), and the glass transition temperature measured at the second temperature rise in DSC measurement of the toner (i.e., Tg2nd) are shown in Tables 4-1 and 4-2.

In the toner, the amount of the crystalline polyester resin (W2), the amount of the releasing agent (W3), and the amount of the graft-modified polymer (W4), with respect to 100 parts of the toner (W1=100) are shown in Tables 4-1 and 4-2.

The SP value of each component in the toner and relations of the SP values are shown in Tables 5-1 and 5-2.

The obtained toner was evaluated in the same manner as in Example 1. The results are shown in Table 6.

Example 7

<Preparation of Toner 7>

Toner 7 was produced in the same manner as in Example 1, except that Graft-Modified Polymer 1 was replaced with Graft-Modified Polymer 6.

The volume average particle diameter of the obtained toner, the glass transition temperature measured at the first temperature rise in DSC measurement of the toner (i.e., Tg1st), and the glass transition temperature measured at the second temperature rise in DSC measurement of the toner (i.e., Tg2nd) are shown in Tables 4-1 and 4-2.

In the toner, the amount of the crystalline polyester resin (W2), the amount of the releasing agent (W3), and the amount of the graft-modified polymer (W4), with respect to 100 parts of the toner (W1=100) are shown in Tables 4-1 and 4-2.

The SP value of each component in the toner and relations of the SP values are shown in Tables 5-1 and 5-2.

The obtained toner was evaluated in the same manner as in Example 1. The results are shown in Table 6.

Example 8

<Preparation of Toner 8>

Toner 8 was produced in the same manner as in Example 1, except that Graft-Modified Polymer 1 was replaced with Graft-Modified Polymer 7.

The volume average particle diameter of the obtained toner, the glass transition temperature measured at the first temperature rise in DSC measurement of the toner (i.e., Tg1st), and the glass transition temperature measured at the second temperature rise in DSC measurement of the toner (i.e., Tg2nd) are shown in Tables 4-1 and 4-2.

In the toner, the amount of the crystalline polyester resin (W2), the amount of the releasing agent (W3), and the amount of the graft-modified polymer (W4), with respect to 100 parts of the toner (W1=100) are shown in Tables 4-1 and 4-2.

The SP value of each component in the toner and relations of the SP values are shown in Tables 5-1 and 5-2.

The obtained toner was evaluated in the same manner as in Example 1. The results are shown in Table 6.

Example 9

<Preparation of Toner 9>

Toner 9 was produced in the same manner as in Example 1, except that Graft-Modified Polymer 1 was replaced with Graft-Modified Polymer 8.

The volume average particle diameter of the obtained toner, the glass transition temperature measured at the first temperature rise in DSC measurement of the toner (i.e., Tg1st), and the glass transition temperature measured at the second temperature rise in DSC measurement of the toner (i.e., Tg2nd) are shown in Tables 4-1 and 4-2.

In the toner, the amount of the crystalline polyester resin (W2), the amount of the releasing agent (W3), and the amount of the graft-modified polymer (W4), with respect to 100 parts of the toner (W1=100) are shown in Tables 4-1 and 4-2.

The SP value of each component in the toner and relations of the SP values are shown in Tables 5-1 and 5-2.

The obtained toner was evaluated in the same manner as in Example 1. The results are shown in Table 6.

Example 10

<Preparation of Toner 10>

Toner 10 was produced in the same manner as in Example 1, except that Graft-Modified Polymer 1 was replaced with Graft-Modified Polymer 9.

The volume average particle diameter of the obtained toner, the glass transition temperature measured at the first temperature rise in DSC measurement of the toner (i.e., Tg1st), and the glass transition temperature measured at the second temperature rise in DSC measurement of the toner (i.e., Tg2nd) are shown in Tables 4-1 and 4-2.

In the toner, the amount of the crystalline polyester resin (W2), the amount of the releasing agent (W3), and the amount of the graft-modified polymer (W4), with respect to 100 parts of the toner (W1=100) are shown in Tables 4-1 and 4-2.

The SP value of each component in the toner and relations of the SP values are shown in Tables 5-1 and 5-2.

The obtained toner was evaluated in the same manner as in Example 1. The results are shown in Table 6.

Example 11

<Preparation of Toner 11>

Toner 11 was produced in the same manner as in Example 1, except that Graft-Modified Polymer 1 was replaced with Graft-Modified Polymer 10.

The volume average particle diameter of the obtained toner, the glass transition temperature measured at the first temperature rise in DSC measurement of the toner (i.e., Tg1st), and the glass transition temperature measured at the second temperature rise in DSC measurement of the toner (i.e., Tg2nd) are shown in Tables 4-1 and 4-2.

In the toner, the amount of the crystalline polyester resin (W2), the amount of the releasing agent (W3), and the amount of the graft-modified polymer (W4), with respect to 100 parts of the toner (W1=100) are shown in Tables 4-1 and 4-2.

The SP value of each component in the toner and relations of the SP values are shown in Tables 5-1 and 5-2. The obtained toner was evaluated in the same manner as in Example 1. The results are shown in Table 6.

Example 12

<Preparation of Toner 12>

Toner 12 was produced in the same manner as in Example 1, except that Graft-Modified Polymer 1 was replaced with Graft-Modified Polymer 11.

The volume average particle diameter of the obtained toner, the glass transition temperature measured at the first temperature rise in DSC measurement of the toner (i.e., Tg1st), and the glass transition temperature measured at the second temperature rise in DSC measurement of the toner (i.e., Tg2nd) are shown in Tables 4-1 and 4-2.

In the toner, the amount of the crystalline polyester resin (W2), the amount of the releasing agent (W3), and the amount of the graft-modified polymer (W4), with respect to 100 parts of the toner (W1=100) are shown in Tables 4-1 and 4-2.

The SP value of each component in the toner and relations of the SP values are shown in Tables 5-1 and 5-2.

The obtained toner was evaluated in the same manner as in Example 1. The results are shown in Table 6.

Example 13

<Preparation of Toner 13>

Toner 13 was produced in the same manner as in Example 1, except that Graft-Modified Polymer 1 was replaced with Graft-Modified Polymer 12.

The volume average particle diameter of the obtained toner, the glass transition temperature measured at the first temperature rise in DSC measurement of the toner (i.e., Tg1st), and the glass transition temperature measured at the second temperature rise in DSC measurement of the toner (i.e., Tg2nd) are shown in Tables 4-1 and 4-2.

In the toner, the amount of the crystalline polyester resin (W2), the amount of the releasing agent (W3), and the amount of the graft-modified polymer (W4), with respect to 100 parts of the toner (W1=100) are shown in Tables 4-1 and 4-2.

The SP value of each component in the toner and relations of the SP values are shown in Tables 5-1 and 5-2.

The obtained toner was evaluated in the same manner as in Example 1. The results are shown in Table 6.

Example 14

<Preparation of Toner 14>

Toner 14 was produced in the same manner as in Example 1, except that Graft-Modified Polymer 1 was replaced with Graft-Modified Polymer 13.

The volume average particle diameter of the obtained toner, the glass transition temperature measured at the first temperature rise in DSC measurement of the toner (i.e., Tg1st), and the glass transition temperature measured at the second temperature rise in DSC measurement of the toner (i.e., Tg2nd) are shown in Tables 4-1 and 4-2.

In the toner, the amount of the crystalline polyester resin (W2), the amount of the releasing agent (W3), and the amount of the graft-modified polymer (W4), with respect to 100 parts of the toner (W1=100) are shown in Tables 4-1 and 4-2.

The SP value of each component in the toner and relations of the SP values are shown in Tables 5-1 and 5-2.

The obtained toner was evaluated in the same manner as in Example 1. The results are shown in Table 6.

Example 15

<Preparation of Toner 15>

Toner 15 was produced in the same manner as in Example 1, except that Non-Crystalline Polyester Resin 1 was replaced with Non-Crystalline Polyester Resin 4, and that Graft-Modified Polymer 1 was replaced with Graft-Modified Polymer 6.

The volume average particle diameter of the obtained toner, the glass transition temperature measured at the first temperature rise in DSC measurement of the toner (i.e., Tg1st), and the glass transition temperature measured at the second temperature rise in DSC measurement of the toner (i.e., Tg2nd) are shown in Tables 4-1 and 4-2.

In the toner, the amount of the crystalline polyester resin (W2), the amount of the releasing agent (W3), and the amount of the graft-modified polymer (W4), with respect to 100 parts of the toner (W1=100) are shown in Tables 4-1 and 4-2.

The SP value of each component in the toner and relations of the SP values are shown in Tables 5-1 and 5-2.

The obtained toner was evaluated in the same manner as in Example 1. The results are shown in Table 6.

Example 16

<Preparation of Toner 16>

Toner 16 was produced in the same manner as in Example 1, except that Non-Crystalline Polyester Resin 1 was replaced with Non-Crystalline Polyester Resin 5.

The volume average particle diameter of the obtained toner, the glass transition temperature measured at the first temperature rise in DSC measurement of the toner (i.e., Tg1st), and the glass transition temperature measured at the second temperature rise in DSC measurement of the toner (i.e., Tg2nd) are shown in Tables 4-1 and 4-2.

In the toner, the amount of the crystalline polyester resin (W2), the amount of the releasing agent (W3), and the amount of the graft-modified polymer (W4), with respect to 100 parts of the toner (W1=100) are shown in Tables 4-1 and 4-2.

The SP value of each component in the toner and relations of the SP values are shown in Tables 5-1 and 5-2.

The obtained toner was evaluated in the same manner as in Example 1. The results are shown in Table 6.

Example 17

<Preparation of Toner 17>

Toner 17 was produced in the same manner as in Example 1, except that Crystalline Polyester Resin Dispersion Liquid 1 was replaced with Crystalline Polyester Resin Dispersion Liquid 3, and that Graft-Modified Polymer 1 was replaced with Graft-Modified Polymer 7.

The volume average particle diameter of the obtained toner, the glass transition temperature measured at the first temperature rise in DSC measurement of the toner (i.e., Tg1st), and the glass transition temperature measured at the second temperature rise in DSC measurement of the toner (i.e., Tg2nd) are shown in Tables 4-1 and 4-2.

In the toner, the amount of the crystalline polyester resin (W2), the amount of the releasing agent (W3), and the amount of the graft-modified polymer (W4), with respect to 100 parts of the toner (W1=100) are shown in Tables 4-1 and 4-2.

The SP value of each component in the toner and relations of the SP values are shown in Tables 5-1 and 5-2.

The obtained toner was evaluated in the same manner as in Example 1. The results are shown in Table 6.

Example 18

<Preparation of Toner 18>

Toner 18 was produced in the same manner as in Example 1, except that Crystalline Polyester Resin Dispersion Liquid 1 was replaced with Crystalline Polyester Resin Dispersion Liquid 2, and that Graft-Modified Polymer 1 was replaced with Graft-Modified Polymer 7.

The volume average particle diameter of the obtained toner, the glass transition temperature measured at the first temperature rise in DSC measurement of the toner (i.e., Tg1st), and the glass transition temperature measured at the second temperature rise in DSC measurement of the toner (i.e., Tg2nd) are shown in Tables 4-1 and 4-2.

In the toner, the amount of the crystalline polyester resin (W2), the amount of the releasing agent (W3), and the amount of the graft-modified polymer (W4), with respect to 100 parts of the toner (W1=100) are shown in Tables 4-1 and 4-2.

The SP value of each component in the toner and relations of the SP values are shown in Tables 5-1 and 5-2.

The obtained toner was evaluated in the same manner as in Example 1. The results are shown in Table 6.

Example 19

<Preparation of Toner 19>

Toner 19 was produced in the same manner as in Example 1, except that Non-Crystalline Polyester Resin 1 was replaced with Non-Crystalline Polyester Resin 5, and that Crystalline Polyester Resin Dispersion Liquid 1 was replaced with Crystalline Polyester Resin Dispersion Liquid 3.

The volume average particle diameter of the obtained toner, the glass transition temperature measured at the first temperature rise in DSC measurement of the toner (i.e., Tg 1st), and the glass transition temperature measured at the second temperature rise in DSC measurement of the toner (i.e., Tg2nd) are shown in Tables 4-1 and 4-2.

In the toner, the amount of the crystalline polyester resin (W2), the amount of the releasing agent (W3), and the amount of the graft-modified polymer (W4), with respect to 100 parts of the toner (W1=100) are shown in Tables 4-1 and 4-2.

The SP value of each component in the toner and relations of the SP values are shown in Tables 5-1 and 5-2.

The obtained toner was evaluated in the same manner as in Example 1. The results are shown in Table 6.

Example 20

Toner 20 was produced by a dissolution suspension method, without using prepolymer.

—Preparation of Oil Phase—

—Synthesis of Masterbatch (MB)—

Water (1,200 parts), 540 parts of carbon black (Printex35, product of Degussa) [DBP oil absorption amount=42 mL/100 mg, pH=9.5] and 1,200 parts of Non-Crystalline Polyester Resin 3 were mixed together with HENSCHEL MIXER (product of Mitsui Mining Co., Ltd). The resultant mixture was kneaded at 150° C. for 30 minutes with a two-roller mill, and then rolled, cooled and pulverized with a pulverizer, to thereby produce Masterbatch 2.

—Preparation of Pigment-Wax Dispersion Liquid—

A container equipped with a stirring rod and a thermometer was charged with 378 parts of Non-Crystalline Polyester Resin 3, 50 parts of paraffin wax as Releasing Agent 1 (HNP-9, product of Nippon Seiro Co., Ltd., hydrocarbon wax, a melting point: 75° C., a SP value: 8.8) and 20 parts of Graft-Modified Polymer 1, 22 parts of CCA (salycilic acid metal complex E-84: product of Orient Chemical Industries, Ltd.) and 947 parts of ethyl acetate, and the mixture was heated to 80° C. with stirring. The resultant mixture was maintained at 80° C. for 5 hours and then cooled to 30° C. for 1 hour. Subsequently, 500 parts of Masterbatch 2 and 500 parts of ethyl acetate were charged into the container, followed by mixing for 1 hour, to thereby prepare Raw Material Solution 2.

Raw Material Solution 2 (1,324 parts) was placed in a container, and dispersed with a bead mill ("ULTRA VISCOMILL," product of AIMEX CO., Ltd.) under the following conditions: a liquid feed rate of 1 kg/hr, disc circumferential velocity of 6 m/s, 0.5 mm-zirconia beads packed to 80% by volume, and 3 passes. Next, 1,042.3 parts of a 65% by mass ethyl acetate solution of Non-Crystalline Polyester Resin 3 was added thereto, and passed once with the bead mill under the above conditions, to thereby obtain Pigment-Wax Dispersion Liquid 2. Pigment-Wax Dispersion Liquid 2 had a solid content concentration of 50% by mass (130° C., 30 minutes).

—Preparation of Oil Phase—

A container was charged with 773 parts of Pigment-Wax Dispersion Liquid 2, and 73.9 parts of Crystalline Polyester Resin Dispersion Liquid 1, and the mixture was mixed at 6,000 rpm for 1 min with a TK homomixer (produced by PRIMIX Corporation), to thereby obtain Oil Phase 2.

—Synthesis of Organic Fine Particle Emulsion (Fine Particle Dispersion Liquid)—

A reaction container equipped with a stirring rod and a thermometer was charged with 683 parts of water, 11 parts of a sodium salt of sulfuric acid ester of methacrylic acid-ethylene oxide adduct (ELEMINOL RS-30: product of Sanyo Chemical Industries, Ltd.), 138 parts of styrene, 138 parts of methacrylic acid and 1 part of ammonium persulfate, and the resultant mixture was stirred at 400 rpm for 15 min to prepare a white emulsion. The thus-obtained emulsion was heated to 75° C. and allowed to react for 5 hours. Subsequently, 30 parts of a 1% by mass aqueous ammonium persulfate solution was added to the reaction mixture, followed by aging at 75° C. for 5 hours, to thereby prepare an aqueous dispersion liquid, i.e., Fine Particle Dispersion Liquid 1 of a vinyl resin (a copolymer of styrene/methacrylic acid/sodium salt of sulfuric acid ester of methacrylic acid ethylene oxide adduct). The thus-prepared Fine Particle Dispersion Liquid 2 had a volume average particle diameter of 0.14 μm as measured with LA-920 (product of Horiba, Ltd.). Part of Fine Particle Dispersion Liquid 2 was dried to separate a resin.

—Preparation of Aqueous Phase—

Water (990 parts), 83 parts of Fine Particle Dispersion Liquid 2, 37 parts of a 48.5% aqueous solution of sodium dodecyldiphenyl ether disulfonate (ELEMINOL MON-7, product of Sanyo Chemical Industries Ltd.) and 90 parts of ethyl acetate were mixed together and stirred to obtain an opaque white liquid, which was used as Aqueous Phase 2.

—Emulsification/Desolventation—

Into a container, Oil Phase 2 was charged, 1,200 parts of Aqueous Phase 2 was added thereto, and the resultant mixture was mixed with a TK homomixer at 13,000 rpm for 20 minutes, to thereby produce Emulsified Slurry 2.

A container equipped with a stirrer and a thermometer was charged with Emulsified Slurry 2, followed by removing a solvent (desolventation) at 30° C. for 8 hours and aging at 45° C. for 4 hours, to thereby produce Dispersion Slurry 2.

—Washing/Drying—

Dispersion Slurry 2 (100 parts) was filtrated under reduced pressure and then subjected twice to a series of treatments (1) to (4) described below, to thereby produce Filtration Cake 2:

(1): 100 parts of ion-exchanged water was added to the filtration cake, followed by mixing with a TK homomixer (at 12,000 rpm for 10 minutes) and then filtration;

(2): 100 parts of 10% aqueous sodium hydroxide solution was added to the filtration cake obtained in (1), followed by mixing with the TK homomixer (at 12,000 rpm for 30 minutes) and then filtration under reduced pressure;

(3): 100 parts of 10% by mass hydrochloric acid was added to the filtration cake obtained in (2), followed by mixing with the TK homomixer (at 12,000 rpm for 10 minutes) and then filtration; and (4): 300 parts of ion-exchanged water was added to the filtration cake obtained in (3), followed by mixing with the TK homomixer (at 12,000 rpm for 10 minutes) and then filtration.

Filtration Cake 2 was dried with an air-circulating drier at 45° C. for 48 hours, and then sieved with a mesh having an aperture of 75 μm, to thereby produce Toner 20.

The volume average particle diameter of the obtained toner, the glass transition temperature measured at the first temperature rise in DSC measurement of the toner (i.e., Tg1st), and the glass transition temperature measured at the second temperature rise in DSC measurement of the toner (i.e., Tg2nd) are shown in Tables 4-1 and 4-2.

In the toner, the amount of the crystalline polyester resin (W2), the amount of the releasing agent (W3), and the amount of the graft-modified polymer (W4), with respect to 100 parts of the toner (W1=100) are shown in Tables 4-1 and 4-2.

The SP value of each component in the toner and relations of the SP values are shown in Tables 5-1 and 5-2.

The obtained toner was evaluated in the same manner as in Example 1. The results are shown in Table 6.

Comparative Example 1

<Preparation of Toner

A toner of Comparative Example 1 was produced in the same manner as in Example 1, except that Graft-Modified Polymer 1 was not added in the Preparation of Pigment-Wax Dispersion Liquid.

The volume average particle diameter of the obtained toner, the glass transition temperature measured at the first temperature rise in DSC measurement of the toner (i.e., Tg 1st), and the glass transition temperature measured at the second temperature rise in DSC measurement of the toner (i.e., Tg2nd) are shown in Tables 4-1 and 4-2.

In the toner, the amount of the crystalline polyester resin (W2), the amount of the releasing agent (W3), and the amount of the graft-modified polymer (W4), with respect to 100 parts of the toner (W1=100) are shown in Tables 4-1 and 4-2.

The SP value of each component in the toner and relations of the SP values are shown in Tables 5-1 and 5-2.

The obtained toner was evaluated in the same manner as in Example 1. The results are shown in Table 6.

Comparative Example 2

<Preparation of Toner

A toner of Comparative Example 2 was produced in the same manner as in Example 1, except that Graft-Modified Polymer 1 was replaced with Graft-Modified Polymer 3.

The volume average particle diameter of the obtained toner, the glass transition temperature measured at the first temperature rise in DSC measurement of the toner (i.e., Tg1st), and the glass transition temperature measured at the second temperature rise in DSC measurement of the toner (i.e., Tg2nd) are shown in Tables 4-1 and 4-2.

In the toner, the amount of the crystalline polyester resin (W2), the amount of the re leasing agent (W3), and the amount of the graft-modified polymer (W4), with respect to 100 parts of the toner (W1=100) are shown in Tables 4-1 and 4-2.

The SP value of each component in the toner and relations of the SP values are shown in Tables 5-1 and 5-2.

The obtained toner was evaluated in the same manner as in Example 1. The results are shown in Table 6.

Comparative Example 3

<Preparation of Toner

A toner of Comparative Example 3 was produced in the same manner as in Example 1, except that Graft-Modified Polymer 1 was replaced with Graft-Modified Polymer 4.

The volume average particle diameter of the obtained toner, the glass transition temperature measured at the first temperature rise in DSC measurement of the toner (i.e., Tg1st), and the glass transition temperature measured at the second temperature rise in DSC measurement of the toner (i.e., Tg2nd) are shown in Tables 4-1 and 4-2.

In the toner, the amount of the crystalline polyester resin (W2), the amount of the releasing agent (W3), and the amount of the graft-modified polymer (W4), with respect to 100 parts of the toner (W1=100) are shown in Tables 4-1 and 4-2.

The SP value of each component in the toner and relations of the SP values are shown in Tables 5-1 and 5-2.

The obtained toner was evaluated in the same manner as in Example 1. The results are shown in Table 6.

Comparative Example 4

<Preparation of Toner

A toner of Comparative Example 4 was produced in the same manner as in Example 1, except that Graft-Modified Polymer 1 was replaced with Graft-Modified Polymer 5.

The volume average particle diameter of the obtained toner, the glass transition temperature measured at the first temperature rise in DSC measurement of the toner (i.e., Tg1st), and the glass transition temperature measured at the second temperature rise in DSC measurement of the toner (i.e., Tg2nd) are shown in Tables 4-1 and 4-2.

In the toner, the amount of the crystalline polyester resin (W2), the amount of the releasing agent (W3), and the amount of the graft-modified polymer (W4), with respect to 100 parts of the toner (W1=100) are shown in Tables 4-1 and 4-2.

The SP value of each component in the toner and relations of the SP values are shown in Tables 5-1 and 5-2.

The obtained toner was evaluated in the same manner as in Example 1. The results are shown in Table 6.

Comparative Example 5

<Preparation of Toner

A toner of Comparative Example 5 was produced in the same manner as in Example 1, except that Non-Crystalline Polyester Resin 1 was replaced with Non-Crystalline Polyester Resin 2, that Crystalline Polyester Resin Dispersion Liquid 1 was replaced with Crystalline Polyester Resin Dispersion Liquid 3, and that Graft-Modified Polymer 1 was replaced with Graft-Modified Polymer 14.

The volume average particle diameter of the obtained toner, the glass transition temperature measured at the first temperature rise in DSC measurement of the toner (i.e., Tg1st), and the glass transition temperature measured at the second temperature rise in DSC measurement of the toner (i.e., Tg2nd) are shown in Tables 4-1 and 4-2.

In the toner, the amount of the crystalline polyester resin (W2), the amount of the releasing agent (W3), and the amount of the graft-modified polymer (W4), with respect to 100 parts of the toner (W1=100) are shown in Tables 4-1 and 4-2.

The SP value of each component in the toner and relations of the SP values are shown in Tables 5-1 and 5-2.

The obtained toner was evaluated in the same manner as in Example 1. The results are shown in Table 6.

Comparative Example 6

<Preparation of Toner

A toner of Comparative Example 6 was produced in the same manner as in Example 1, except that Non-Crystalline Polyester Resin 1 was replaced with Non-Crystalline Polyester Resin 4, and that Graft-Modified Polymer 1 was replaced with Graft-Modified Polymer 7.

The volume average particle diameter of the obtained toner, the glass transition temperature measured at the first temperature rise in DSC measurement of the toner (i.e., Tg1st), and the glass transition temperature measured at the second temperature rise in DSC measurement of the toner (i.e., Tg2nd) are shown in Tables 4-1 and 4-2.

In the toner, the amount of the crystalline polyester resin (W2), the amount of the releasing agent (W3), and the amount of the graft-modified polymer (W4), with respect to 100 parts of the toner (W1=100) are shown in Tables 4-1 and 4-2.

The SP value of each component in the toner and relations of the SP values are shown in Tables 5-1 and 5-2.

The obtained toner was evaluated in the same manner as in Example 1. The results are shown in Table 6.

Comparative Example 7

<Preparation of Toner

A toner of Comparative Example 7 was produced in the same manner as in Example 1, except that Crystalline Polyester Resin Dispersion Liquid 1 was replaced with Crystalline Polyester Resin Dispersion Liquid 4.

The volume average particle diameter of the obtained toner, the glass transition temperature measured at the first temperature rise in DSC measurement of the toner (i.e., Tg1st), and the glass transition temperature measured at the second temperature rise in DSC measurement of the toner (i.e., Tg2nd) are shown in Tables 4-1 and 4-2.

In the toner, the amount of the crystalline polyester resin (W2), the amount of the releasing agent (W3), and the amount of the graft-modified polymer (W4), with respect to 100 parts of the toner (W1=100) are shown in Tables 4-1 and 4-2.

The SP value of each component in the toner and relations of the SP values are shown in Tables 5-1 and 5-2.

The obtained toner was evaluated in the same manner as in Example 1. The results are shown in Table 6.

Comparative Example 8

<Preparation of Toner

A toner of Comparative Example 8 was produced in the same manner as in Example 1, except that Crystalline Polyester Resin Dispersion Liquid 1 was replaced with Crystalline Polyester Resin Dispersion Liquid 2.

The volume average particle diameter of the obtained toner, the glass transition temperature measured at the first temperature rise in DSC measurement of the toner (i.e., Tg1st), and the glass transition temperature measured at the second temperature rise in DSC measurement of the toner (i.e., Tg2nd) are shown in Tables 4-1 and 4-2.

In the toner, the amount of the crystalline polyester resin (W2), the amount of the releasing agent (W3), and the amount of the graft-modified polymer (W4), with respect to 100 parts of the toner (W1=100) are shown in Tables 4-1 and 4-2.

The SP value of each component in the toner and relations of the SP values are shown in Tables 5-1 and 5-2.

The obtained toner was evaluated in the same manner as in Example 1. The results are shown in Table 6.

Comparative Example 9

<Preparation of Toner

A toner of Comparative Example 9 was produced in the following manner.

| Composition of Toner | |
|---|---|
| Crystalline Polyester Resin 5 | 6 parts |
| Non-Crystalline Polyester Resin 3 | 80 parts |
| Graft-Modified Polymer 7 | 1.6 parts |
| Colorant: carbon black C-44 (product of Mitsubishi Chemical Corporation, an average particle size: 24 nm, a BET specific surface area: 125 $m^2/g$) | 7.4 parts |
| CCA: BONTRON E-84 (ORIENT CHEMICAL INDUSTRIES CO., LTD) | 1 part |
| Releasing Agent 3: polyethylene wax (product of Sanyo Chemical Industries Ltd., a melting point: 99° C., a SP value: 8.8) | 4 parts |

These compositions were sufficiently mixed with SUPER-MIXER (SMV-200, product of KAWATA MFG Co., Ltd.), to obtain a toner material powder mixture. The toner material powder mixture was fed to a material feeding hopper of a BUSS Cokneader (TCS-100, product of BUSS), and mixed and kneaded at a feed rate of 120 kg/h.

The obtained kneaded product was rolled and cooled with a double-belt cooler, coarsely pulverized with a hammer mill, and then finely pulverized with a jet stream pulverizer (I-20 jet mill, product of Nippon Pneumatic Mfg. Co., Ltd.), followed by classifying fine particles with a wind power classifier (DS-20, DS-10 classifier, product of Nippon Pneumatic Mfg. Co., Ltd.). Thereafter, the obtained product was left to stand at 50° C. for 24 hours so as to perform annealing.

To 100 parts of the thus-obtained toner base, 0.7 parts of hydrophobic silica and 0.3 parts of hydrophobized titanium oxide were added and mixed with HENSCHEL MIXER, to obtain the toner of Comparative Example 9.

The volume average particle diameter of the obtained toner, the glass transition temperature measured at the first temperature rise in DSC measurement of the toner (i.e., Tg1st), and the glass transition temperature measured at the second temperature rise in DSC measurement of the toner (i.e., Tg2nd) are shown in Tables 4-1 and 4-2.

In the toner, the amount of the crystalline polyester resin (W2), the amount of the releasing agent (W3), and the amount of the graft-modified polymer (W4), with respect to 100 parts of the toner (W1=100) are shown in Tables 4-1 and 4-2.

The SP value of each component in the toner and relations of the SP values are shown in Tables 5-1 and 5-2.

The obtained toner was evaluated in the same manner as in Example 1. The results are shown in Table 6.

Comparative Example 10

<Preparation of Toner

A toner of Comparative Example 10 was produced in the following manner.

| Composition of Toner | |
|---|---|
| Crystalline Polyester Resin 6 | 73 parts |
| Non-Crystalline Polyester Resin 6 | 11 parts |
| Graft-Modified Polymer 15 | 6 parts |
| Colorant: carbon black C-44 (product of Mitsubishi Chemical Corporation, an average particle size: 24 nm, a BET specific surface area: 125 $m^2/g$) | 7 parts |
| CCA: BONTRON E-84 (ORIENT CHEMICAL INDUSTRIES CO., LTD) | 1 part |
| Releasing Agent 3: polyethylene wax (product of Sanyo Chemical Industries Ltd., a melting point: 99° C., a SP value: 8.8) | 4 parts |

These compositions were sufficiently mixed with SUPER-MIXER (SMV-200, product of KAWATA MFG Co., Ltd.), to obtain a toner material powder mixture. The toner material powder mixture was fed to a material feeding hopper of a BUSS Cokneader (TCS-100, product of BUSS), and mixed and kneaded at a feed rate of 120 kg/h.

The obtained kneaded product was rolled and cooled with a double-belt cooler, coarsely pulverized with a hammer mill, and then finely pulverized with a jet stream pulverizer (I-20 jet mill, product of Nippon Pneumatic Mfg. Co., Ltd.), followed by classifying fine particles with a wind power classifier (DS-20, DS-10 classifier, product of Nippon Pneumatic Mfg. Co., Ltd.). Thereafter, the obtained product was left to stand at 50° C. for 24 hours so as to perform annealing.

To 100 parts of the thus-obtained toner base, 0.7 parts of hydrophobic silica and 0.3 parts of hydrophobized titanium oxide were added and mixed with HENSCHEL MIXER, to obtain the toner of Comparative Example 10.

The volume average particle diameter of the obtained toner, the glass transition temperature measured at the first temperature rise in DSC measurement of the toner (i.e., Tg1st), and the glass transition temperature measured at the second temperature rise in DSC measurement of the toner (i.e., Tg2nd) are shown in Tables 4-1 and 4-2.

In the toner, the amount of the crystalline polyester resin (W2), the amount of the releasing agent (W3), and the amount of the graft-modified polymer (W4), with respect to 100 parts of the toner (W1=100) are shown in Tables 4-1 and 4-2.

The SP value of each component in the toner and relations of the SP values are shown in Tables 5-1 and 5-2.

The obtained toner was evaluated in the same manner as in Example 1. The results are shown in Table 6.

TABLE 4-1

| | | Toner components | | | | Volume | | | | W2 | | | | |
|---|---|---|---|---|---|---|---|---|---|---|---|---|---|---|
| | | Non-crystalline polyester resin | Crystal-line polyester resin | Releas-ing agent | Graft-modified polymer | average particle diameter (μm) | Tg1st (° C.) | Tg2nd (° C.) | W1 Toner | Crystal-line polyester resin | W3 Releasing agent | W4 Graft-modified polymer | W4/W2 | W4/W3 |
| Ex. | 1 | 1 | 1 | 1 | 1 | 5.5 | 58 | 30 | 100 | 6 | 4 | 1.6 | 0.3 | 0.4 |
| | 2 | 2 | 1 | 1 | 1 | 5.5 | 58 | 32 | 100 | 6 | 4 | 1.6 | 0.3 | 0.4 |
| | 3 | 1 | 1 | 1 | 2 | 5.5 | 58 | 30 | 100 | 6 | 4 | 1.6 | 0.3 | 0.4 |
| | 4 | 1 | 2 | 1 | 1 | 5.5 | 56 | 32 | 100 | 6 | 4 | 1.6 | 0.3 | 0.4 |
| | 5 | 1 | 1 | 2 | 1 | 5.5 | 58 | 32 | 100 | 6 | 4 | 1.6 | 0.3 | 0.4 |
| | 6 | 3 | 1 | 1 | 1 | 5.5 | 56 | 32 | 100 | 6 | 4 | 1.6 | 0.3 | 0.4 |
| | 7 | 1 | 1 | 1 | 6 | 5.5 | 57 | 32 | 100 | 6 | 4 | 1.6 | 0.3 | 0.4 |
| | 8 | 1 | 1 | 1 | 7 | 5.5 | 59 | 31 | 100 | 6 | 4 | 1.6 | 0.3 | 0.4 |
| | 9 | 1 | 1 | 1 | 8 | 5.5 | 57 | 33 | 100 | 6 | 4 | 1.6 | 0.3 | 0.4 |
| | 10 | 1 | 1 | 1 | 9 | 5.5 | 59 | 31 | 100 | 6 | 4 | 1.6 | 0.3 | 0.4 |
| | 11 | 1 | 1 | 1 | 10 | 5.5 | 59 | 33 | 100 | 6 | 4 | 1.6 | 0.3 | 0.4 |
| | 12 | 1 | 1 | 1 | 11 | 5.5 | 57 | 30 | 100 | 6 | 4 | 1.6 | 0.3 | 0.4 |
| | 13 | 1 | 1 | 1 | 12 | 5.5 | 59 | 35 | 100 | 6 | 4 | 1.6 | 0.3 | 0.4 |
| | 14 | 1 | 1 | 1 | 13 | 5.5 | 56 | 29 | 100 | 6 | 4 | 1.6 | 0.3 | 0.4 |
| | 15 | 4 | 1 | 1 | 6 | 5.5 | 58 | 32 | 100 | 6 | 4 | 1.6 | 0.3 | 0.4 |
| | 16 | 5 | 1 | 1 | 1 | 5.5 | 58 | 31 | 100 | 6 | 4 | 1.6 | 0.3 | 0.4 |
| | 17 | 1 | 3 | 1 | 7 | 5.5 | 58 | 33 | 100 | 6 | 4 | 1.6 | 0.3 | 0.4 |
| | 18 | 1 | 2 | 1 | 7 | 5.5 | 58 | 33 | 100 | 6 | 4 | 1.6 | 0.3 | 0.4 |
| | 19 | 5 | 3 | 1 | 1 | 5.5 | 58 | 33 | 100 | 6 | 4 | 1.6 | 0.3 | 0.4 |
| | 20 | 1 | 1 | 1 | 1 | 5.5 | 55 | 34 | 100 | 6 | 4 | 1.6 | 0.3 | 0.4 |

TABLE 4-2

| | | Toner components | | | | Volume | | | | W2 | | | | |
|---|---|---|---|---|---|---|---|---|---|---|---|---|---|---|
| | | Non-crystalline polyester resin | Crystal-line polyester resin | Releas-ing agent | Graft-modified polymer | average particle diameter (μm) | Tg1st (° C.) | Tg2nd (° C.) | W1 Toner | Crystal-line polyester resin | W3 Releasing agent | W4 Graft-modified polymer | W4/W2 | W4/W3 |
| Comp. | 1 | 1 | 1 | 1 | — | 5.5 | 58 | 32 | 100 | 6 | 4 | 0 | 0 | 0 |
| Ex. | 2 | 1 | 1 | 1 | 3 | 5.5 | 58 | 32 | 100 | 6 | 4 | 1.6 | 0.3 | 0.4 |
| | 3 | 1 | 1 | 1 | 4 | 5.5 | 58 | 32 | 100 | 6 | 4 | 1.6 | 0.3 | 0.4 |
| | 4 | 1 | 1 | 1 | 5 | 5.5 | 58 | 32 | 100 | 6 | 4 | 1.6 | 0.3 | 0.4 |
| | 5 | 2 | 3 | 1 | 14 | 5.5 | 58 | 32 | 100 | 6 | 4 | 1.6 | 0.3 | 0.4 |
| | 6 | 4 | 1 | 1 | 7 | 5.5 | 58 | 33 | 100 | 6 | 4 | 1.6 | 0.3 | 0.4 |
| | 7 | 1 | 4 | 1 | 1 | 5.5 | 58 | 35 | 100 | 6 | 4 | 1.6 | 0.3 | 0.4 |
| | 8 | 1 | 2 | 1 | 1 | 5.5 | 58 | 32 | 100 | 6 | 4 | 1.6 | 0.3 | 0.4 |
| | 9 | 3 | 5 | 3 | 7 | 5.5 | 56 | 42 | 100 | 6 | 4 | 1.6 | 0.3 | 0.4 |
| | 10 | 6 | 6 | 3 | 15 | 5.5 | 58 | 43 | 100 | 73 | 4 | 6 | 0.1 | 1.5 |

TABLE 5-1

| | | SP1 Non-crystalline polyester resin | SP2 Crystal-line polyester resin | SP3 Releas-ing agent | SP4 Graft-modified polymer | Satisfaction of Formula (1) | Formula (2) | | Formula (3) | | Formula (4) | |
|---|---|---|---|---|---|---|---|---|---|---|---|---|
| | | | | | | | SP1 − SP4 | Satisfaction | SP4 − SP2 | Satisfaction | SP1 − SP2 | Satisfaction |
| Ex. | 1 | 10.8 | 9.9 | 8.8 | 10.4 | satisfied | 0.4 | satisfied | 0.5 | satisfied | 0.9 | satisfied |
| | 2 | 11.1 | 9.9 | 8.8 | 10.4 | satisfied | 0.7 | satisfied | 0.5 | satisfied | 1.2 | satisfied |
| | 3 | 10.8 | 9.9 | 8.8 | 10.5 | satisfied | 0.3 | satisfied | 0.6 | satisfied | 0.9 | satisfied |
| | 4 | 10.8 | 10.3 | 8.8 | 10.4 | satisfied | 0.4 | satisfied | 0.1 | satisfied | 0.5 | satisfied |
| | 5 | 10.8 | 9.9 | 9.3 | 10.4 | satisfied | 0.4 | satisfied | 0.5 | satisfied | 0.9 | satisfied |
| | 6 | 10.8 | 9.9 | 8.8 | 10.4 | satisfied | 0.4 | satisfied | 0.5 | satisfied | 0.9 | satisfied |
| | 7 | 10.8 | 9.9 | 8.8 | 10.1 | satisfied | 0.7 | satisfied | 0.2 | satisfied | 0.9 | satisfied |
| | 8 | 10.8 | 9.9 | 8.8 | 10.5 | satisfied | 0.3 | satisfied | 0.6 | satisfied | 0.9 | satisfied |
| | 9 | 10.8 | 9.9 | 8.8 | 10.1 | satisfied | 0.7 | satisfied | 0.2 | satisfied | 0.9 | satisfied |
| | 10 | 10.8 | 9.9 | 8.8 | 10.5 | satisfied | 0.3 | satisfied | 0.6 | satisfied | 0.9 | satisfied |
| | 11 | 10.8 | 9.9 | 8.8 | 10.4 | satisfied | 0.4 | satisfied | 0.5 | satisfied | 0.9 | satisfied |
| | 12 | 10.8 | 9.9 | 8.8 | 10.4 | satisfied | 0.4 | satisfied | 0.5 | satisfied | 0.9 | satisfied |
| | 13 | 10.8 | 9.9 | 8.8 | 10.4 | satisfied | 0.4 | satisfied | 0.5 | satisfied | 0.9 | satisfied |
| | 14 | 10.8 | 9.9 | 8.8 | 10.4 | satisfied | 0.4 | satisfied | 0.5 | satisfied | 0.9 | satisfied |
| | 15 | 10.6 | 9.9 | 8.8 | 10.1 | satisfied | 0.5 | satisfied | 0.2 | satisfied | 0.7 | satisfied |
| | 16 | 11.0 | 9.9 | 8.8 | 10.4 | satisfied | 0.6 | satisfied | 0.5 | satisfied | 1.1 | satisfied |
| | 17 | 10.8 | 9.6 | 8.8 | 10.5 | satisfied | 0.3 | satisfied | 0.9 | satisfied | 1.2 | satisfied |
| | 18 | 10.8 | 10.3 | 8.8 | 10.5 | satisfied | 0.3 | satisfied | 0.2 | satisfied | 0.5 | satisfied |

TABLE 5-1-continued

| | SP1 Non-crystalline polyester resin | SP2 Crystal-line polyester resin | SP3 Releas-ing agent | SP4 Graft-modified polymer | Satisfaction of Formula (1) | Formula (2) SP1 – SP4 | Formula (2) Satisfaction | Formula (3) SP4 – SP2 | Formula (3) Satisfaction | Formula (4) SP1 – SP2 | Formula (4) Satisfaction |
|---|---|---|---|---|---|---|---|---|---|---|---|
| 19 | 11.0 | 9.6 | 8.8 | 10.4 | satisfied | 0.6 | satisfied | 0.8 | satisfied | 1.4 | satisfied |
| 20 | 10.8 | 9.9 | 8.8 | 10.4 | satisfied | 0.4 | satisfied | 0.5 | satisfied | 0.9 | satisfied |

TABLE 5-2

| | | SP1 Non-crystalline polyester resin | SP2 Crystal-line polyester resin | SP3 Releas-ing agent | SP4 Graft-modified polymer | Satisfaction of Formula (1) | Formula (2) SP1 – SP4 | Formula (2) Satisfaction | Formula (3) SP4 – SP2 | Formula (3) Satisfaction | Formula (4) SP1 – SP2 | Formula (4) Satisfaction |
|---|---|---|---|---|---|---|---|---|---|---|---|---|
| Comp. | 1 | 10.8 | 9.9 | 8.8 | — | Not satisfied | — | Not satisfied | — | Not satisfied | 0.9 | satisfied |
| Ex. | 2 | 10.8 | 9.9 | 8.8 | 10.6 | satisfied | 0.2 | satisfied | 0.7 | satisfied | 0.9 | satisfied |
| | 3 | 10.8 | 9.9 | 8.8 | 9.7 | Not satisfied | 1.1 | satisfied | −0.2 | Not satisfied | 0.9 | satisfied |
| | 4 | 10.8 | 9.9 | 8.8 | 11.0 | satisfied | −0.2 | Not satisfied | 1.1 | Not satisfied | 0.9 | satisfied |
| | 5 | 11.1 | 9.6 | 8.8 | 10.0 | satisfied | 1.1 | Not satisfied | 0.4 | satisfied | 1.5 | Not satisfied |
| | 6 | 10.6 | 9.9 | 8.8 | 10.5 | satisfied | 0.1 | Not satisfied | 0.6 | satisfied | 0.7 | satisfied |
| | 7 | 10.8 | 9.3 | 8.8 | 10.4 | satisfied | 0.4 | satisfied | 1.1 | Not satisfied | 1.5 | Not satisfied |
| | 8 | 10.8 | 10.3 | 8.8 | 10.4 | satisfied | 0.4 | satisfied | 0.1 | Not satisfied | 0.5 | satisfied |
| | 9 | 10.8 | 10.8 | 8.8 | 10.2 | Not satisfied | 0.6 | satisfied | −0.6 | Not satisfied | 0.0 | Not satisfied |
| | 10 | 11.0 | 11.1 | 8.8 | 11.0 | Not satisfied | 0.0 | Not satisfied | −0.1 | Not satisfied | −0.1 | Not satisfied |

TABLE 6

| | | Low temperature fixing ability Minimum fixing temperature (° C.) | High temperature offset resistance Maximum fixing temperature (° C.) | Heat resistant storage stability | Fogging | Filming |
|---|---|---|---|---|---|---|
| Ex. | 1 | 120 | 190 | A | A | A |
| | 2 | 125 | 185 | A | B | B |
| | 3 | 120 | 190 | A | A | A |
| | 4 | 125 | 190 | A | B | B |
| | 5 | 125 | 180 | A | A | B |
| | 6 | 125 | 185 | B | B | B |
| | 7 | 120 | 190 | A | A | A |
| | 8 | 120 | 185 | A | A | A |
| | 9 | 125 | 190 | B | B | B |
| | 10 | 125 | 180 | A | B | B |
| | 11 | 125 | 190 | A | B | A |
| | 12 | 120 | 185 | B | A | A |
| | 13 | 125 | 190 | B | B | B |
| | 14 | 125 | 180 | B | B | B |
| | 15 | 125 | 190 | A | B | A |
| | 16 | 120 | 185 | B | A | A |
| | 17 | 120 | 190 | B | A | A |
| | 18 | 125 | 190 | A | B | A |
| | 19 | 125 | 180 | B | B | A |
| | 20 | 125 | 185 | B | B | B |
| Comp. | 1 | 130 | 180 | D | D | D |
| Ex. | 2 | 130 | 185 | C | C | C |
| | 3 | 130 | 190 | C | C | D |
| | 4 | 130 | 190 | C | C | C |
| | 5 | 130 | 190 | C | D | D |
| | 6 | 130 | 185 | C | C | C |
| | 7 | 130 | 190 | C | D | D |
| | 8 | 130 | 185 | C | C | C |
| | 9 | 135 | 185 | C | D | D |
| | 10 | 135 | 185 | C | D | D |

As described above, in each of Examples 1 to 20, the obtained toner had the desirable results in all evaluation items of the low temperature fixing ability, high temperature offset resistance, and heat resistant storage stability, image fogging, and filming.

In Comparative Example 1, since the toner did not contain the graft-modified polymer, fogging and filming were degraded.

In Comparative Example 2, the toner satisfied the relations of the SP values represented by Formulas (1) to (3). However, it was presumed that the heat resistant storage stability, fogging, and filming were degraded, since the graft-modified polymer had the same skeleton as that of the crystalline polyester resin in the toner, and the graft-modified polymer was easily compatible with the crystalline polyester resin, causing decrease in dispersibility of the polyester resin with the graft-modified polymer, the dispersion diameter of the crystalline polyester resin became large, and the crystalline polyester resin was easily, unevenly localized in the toner surface.

In each of Comparative Examples 3 to 8, the toner contained the graft-modified polymer used in the present invention. However, it was presumed that the heat resistant storage stability, fogging and filming were degraded, since at least one of the relations represented by Formulas (1) to (3) was not satisfied, the effect of the graft-modified polymer as a dispersant did not sufficiently exhibit, a dispersion diameter of the crystalline polyester resin became large, and the crystalline polyester resin was easily, unevenly localized in the toner surface.

In each of Comparative Examples 9 and 10, the crystalline polyester resin had the high SP value. It was presumed that the heat resistant storage stability, fogging and filming were degraded, since at least one of the relations represented by Formulas (1) to (3) was not satisfied, the effect of the graft-modified polymer as a dispersant did not sufficiently exhibit, a dispersion diameter of the crystalline polyester resin became large, and the crystalline polyester resin was easily, unevenly localized in the toner surface.

The toner of the present invention is suitably used for forming high quality image, since it has excellent low temperature fixing ability, high temperature offset resistance, and heat resistant storage stability without occurring filming.

This application claims priority to Japanese patent application No. 2010-194609, filed on Aug. 31, 2010, and incorporated herein by reference.

What is claimed is:

1. A toner comprising:

a non-crystalline polyester resin;

a crystalline polyester resin;

a releasing agent;

a graft-modified polymer; and a colorant, wherein the graft-modified polymer is a polymer having a glass transition temperature of higher than 40° C. but lower than 80° C., and obtained by grafting an acrylic resin onto at least one of a hydrocarbon wax and a crystalline polyester resin, and wherein a SP value of the non-crystalline polyester resin is defined as SP1, a SP value of the crystalline polyester resin is defined as SP2, a SP value of the releasing agent is defined as SP3, and a SP value of the graft-modified polymer is defined as SP4, and SP1, SP2, SP3 and SP4 satisfy relations represented by Formulas (1) to (3):

| | |
|---|---|
| $SP1 > SP4 > SP2 > SP3$ | Formula (1), |
| $0.1 < SP1 - SP4 < 1.0$ | Formula (2), and |
| $0.1 < SP4 - SP2 < 1.0$ | Formula (3). |

2. The toner according to claim 1, wherein the amount of the at least one of the hydrocarbon wax and the crystalline polyester resin in the graft-modified polymer is 2 parts by mass to 25 parts by mass, relative to 100 parts by mass of the graft-modified polymer.

3. The toner according to claim 1, wherein the weight average molecular weight of the at least one of the hydrocarbon wax and the crystalline polyester resin in the graft-modified polymer is 500 to 20,000.

4. The toner according to claim 1, wherein the weight average molecular weight of the acrylic resin in the graft-modified polymer is 5,000 to 100,000.

5. The toner according to claim 1, wherein the crystalline polyester resin has a constituent unit derived from saturated aliphatic dicarboxylic acid and a constituent unit derived from saturated aliphatic diol.

6. The toner according to claim 1, wherein the crystalline polyester resin has a melting point of 60° C. or higher but lower than 80° C.

7. The toner according to claim 1, wherein the releasing agent is a hydrocarbon wax, and the hydrocarbon wax has a melting point of 60° C. or higher but lower than 95° C.

8. The toner according to claim 1, wherein the SP1 and the SP2 satisfy a relation represented by Formula (4):

| | |
|---|---|
| $0.5 < SP1 - SP2 < 1.5$ | Formula (4). |

9. The toner according to claim 1, wherein a mass of the toner is defined as W1, a mass of the crystalline polyester resin in the toner is defined as W2, a mass of the releasing agent in the toner is defined as W3, and a mass of the graft-modified polymer in the toner is defined as W4, and W1, W2, W3 and W4 satisfy relations represented by Formulas (5) to (7):

| | |
|---|---|
| $W1 : W2 : W3 : W4 = 100 : 2 \text{ to } 20 : 2 \text{ to } 10 : 1 \text{ to } 10$ | Formula (5) |
| $0.2 < W4/W2 < 1.0$ | Formula (6), and |
| $0.2 < W4/W3 < 1.0$ | Formula (7). |

10. The toner according to claim 1, wherein the glass transition temperature of the toner at the first temperature rise (Tg1st) in a differential scanning calorimetry measurement is 45° C. or higher but lower than 65° C.

11. The toner according to claim 1, wherein the glass transition temperature of the toner at the second temperature rise (Tg2nd) in a differential scanning calorimetry measurement is 20° C. or higher but lower than 40° C.

12. The toner according to claim 1, wherein an orthodichlorobenzene soluble content of the crystalline polyester resin has a weight average molecular weight (Mw) of 3,000 to 30,000, a number average molecular weight (Mn) of 1,000 to 10,000, and a ratio Mw/Mn of 1 to 10 as determined by gel permeation chromatography.

13. The toner according to claim 1, obtained by dispersing in an aqueous medium an oil phase containing at least the non-crystalline polyester resin, the crystalline polyester resin, the releasing agent, the graft-modified polymer and the colorant.

14. The toner according to claim 13, wherein the dispersing the oil phase in the aqueous medium comprises:

dissolving or dispersing at least an active hydrogen group-containing compound, a polymer having a site reactive with the active hydrogen group-containing compound, the non-crystalline polyester resin, the crystalline polyester resin, the releasing agent, the graft-modified polymer and the colorant in an organic solvent, so as to form a dissolved or dispersed product, dispersing the dissolved or dispersed product in the aqueous medium, allowing the active hydrogen group-containing compound and the polymer having a site reactive with the active hydrogen group-containing compound to undergo crosslinking reaction or elongation reaction in the aqueous medium so as to obtain a dispersion liquid, and removing the organic solvent from the dispersion liquid.

* * * * *